US010316525B1

(12) United States Patent
Bilge

(10) Patent No.: US 10,316,525 B1
(45) **Date of Patent: *Jun. 11, 2019**

(54) SYSTEM AND METHOD FOR MOUNTING WALL PANELS TO A WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/945,875

(22) Filed: Apr. 5, 2018

Related U.S. Application Data

(60) Division of application No. 15/164,117, filed on May 25, 2016, now Pat. No. 10,011,997, which is a continuation-in-part of application No. 15/067,955, filed on Mar. 11, 2016, now Pat. No. 9,874,026, which is a continuation-in-part of application No. 15/047,204, filed on Feb. 18, 2016, now Pat. No. 9,834,941.

(51) Int. Cl.

| | |
|---|---|
| ***E04B 1/38*** | (2006.01) |
| ***E04F 13/26*** | (2006.01) |
| ***E04F 13/076*** | (2006.01) |
| ***E04F 13/073*** | (2006.01) |
| ***E04F 13/08*** | (2006.01) |

(52) U.S. Cl.
CPC ..... *E04F 13/26* (2013.01); *E04F 13/076* (2013.01); *E04F 13/0733* (2013.01); *E04F 13/0801* (2013.01); *E04F 13/0805* (2013.01); *E04F 13/0839* (2013.01)

(58) Field of Classification Search
CPC ..... E04F 13/26; E04F 13/0801; E04F 13/076; E04F 13/0839; E04F 13/0733; E04F 13/0805
USPC ..... 52/512
See application file for complete search history.

(56) References Cited

U.S. PATENT DOCUMENTS

| | | | |
|---|---|---|---|
| 2,348,658 | A | 5/1944 | Slaughter |
| 2,607,971 | A | 8/1952 | Bedford, Jr. |
| 2,803,321 | A | 8/1957 | Fox-Williams |
| 3,342,000 | A | 9/1967 | Cripe |
| 3,374,590 | A | 3/1968 | Kessler |
| 3,807,100 | A | 4/1974 | Kuss |
| 4,833,858 | A | 5/1989 | Hutchison |
| 4,936,065 | A | 6/1990 | Hutchison |
| 5,579,624 | A | 12/1996 | Aeberhard |
| 6,745,527 | B1 | 6/2004 | Sherman |
| 7,210,273 | B2 | 5/2007 | Zahner, III |
| 8,127,507 | B1 | 3/2012 | Bilge |
| 8,429,866 | B2 | 4/2013 | Knight et al. |
| D689,199 | S | 9/2013 | Elizarraras |

(Continued)

FOREIGN PATENT DOCUMENTS

WO 2011044696 A1 4/2011

*Primary Examiner* — Basil S Katcheves
(74) *Attorney, Agent, or Firm* — Richard M. Goldberg

(57) ABSTRACT

A system for mounting wall panels to an existing wall, including a plurality of fastening extrusions, each fastening extrusion including a base section adapted to be secured to the existing wall, at least one retaining wall extending at an angle from the base section, and a holding member on each retaining wall for holding one end of a wall panel to a respective the fastening extrusion; and wherein at least some adjacent retaining walls have different heights from each other so as to impart a three-dimensional appearance to the wall panels mounted to the existing wall.

13 Claims, 53 Drawing Sheets

(56) References Cited

U.S. PATENT DOCUMENTS

| | | | | |
|---|---|---|---|---|
| 8,739,483 | B1 | 6/2014 | Bilge | |
| 8,833,015 | B2 | 9/2014 | Bilge | |
| 8,875,467 | B2 | 11/2014 | Anastasi | |
| 8,925,271 | B1 | 1/2015 | Bilge | |
| 8,966,849 | B1 | 3/2015 | Bilge | |
| 9,163,411 | B2 | 10/2015 | Brady | |
| 9,562,361 | B2 | 2/2017 | Bilge | |
| 9,874,026 | B2 * | 1/2018 | Bilge | E04F 13/0891 |
| 2004/0134143 | A1 | 7/2004 | Boyer | |
| 2009/0241451 | A1 | 10/2009 | Griffiths | |
| 2011/0239571 | A1 | 10/2011 | Neuhofer | |
| 2013/0180202 | A1 | 7/2013 | Woods | |

* cited by examiner

SYSTEM AND METHOD FOR MOUNTING WALL PANELS TO A WALL

REFERENCE TO RELATED APPLICATION

The present application is a continuation-in-part of U.S. patent application Ser. No. 15/067,955, filed Mar. 11, 2016 and entitled SYSTEM AND METHOD FOR MOUNTING WALL PANELS SECURED TO A WALL, which in turn, is a continuation-in-part of U.S. patent application Ser. No. 15/047,024, filed Feb. 18, 2016 and entitled THERMAL BREAK SYSTEM FOR WALL PANELS SECURED TO AN EXISTING WALL, the entire disclosures of which are incorporated herein by reference.

BACKGROUND OF THE INVENTION

The present invention relates generally to a wall system, and more particularly, to a system for easily mounting wall panels over an existing wall.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes these problems is disclosed in U.S. Pat. Nos. 8,833,015, 8,739,483, 8,925,271 and 8,966,849; and pending U.S. patent application Ser. Nos. 14/044,606, 14/256,384, 14/641,097 and 14/667,297 to the same inventor herein, the entire disclosures of which are incorporated herein by reference. In these patents, each wall panel includes a main panel section and at least two bent end sections bent at a right angle in the same direction, at edges of the main panel section. Each bent end section includes a cut-out section or recess at an inner surface thereof. A fastening extrusion is secured to an existing wall for receiving the bent end sections. The fastening extrusion includes a base section and flexible and resilient bent end securing walls extending outwardly therefrom. Each bent end securing wall includes a projection on an outer surface thereof. When the bent end sections are forced in a direction toward the existing wall, the bent end sections force the respective bent end securing walls to bias away until the projections are in line with the cut-out sections or recesses, whereupon the bent end securing walls snap back to their original position in which the projections are engaged in the cut-out sections or recesses.

However, the above system utilizes bent end sections at the edges of the main panel section. This increases the material that must be used, and makes the construction more complicated.

It would therefore be desirable to provide wall panels which do not require the bent end sections, but which can easily be installed over an existing wall.

SUMMARY OF THE INVENTION

Accordingly, it is an object of the present invention to provide a system and method for easily mounting wall panels over an existing wall that overcomes the aforementioned problems.

It is another object of the present invention to provide a system and method for easily mounting wall panels over an existing wall, which utilizes a simple sliding action for assembling the wall panels.

It is still another object of the present invention to provide a system and method for easily mounting wall panels over an existing wall which provides support at an intermediate position of the wall panels where the sliding action occurs.

It is yet another object of the present invention to provide a system and method for easily mounting wall panels over an existing wall which easily captures and restrains ends of the wall panels.

It is a further object of the present invention to provide a system and method for easily mounting wall panels over an existing wall which allows for thermal expansion of the wall panels.

In accordance with an aspect of the present invention, a system for mounting wall panels to an existing wall, includes a plurality of fastening extrusions. Each fastening extrusion includes a base section adapted to be secured to the existing wall, at least one retaining wall extending at an angle from the base section, and a holding member on each retaining wall for holding one end of a wall panel to a respective the fastening extrusion; and wherein at least some adjacent retaining walls have different heights from each other so as to impart a three-dimensional appearance to the wall panels mounted to the existing wall.

Each fastening extrusion includes two spaced apart retaining walls having different heights from each other so as to secure two adjacent wall panels to the existing wall at different heights from each other in order to impart a three-dimensional appearance. Alternatively, two retaining walls associated with opposite sides of the same wall panel have different heights so as to mount the wall panel in an inclined manner on the existing wall.

There are also a plurality of intermediary supports for supporting the wall panels at a position between side edges of the wall panels. Each intermediary support includes an intermediary support base, two spacing walls which secure the intermediary support base to the existing wall, with a spacing between the existing wall and the intermediary support base plate, with the two spacing walls having different heights corresponding to the different heights of the two retaining walls, and a sliding member adapted to be slidably connected with the base, such that one the wall panel is adapted to be secured to the sliding member for sliding movement with the sliding member relative to the intermediary support base.

In one embodiment, the two spacing walls form part of a U-channel furring having lower ends thereof connected to the existing wall and further including a connection wall which connects upper ends of the two spacing walls together, with the intermediary support base mounted on the connection wall.

In another embodiment, the two spacing walls form part of a U-channel furring having lower ends thereof connected to the existing wall and wherein the intermediary support base connects upper ends of the two spacing walls together.

In accordance with another aspect of the present invention, there are a plurality of intermediary supports for supporting the wall panels at a position between side edges of the wall panels. Each intermediary support includes an intermediary support base adapted to be secured to the existing wall; a sliding member adapted to be slidably connected with the base; and a securement arrangement for securing the sliding member to a wall panel. The securement arrangement includes either an adhesive member secured between the sliding member and the wall panel, or at least one projection extending from the sliding member or the wall panel, and at least one groove in the other of the sliding member and the wall panel for receiving the at least one projection, each groove having a shape complementary to each respective projection received therein.

Preferably, each projection has a shape in cross-section selected from the group consisting of a trapezoid, diverging planar walls, a T-shape, and a bulbous shape.

There is further a thermally insulating spacer block positioned between the sliding member and the base.

The intermediary support base includes a base plate adapted to be secured to the existing wall, a first retaining wall connected with a first side of the base plate, and a second retaining wall connected with a second opposite side of the base plate. The sliding member includes an inverted U-shaped central member dimensioned to fit between the first and second retaining walls, a first wing member at a first side of the central member for engagement within the first retaining wall, and a second wing member at a second opposite side of the central member for engagement within the second retaining wall; and wherein the thermally insulating spacer block is positioned between the inverted U-shaped central member of the sliding member and the base.

In another embodiment, there is a stiffener element which fixes the distance between adjacent support bases and which provides further support for wall panels positioned thereon. Each stiffener element includes a stiffener plate; first and second separation walls extending from the underside of stiffener plate and against which adjacent intermediary support bases abut in order to fix the distance between adjacent support bases; and first and second limit walls at a center portion thereof against which ends of adjacent wall panels are adapted to abut when seated on the stiffener plate.

In a further embodiment, the intermediary support base includes: a base section adapted to be secured to the existing wall either directly or via a furring member, and a generally L-shaped retaining wall extends outwardly from the base section and defining a gap between the base section and the generally L-shaped retaining wall. The sliding member is formed by a generally U-shaped member formed by two parallel, spaced apart walls connected by a connecting wall, with one of the spaced apart walls adapted to slide and be captured within the gap to secure the sliding member to the intermediary support base; and a securement arrangement is connected with the other spaced apart wall of the sliding member for securing the sliding member to a wall panel.

The securement arrangement includes one of the following: an adhesive member secured between the sliding member and the wall panel, at least one projection extending from the sliding member or the wall panel, and at least one groove in the other of the sliding member and the wall panel for receiving the at least one projection, each groove having a shape complementary to each respective projection received therein, and screws for securing the sliding member to the wall panel. Each projection has a shape in cross-section selected from the group consisting of a trapezoid, diverging planar walls, a T-shape, and a bulbous shape.

In accordance with still another embodiment of the present invention, there is provided a thermal break system for securing wall panels to an existing wall, in order to mount the wall panels in covering relation to the existing wall. The thermal break system includes a furring member connected between the existing wall and the wall panels. Each furring member includes at least one first foot wall adapted to be connected to the existing wall, at least one spacing wall having one end connected to the at least one first foot wall and extending in a direction transverse to the at least one first foot wall and the existing wall, with the at least one foot wall extending outwardly to one side of the at least one spacing wall, and a connection wall connected to an opposite end of the at least one spacing wall and extending in a direction transverse to the at least one spacing wall for connection either directly to adjacent wall panels, or indirectly to adjacent wall panels through at least one intermediary member. The connection wall includes a first section extending to the one side of the at least one at least one spacing wall. A first thermal insulation cover is positioned around the at least one foot wall; and a second thermal insulation cover is positioned around the first section of the connection wall.

In accordance with yet another embodiment of the present invention, a system for mounting wall panels to an existing wall, includes plurality of fastening extrusions. Each fastening extrusion includes an extrusion base section adapted to be secured to the existing wall, at least one retaining wall extending at an angle from the base section, a holding member on each retaining wall, and a bent wall in the extrusion base section which is bent toward the holding member to form a gap therebetween to receive one side edge of one wall panel. A thin walled thermal insulation cover is positioned in the gap for receiving the one side of the one wall panel.

The thin walled thermal insulation cover includes an inner surface in facing relation to an end edge at the one side of the one wall panel, with an elongated bead formed at the inner surface and against which the end edge of the one wall panel abuts to allow for thermal expansion.

In accordance with a further aspect of the present invention, a system for mounting wall panels to an existing wall, includes a plurality of fastening extrusions. Each fastening extrusion includes an extrusion base section adapted to be secured to the existing wall, at least one retaining wall extending at an angle from the base section, a holding member on each retaining wall, and a bent wall in the extrusion base section which is bent toward the holding member to form a gap therebetween to receive one side edge of one wall panel. A thermal insulation cover is positioned around the extrusion base section to an outside of each bent wall.

In accordance with a still further aspect of the present invention, a system for mounting wall panels to an existing wall, includes a plurality of fastening extrusions. Each fastening extrusion includes an extrusion base section adapted to be secured to the existing wall, two parallel, spaced apart retaining walls extending at an angle from the base section, an outwardly extending holding wall on each retaining wall, and a bent wall in the extrusion base section to an outside of each retaining wall and which is bent toward each holding wall to form a gap therebetween to receive one side edge of one wall panel. A closure member is secured to the fastening extrusion in covering relation to the holding walls, the retaining walls and a space between the retaining walls. The closure member includes a center section which covers the space between the retaining walls, L-shaped cover walls extending from the center section and which cover the holding walls, two parallel, spaced apart walls extending from an underside of the center section, and first tabs formed at free ends of the spaced apart walls. A spacer block is mounted on the extrusion base between the retaining walls and includes two outwardly extending spaced apart side walls having a catch at a free end of each side wall for engaging with the tabs to lock closure member in position.

Each retaining wall includes a recess on an inwardly facing surface thereof adjacent the tabs and catches, to permit one of the tabs and catches to be biased into a respective recess during assembly of a the closure member, whereupon after insertion of the closure member, the one of the tabs and catches springs back to its original position so that each tab is captured by a respective catch.

In accordance with a yet further aspect of the present invention, a system for mounting wall panels to an existing wall, includes a plurality of fastening extrusions. Each fastening extrusion includes an extrusion base section adapted to be secured to the existing wall, two parallel, spaced apart retaining walls extending at an angle from the base section, each retaining wall including a recess on an inwardly facing surface thereof, an outwardly extending holding wall on each retaining wall, and a bent wall in the extrusion base section to an outside of each retaining wall and which is bent toward each holding wall to form a gap therebetween to receive one side edge of one wall panel. A closure member is secured to the fastening extrusion in covering relation to the holding walls, the retaining walls and a space between the retaining walls, the closure member including a center section which covers the space between the retaining walls, L-shaped cover walls extending from the center section and which cover the holding walls, two parallel, spaced apart walls extending from an underside of the center section, and first spring tabs formed at free ends of the spaced apart walls for engagement within the recesses when the closure member is assembled with each fastening extrusion.

In accordance with another aspect of the present invention, a system for mounting wall panels to an existing wall, includes a plurality of fastening extrusions. Each fastening extrusion includes an extrusion base section adapted to be secured to the existing wall, two parallel, spaced apart retaining walls extending at an angle from the base section, each retaining wall including a recess on an inwardly facing surface thereof, an outwardly extending holding wall on each retaining wall, and a bent wall in the extrusion base section to an outside of each retaining wall and which is bent toward each holding wall to form a gap therebetween to receive one side edge of one wall panel. A closure member is secured to the fastening extrusion in covering relation to the holding walls, the retaining walls and a space between the retaining walls, the closure member including a center section which covers the space between the retaining walls, L-shaped cover walls extending from the center section and which cover the holding walls; one of beads and recesses formed in end edges of the holding walls; and the other of beads and recesses formed in inner surfaces at ends of the L-shaped cover walls for engagement with the one of the beads and recesses formed in the end edges of the holding walls.

In accordance with still another aspect of the present invention, a corner fastening extrusion for mounting wall panels to a corner of an existing wall structure of the type including first and second walls that meet at a corner, includes a first extrusion base section adapted to be secured to the first wall of the existing wall structure, a first retaining wall extending at an angle from the first extrusion base section, a first holding member on the first retaining wall, a first bent wall in the first extrusion base section which is bent toward the first holding member to form a gap therebetween to receive one side edge of one wall panel, a second extrusion base section adapted to be secured to the second wall of the existing wall structure, a second retaining wall extending at an angle from the second extrusion base section, a second holding member on the second retaining wall, a second bent wall in the second extrusion base section which is bent toward the second holding member to form a gap therebetween to receive one side edge of another wall panel, and an extrusion connecting wall which connects together the first and second extrusion base sections at an angle to each other.

The extrusion connecting wall is an L-shaped wall having a first wall connected with the first extrusion base section and a second wall connected with the second extrusion base section, with the first and second walls being connected with each other at a right angle. At least one of the first and second walls includes openings for receiving screws to fasten the corner fastening extrusion to the existing wall structure.

There is further a closure member adapted to clamp onto the first and second holding members.

In accordance with another aspect of the present invention, a fastening extrusion for mounting a wall panel to an existing wall, includes an extrusion base adapted to be secured to the existing wall, a first retaining wall extending at an angle from the extrusion base, a first holding member on the retaining wall, and a first bent wall extending from the extrusion base in a direction toward the holding member to form a gap between the bent wall and the holding member to receive one side edge of the wall panel.

The bent wall includes either an upturned wall extending from the extrusion base, or a bent section of the extrusion base.

In one embodiment, the extrusion base is formed as first extrusion base section and a separate disconnected extrusion base section, with the retaining wall and holding member formed on the first extrusion base section and the bent wall formed on the second extrusion base section. In another embodiment, the fastening extrusion is formed as a single, one-piece member.

Preferably, the retaining wall includes a lower bend that forms a bulge on a surface of the retaining wall which faces the bent wall. The bulge is at a height corresponding to an upper and of the bent wall.

Preferably, the retaining wall includes an upper bulge on a surface of the retaining wall which faces the bent wall for accommodating thermal expansion of the wall panel in the gap.

In another embodiment, a second retaining wall extends at an angle from the extrusion base in parallel, spaced relation to the first retaining wall, with a second holding member on the second retaining wall.

The above and other features of the invention will become readily apparent from the following detailed description thereof which is to be read in connection with the accompanying drawings.

DETAILED DESCRIPTION

Figure 1:
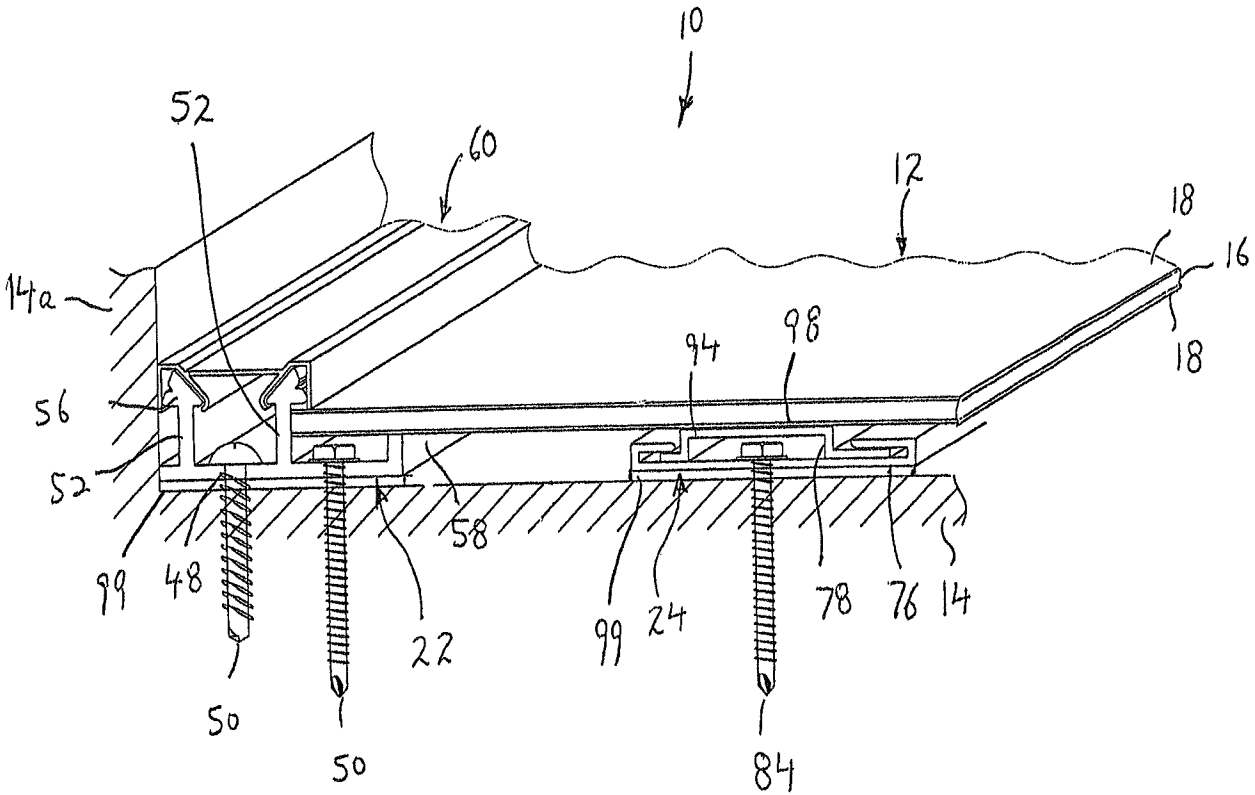
FIG. 1 is a perspective view of a system for easily mounting wall panels over an existing wall, showing securement of a first wall panel at a corner.

Referring to the drawings in detail, and initially to FIGS. 1-4, there is shown a system 10 for easily mounting wall panels 12 over an existing wall 14, which preferably includes any planar wall. Each panel 12 preferably has a rectangular parallelepiped shape, although the present invention is not limited thereby. Although wall panel 12 is shown to be planar, in fact, it can have different shapes, such as a wave shape, etc. to provide different aesthetic appearances. Wall panels 12 are formed preferably by, but not limited to, a polyethylene core 16 with a thin aluminum wall 18 covering opposite sides thereof.

In order to secure wall panels 12 in covering relation to existing wall 14, system 10 includes elongated main fastening extrusions 20, elongated corner fastening extrusions 22 and elongated intermediary structural support assemblies 24, which can be made of any suitable material, such as aluminum, polyvinyl chloride (PVC) or the like.

Figure 2:
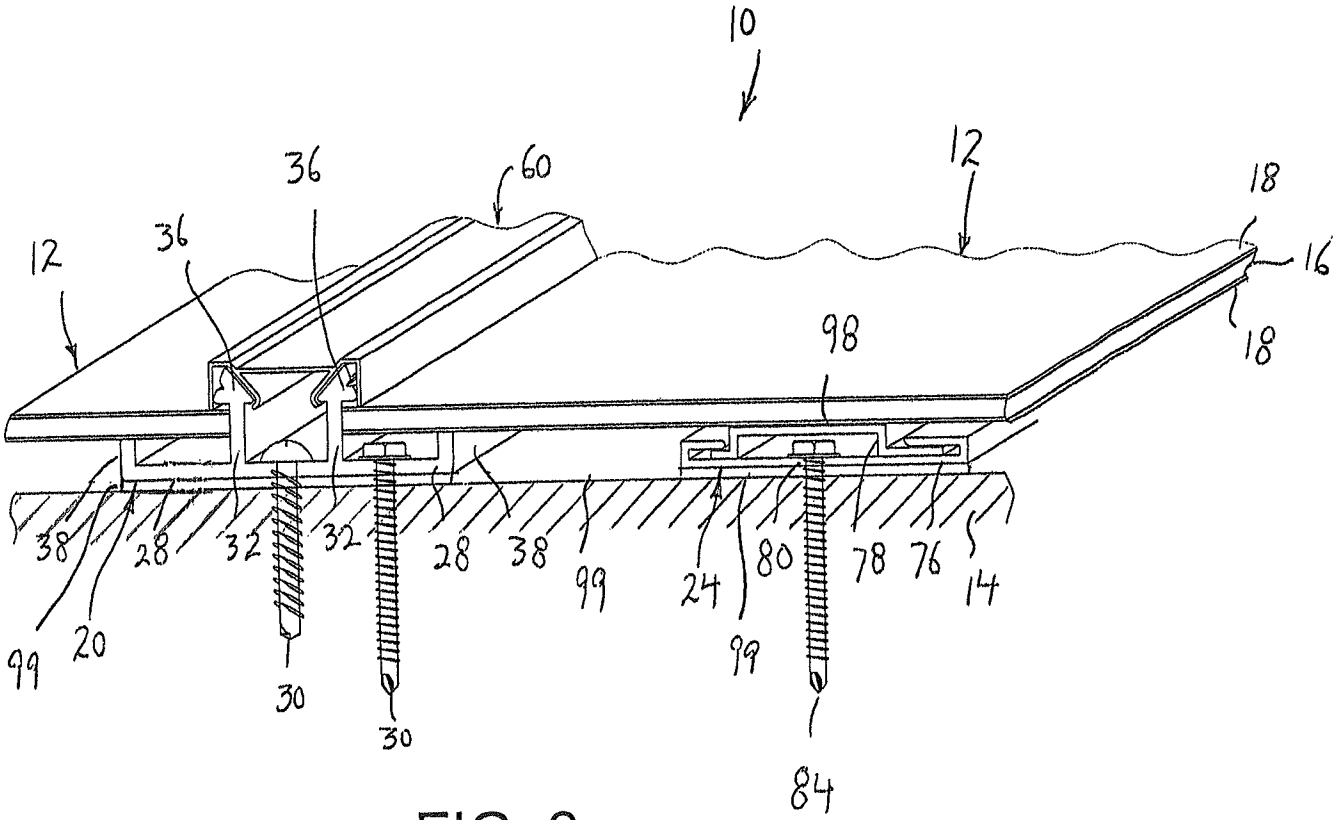
FIG. 2 is a perspective view of the system for easily mounting wall panels over an existing wall, showing securement of a second wall panel adjacent the first wall panel.
Figure 4:
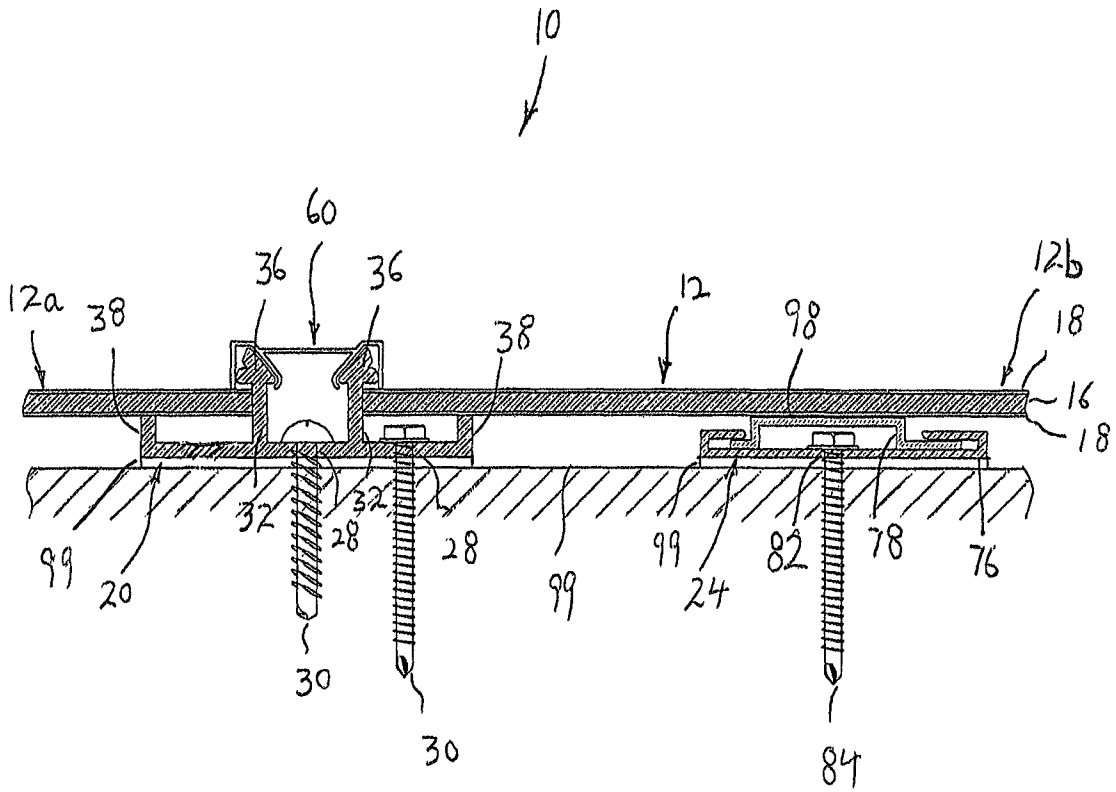
FIG. 4 is a cross-sectional view of the system of FIG. 2.
Figure 7:
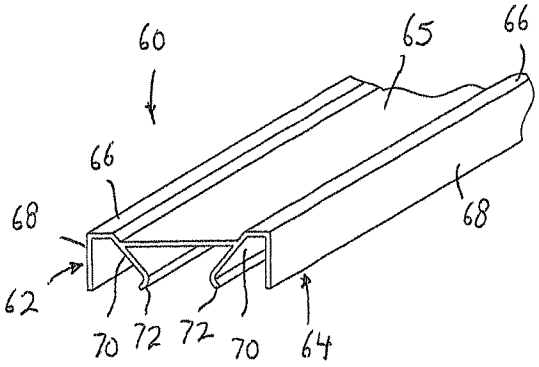
FIG. 7 is a perspective view of a closure member for use with the fastening extrusions of FIGS. 5 and 6.
Figure 6:
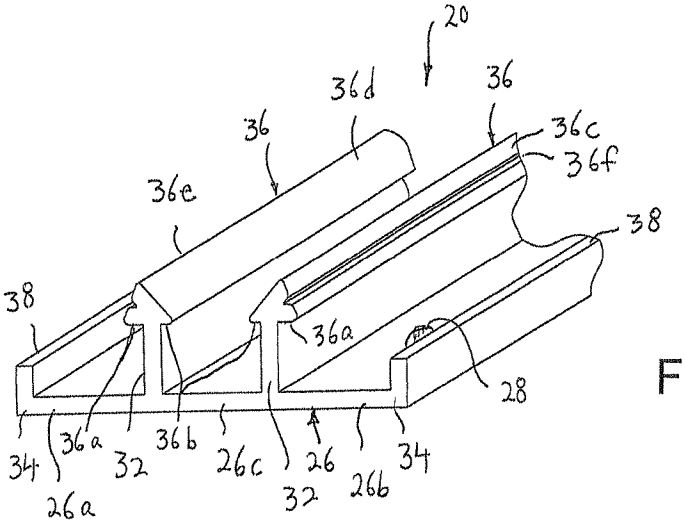
FIG. 6 is a perspective view of the main fastening extrusion of FIG. 2.
Figure 8:
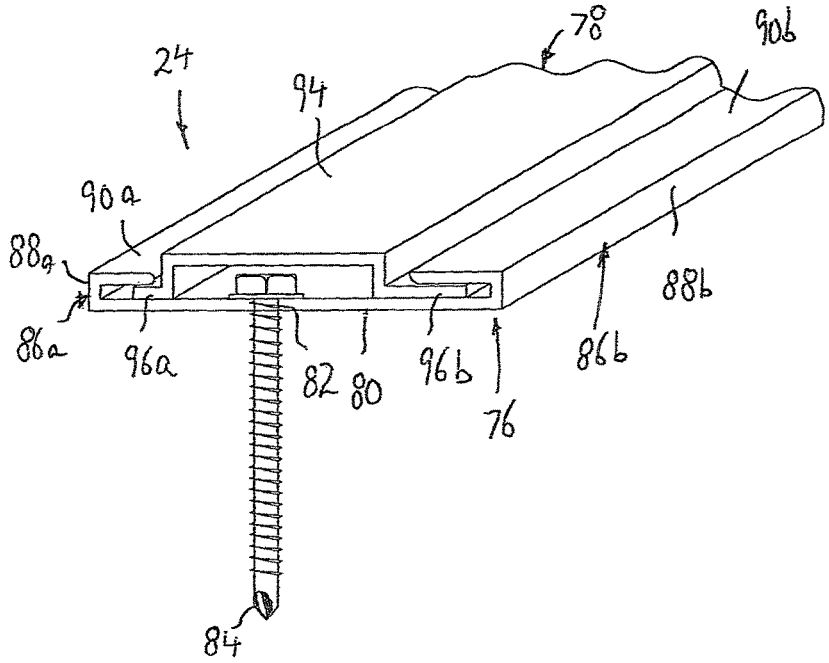
FIG. 8 is a perspective view of the structural support assembly of FIGS. 1 and 2 in a finally assembled condition.
Figure 9:
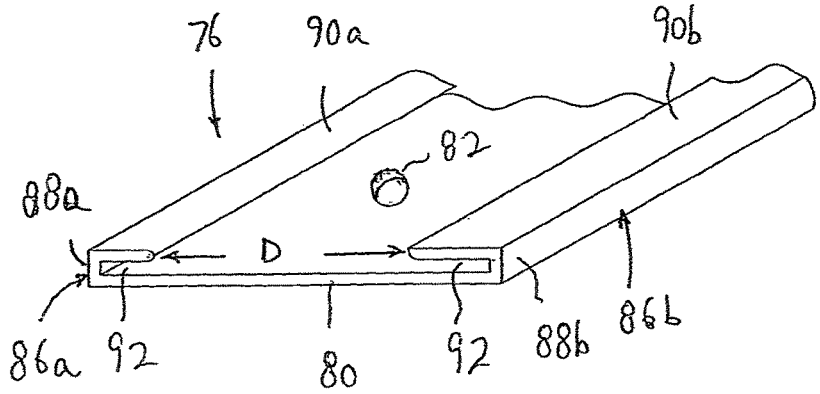
FIG. 9 is a perspective view of the base support of the structural support assembly of FIG. 8.
Figure 10:
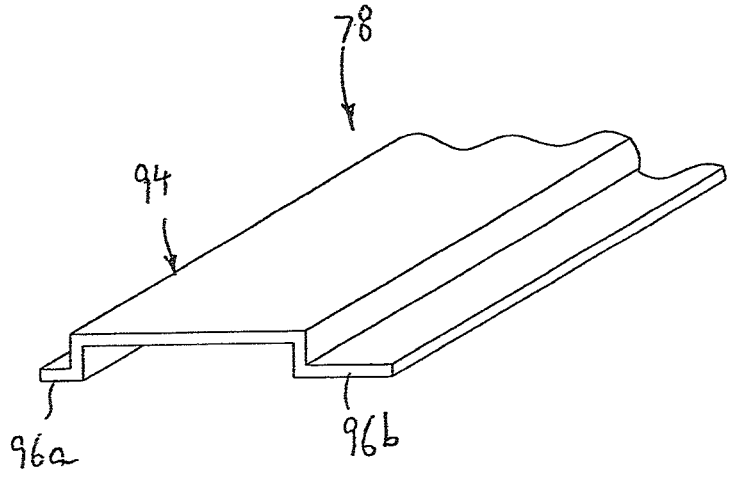
FIG. 10 is a perspective view of the sliding support member of the structural support assembly of FIG. 8.
Figure 11:
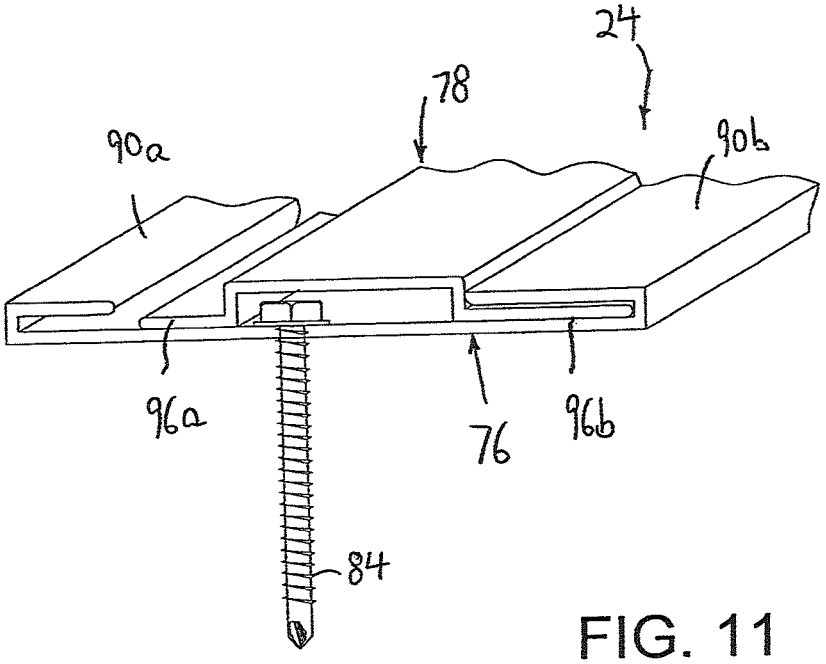
FIG. 11 is a perspective view of the structural support assembly of FIG. 8 in an initial assembly condition.

As shown in FIGS. 2, 4 and 6, each main fastening extrusion 20 is preferably formed as a single, one-piece, unitary member that includes a base section 26 that seats flush against and is secured to existing wall 14. Base section 26 has a plurality of linearly aligned openings 28 extending therealong and through which screws 30 are inserted to secure base section 26 to existing wall 14.

Two, parallel, spaced apart, bent end retaining walls 32 extend outwardly at right angles from base section 26 at a center thereof and are spaced from respective side edges 34 of base section 26. Preferably, each bent end retaining wall 32 extends about one-third of the distance from one side edge 34 to the opposite side edge 34, although the present invention is not limited thereby. Thus, bent end retaining walls 32 separate base section 26 into a first base plate section 26*a* to the outside of one retaining wall 32, a second base plate section 26*b* to the outside of the other retaining wall 32 and a third base plate section 26*c* between the two retaining walls 32, as shown in FIG. 6.

An enlarged holding section 36 extends along the upper end of each retaining wall 32. In this embodiment, enlarged holding section 36 has a triangular cross-sectional shape, so that each retaining wall 32 and its holding section 36 has the shape of an arrow in cross-section. However, the present invention is not limited to the triangular shape of holding sections 36, and any other suitable shape can be used. Thus, each holding section 36 includes a first wall surface 36*a* that extends at right angles to an outer side of the upper end of retaining wall 32 in parallel, spaced relation to first and second base plate sections 26*a*, 26*b*, a second wall surface 36*b* that extends at right angles to an inner side of the upper end of retaining wall 32 in parallel, spaced relation to third base plate section 26*c*, a first inclined wall surface 36*c* that extends upwardly at an angle from first wall surface 36*a* and a second inclined wall surface 36*d* that extends upwardly at an angle from second wall surface 36*b*, with inclined wall surfaces 36*c* and 36*d* meeting at an apex line 36*e*. A V-shaped notch 36*f* is formed centrally along each first inclined wall surface 36*c*.

Further, a side wall 38 extends outwardly at right angles along side edges 34 of base section 26. The height of side walls 38 is less than the height of retaining walls 32, the purpose for which will become apparent from the discussion hereafter.

Although retaining walls 32 and side walls 38 have been shown as continuous walls, a plurality of spaced apart and linearly aligned retaining walls 32 and side walls 38 can be provided instead, and in fact, a plurality of spaced apart main fastening extrusions 20 can also be used instead.

Figure 3:
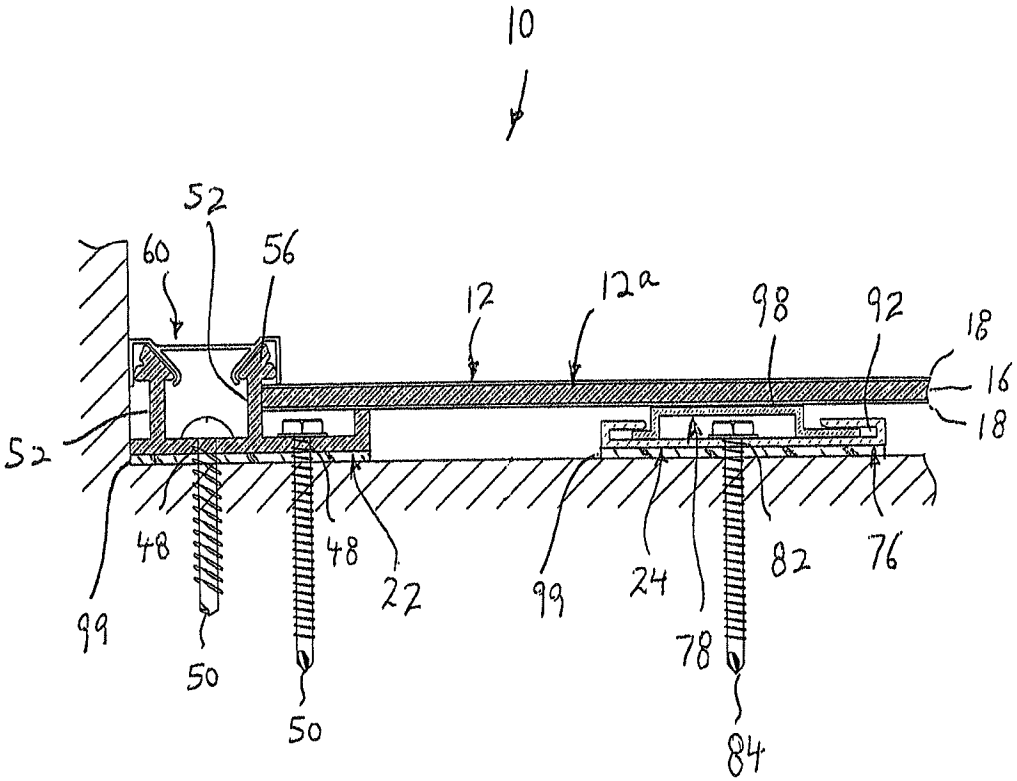
FIG. 3 is a cross-sectional view of the system of FIG. 1.
Figure 5:
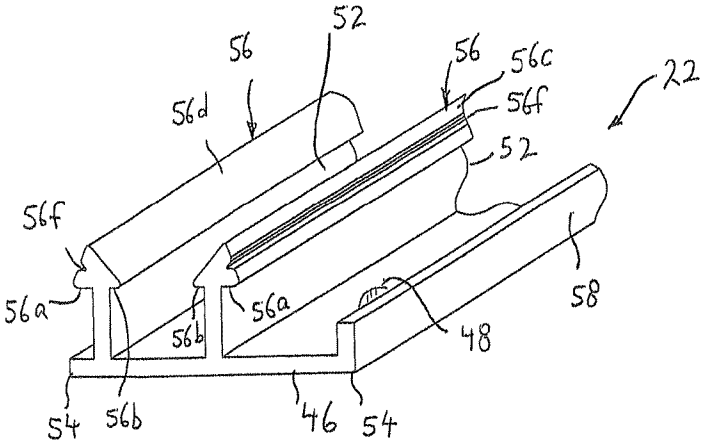
FIG. 5 is a perspective view of the corner fastening extrusion of FIG. 1.

As shown in FIGS. 1, 3 and 5, each corner fastening extrusion 22 is preferably formed as a single, one-piece, unitary member that includes a base section 46 that seats flush against and is secured to existing wall 14. Base section 46 has a plurality of linearly aligned openings 48 extending therealong and through which screws 50 are inserted to secure base section 46 to existing wall 14.

Two, parallel, spaced apart, bent end retaining walls 52 extend outwardly at right angles from base section 46 at a center thereof and are spaced from respective side edges 54 of base section 46. An enlarged holding section 56 extends along the upper end of each retaining wall 52. In this embodiment, enlarged holding section 56 has a triangular cross-sectional shape, so that each retaining wall 52 and its holding section 56 has the shape of an arrow in cross-section. However, the present invention is not limited to the triangular shape of holding sections 56, and any other suitable shape can be used. Thus, each holding section 56 includes a first wall surface 56*a* that extends at right angles to an outer side of the upper end of retaining wall 52 in parallel relation to base section 46, a second wall surface 56*b* that extends at right angles to an inner side of the upper end of retaining wall 52 in parallel relation to base section 46, a first inclined wall surface 56*c* that extends upwardly at an angle from first wall surface 56*a* and a second inclined wall surface 56*d* that extends upwardly at an angle from second wall surface 56*b*, with inclined wall surfaces 56*c* and 56*d* meeting at an apex line 56*e*. A V-shaped notch 56*f* is formed centrally along each first inclined wall surface 56*c*.

Further, a side wall 58 extends outwardly at right angles along only one side edge 54 of base section 26. The height of side wall 58 is less than the height of retaining walls 52, the purpose for which will become apparent from the discussion hereafter.

Although retaining walls 52 and side walls 58 have been shown as continuous walls, a plurality of spaced apart and linearly aligned retaining walls 52 and side walls 58 can be provided instead, and in fact, a plurality of spaced apart corner fastening extrusions 22 can also be used instead.

As shown in FIGS. 1-4 and 7, a closure member 60 is provided to clamp onto enlarged holding sections 36 and 56. Closure member 60 can be made of any suitable thin material such as aluminum. Specifically, closure member 60 includes first and second clamping members 62 and 64 connected together in parallel, spaced apart relation by a connecting plate 65. Each clamping member 62 and 64 includes a sitting wall 66 that sits on top of apex line 36*e*, 56*e* in parallel relation to base section 26, 46, an outer covering wall 68 that extends adjacent to first inclined walls 36*c* and 56*c* at a right angle to sitting wall 66 and which extends down from the outer edge of sitting wall 66 to a position slightly below first walls 36*a* and 36*b*, and an inclined inner lock-down wall 70 that extends adjacent to second inclined walls 36*d* and 56*d* and which extends down from the inner edge of sitting wall 66 at the same angle as second inclined walls 36*d* and 56*d* so as to be positioned thereon. The free lower edge of inclined inner lock-down wall 70 includes a bent tab 72 that wraps to the underside of second walls 36*b* and 56*b* so as to clamp each clamping member 62 and 64 to a respective enlarged holding section 36, 56. Connecting plate 65 is arranged parallel to base section 26, 46 and connects together inclined inner lock-down walls 70 of closure members 60.

As shown in FIGS. 1-4 and 8-10, each structural support assembly 24 includes a base support 76 that is secured to existing wall 14 and a sliding support member 78 that is slidably retained within base support 76.

Base support 76 includes an elongated base plate 80 having openings 82 therein through which screws 84 extend to secure base plate 80 to existing wall 14, and L-shaped retaining walls 86*a* and 86*b* that extend outwardly from opposite side edges of base plate 80. Specifically, each L-shaped retaining wall 86*a*, 86*b* includes a first wall 88*a*, 88*b* that extends at a right angle from a side edge of base plate 80 and an inwardly extending second wall 90*a*, 90*b* that extends toward the opposite side edge of base plate 80 in parallel spaced apart relation to base plate 80 with a space 92 therebetween, with free edges of second walls 90*a*, 90*b* spaced apart by a distance D. Preferably, inwardly extending second wall 90*b* has a greater width than inwardly extending second wall 90*a*.

Sliding support member 78 includes an inverted U-shaped plate 94 that fits in the space between the spaced-apart free edges of second walls 90*a*, 90*b*, and wing plates 96*a*, 96*b* at opposite free ends at the side edges of inverted U-shaped plate 94, with wing plates 96*a*, 96*b* slidably retained in spaces 92. Preferably, wing plate 96*b* has a greater width than wing plate 96*a*. It will be appreciated that the distance between free edges of wing plates 96*a*, 96*b* is less than the distance between first walls 88*a*, 88*b* of each L-shaped retaining wall 86*a*, 86*b* so as to permit side to side sliding of sliding support member 78 within base support 76.

An adhesive member 98, which can be a double sided tape, an adhesive or any other securing means, secured on top of inverted U-shaped plate 94 of sliding support member 78, for securement of wall panel 12 thereon.

It will be appreciated that, base section 26, base section 46 and/or base support 76 may be made of a metal material, and therefore, would be thermally conductive, that is, would undesirably transfer heat and cold from the outside to existing wall 14. Therefore, a thermal break insulation 99 can be positioned between existing wall 14 and base section 26, base section 46 and/or base support 76 so that base section 26, base section 46 and/or base support 76 are not in direct contact with existing wall 14 of the building, with screws 30, 50, 84 also inserted through the thermal insulation break 99. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

Figure 12:
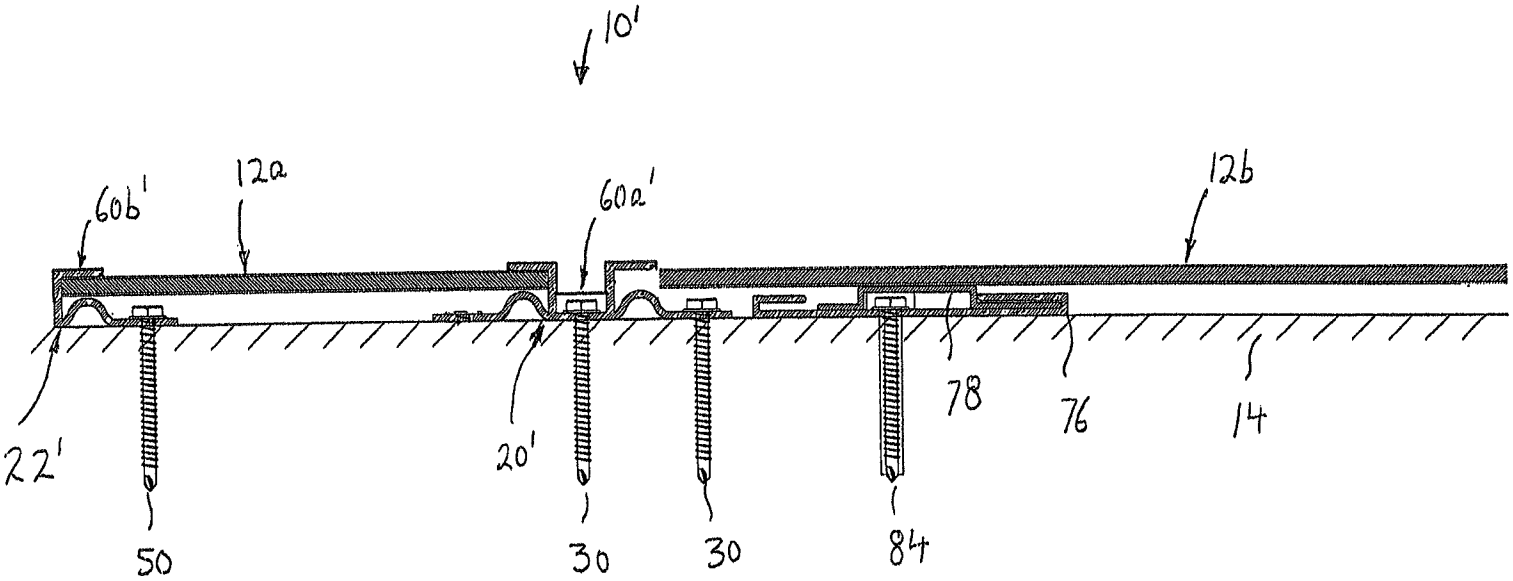
FIG. 12 is a cross-sectional view of a modification of the system for easily mounting wall panels over an existing wall, showing an initial condition for securement of first and second wall panels thereto.
Figure 13:
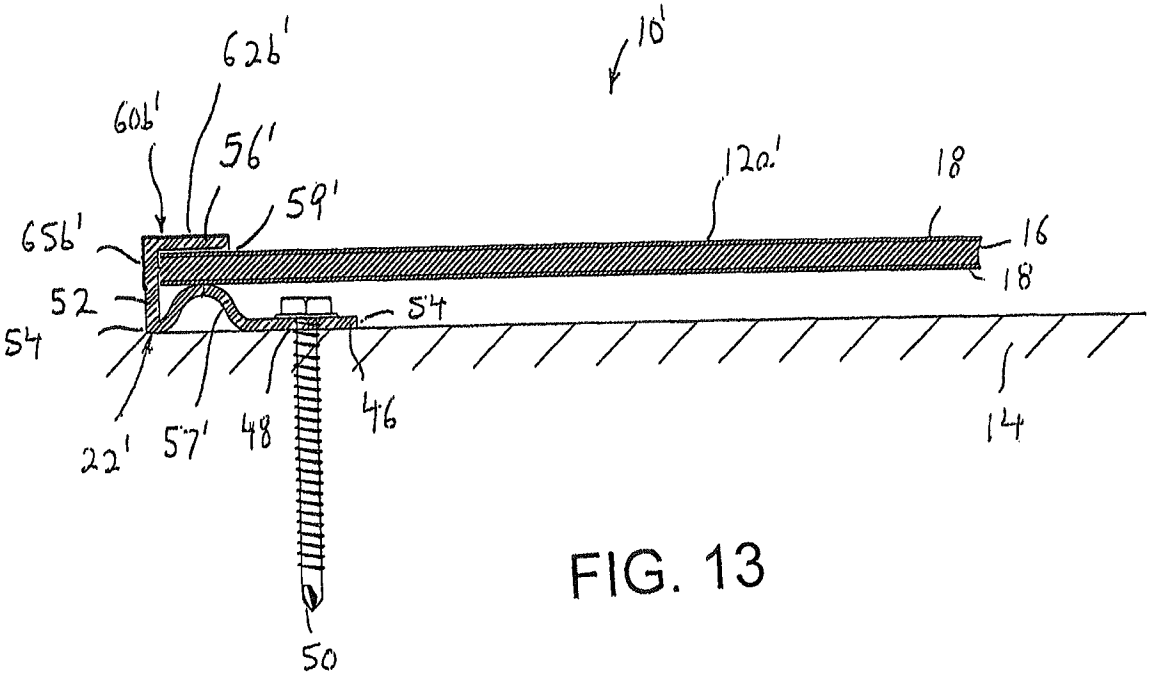
FIG. 13 is a cross-sectional view of the system of FIG. 12, showing securement of the first wall panel at a corner.
Figure 14:
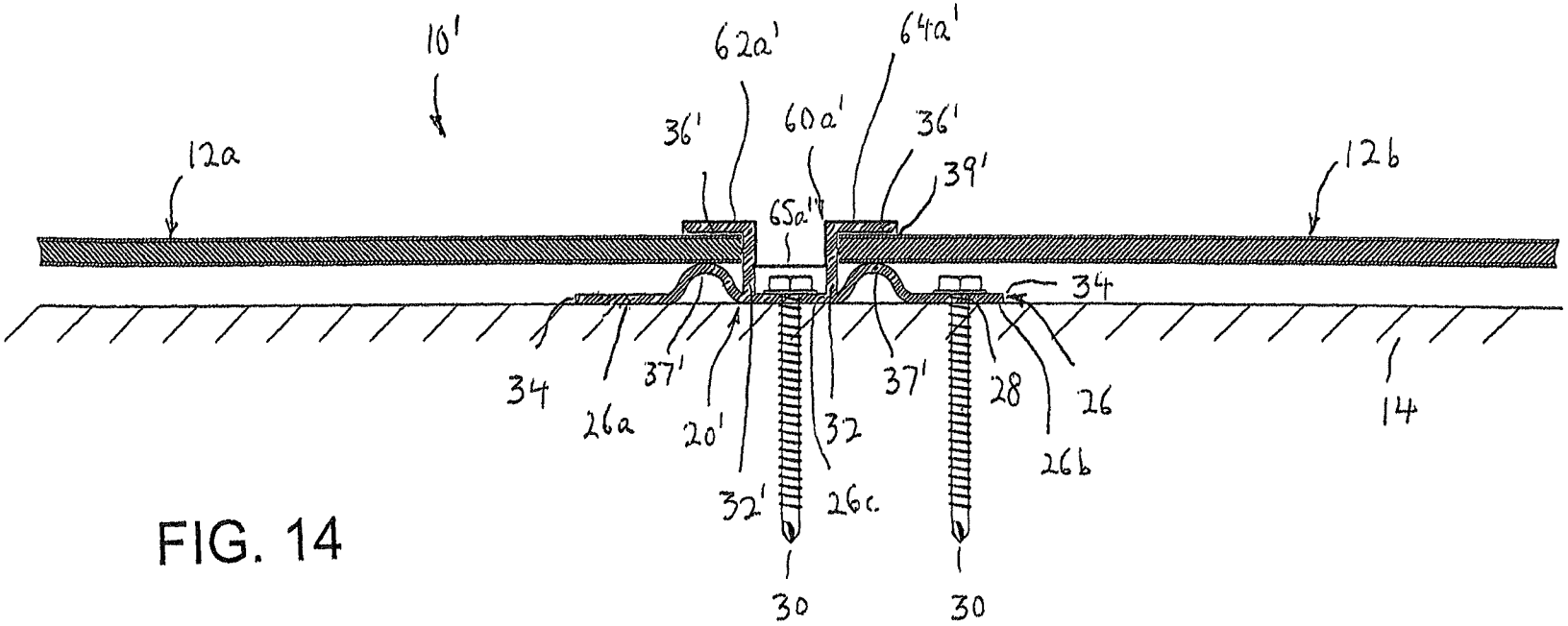
FIG. 14 is a cross-sectional view of the system of FIG. 12, showing securement of the second wall panel adjacent the first wall panel.
Figure 15:
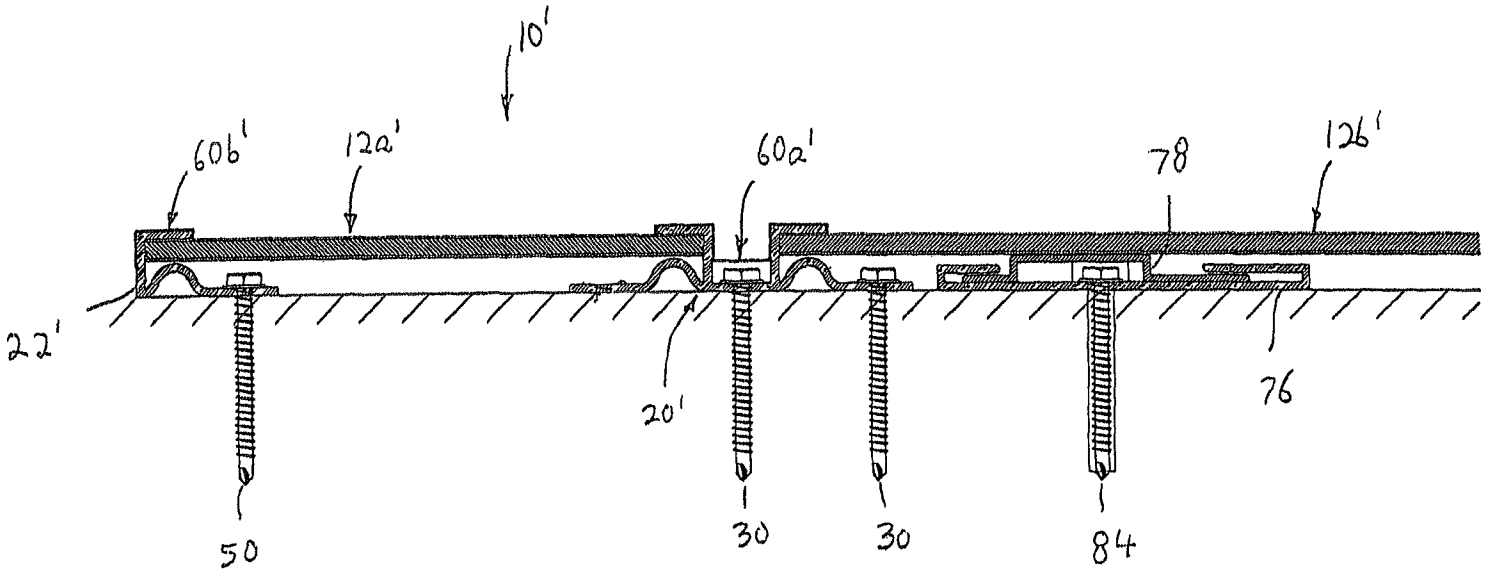
FIG. 15 is a cross-sectional view of the system of FIG. 12, showing a final assembled condition for securement of the first and second wall panels thereto.

Referring now to FIGS. 12-14, there is shown a system 10' which is a modification of the system 10 of FIGS. 1-11, and in which like elements are referred to by the same numerals, but in which modified elements are referred to by the same numerals with a prime (') added, and a detailed description of the like elements is not provided.

System 10' differs from system 10 only as to main fastening extrusions 20' and corner fastening extrusions 22'. All other elements are identical to those in system 10.

As shown in FIGS. 12 and 14, each main fastening extrusion 20' is preferably formed as a single, one-piece, unitary member that includes a base section 26 that seats flush against and is secured to existing wall 14. Base section 26 has a plurality of linearly aligned openings 28 extending therealong and through which screws 30 are inserted to secure base section 26 to existing wall 14.

Two, parallel, spaced apart, bent end retaining walls 32 extend outwardly at right angles from base section 26 at a center thereof and are spaced from respective side edges 34 of base section 26. Preferably, each bent end retaining wall 32 extends slightly more than about one-third of the distance from one side edge to the opposite side edge, although the present invention is not limited thereby. Thus, bent end retaining walls 32 separate base section 26 into a first base plate section 26*a* to the outside of one retaining wall 32, a second base plate section 26*b* to the outside of the other retaining wall 32 and a third base plate section 26*c* between the two retaining walls 32.

The enlarged holding sections 36 of main fastening extrusions 20 are eliminated, and in place thereof, a hold down wall 36' is connected at the upper end of each retaining wall 32'. Hold down wall 36' extends toward the respective outer side edge 34 and is provided in parallel, spaced relation with base section 26.

Also, side walls 38 of main fastening extrusions 20 are eliminated, and instead, first and second base plate sections 26*a* and 26*b* are each bent in an arcuate shape immediately adjacent the respective retaining wall 32 to form arcuate bends 37' that are bent in an arc towards the respective hold down wall 36', thereby creating a space 39' between the apex of each arcuate bend 37' and its respective hold down wall 36'.

Although retaining walls 32, hold down walls 36' and arcuate bends 37' have been shown as continuous walls, a plurality of spaced apart and linearly aligned retaining walls 32, hold down walls 36' and arcuate bends 37' can be provided instead.

A closure member 60*a'* is provided to clamp onto retaining walls 32 and hold down walls 36'. Closure member 60*a'* can be made of any suitable thin material such as aluminum. Specifically, closure member 60*a'* includes a U-shaped center section 65*a'* that fits snugly between retaining walls 32, and L-shaped cover walls 62*a'* and 64*a'* connected to the free edges of U-shaped center section 65*a'* and which seat on top of and wrap around the free edges of hold down walls 36'. As a result, the gap between retaining walls 32 is covered.

As shown in FIGS. 12 and 13, each corner fastening extrusion 22' is preferably formed as a single, one-piece, unitary member that includes a base section 46 that seats flush against and is secured to existing wall 14. Base section 46 has a plurality of linearly aligned openings 48 extending therealong and through which screws 50 are inserted to secure base section 46 to existing wall 14.

A single bent end retaining wall 52 extends outwardly at right angles from one side edge 54 of base section 46. The enlarged holding sections 56 of corner fastening extrusions 22 are eliminated, and in place thereof, a hold down wall 56' is connected at the upper end of each retaining wall 52. Hold down wall 56' extends toward the opposite side edge 54 and is provided in parallel, spaced relation with base section 46.

Also, side walls 58 of corner fastening extrusions 22 are eliminated, and instead, base section 46 is bent in an arcuate shape immediately adjacent retaining wall 52 to form an arcuate bend 57' that is bent in an arc towards hold down wall 56', thereby creating a space 59' between the apex of each arcuate bend 57' and hold down wall 56'.

Although retaining walls 52, hold down walls 56' and arcuate bends 57' have been shown as continuous walls, a plurality of spaced apart and linearly aligned retaining walls 52 hold down walls 56' and arcuate bends 57' can be provided instead.

A closure member 60*b'* is provided to clamp onto retaining wall 52 and hold down wall 56'. Closure member 60*b'* can be made of any suitable thin material such as aluminum. Specifically, closure member 60*b'* includes a first plate 65*b'* that seats against the outside of retaining wall 32 and an L-shaped cover wall 62*a'* connected to the outer free edge of first plate 65*b'* and which seats on top of and wraps around the free edge of hold down wall 36'.

Each structural support assembly 24 is of identical construction to that described in system 10, and therefore, a further explanation is omitted.

Assembly of wall panels 12 occurs in the same manner as described above in the embodiment of FIGS. 1-11.

As a result, wall panels 12 are securely and tightly held in place without any play between main fastening extrusions 20' and corner fastening extrusions 22'.

Figure 16:
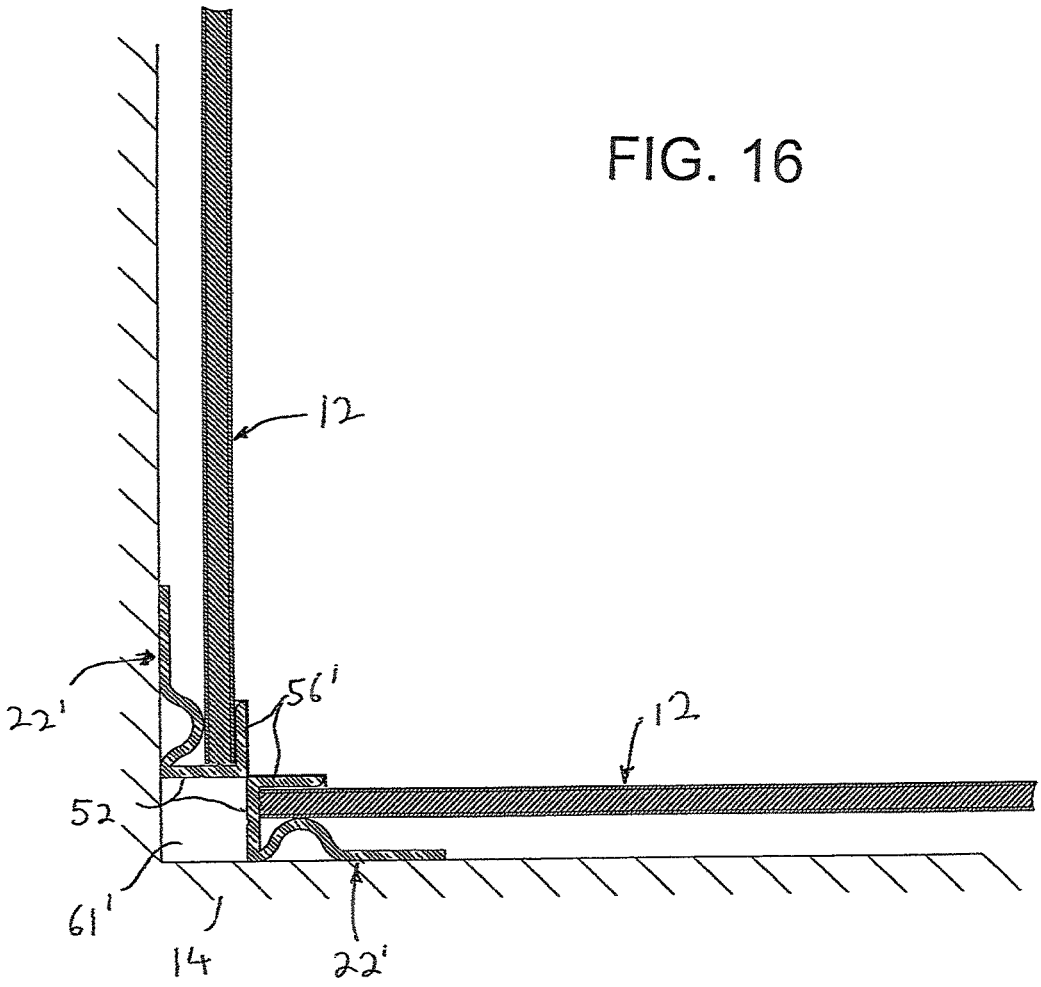
FIG. 16 is a cross-sectional view of a further modification of the system for easily mounting wall panels over an existing wall, showing the use of two corner fastening extrusions of the type shown in FIG. 13, at an inside corner of an existing wall.

Referring now to FIG. 16, there is shown a system for easily mounting wall panels over an existing wall, showing the use of two corner fastening extrusions 22' at an inside corner of existing wall 14. In this case, the corners of the two corner fastening extrusions 22' where each bent end retaining wall 52 meets its respective hold down wall 56' are in contact with each other. As a result, there is a rectangular parallelepiped space 61' between bent end retaining walls 52, which is shown to have a square transverse cross-sectional configuration. Screws 50 are omitted for the sake of clarity.

Figure 17:
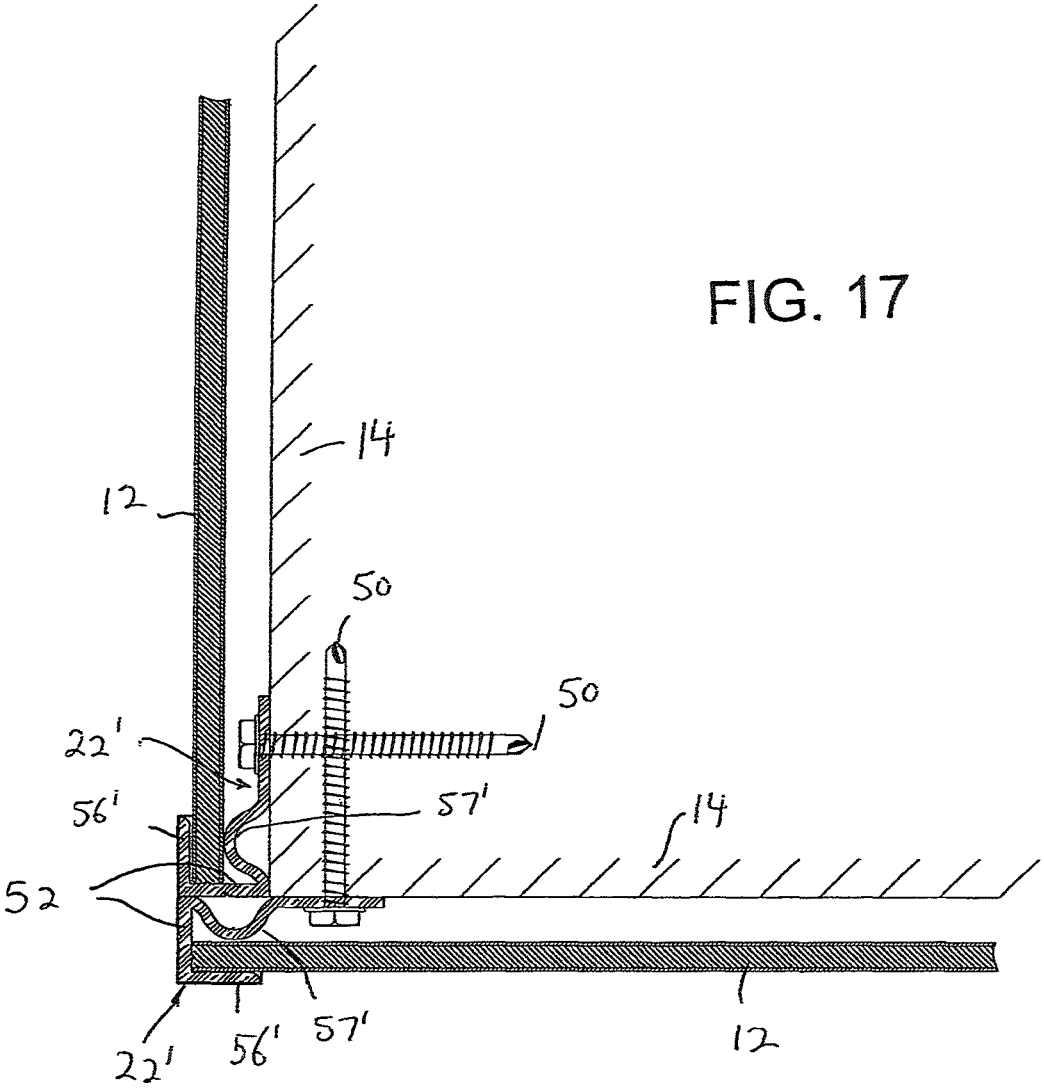
FIG. 17 is a cross-sectional view of a still further modification of the system for easily mounting wall panels over an existing wall, showing the use of two corner fastening extrusions of the type shown in FIG. 13, at an outside corner of an existing wall.

Referring now to FIG. 17, there is shown a system for easily mounting wall panels over an existing wall, showing the use of two corner fastening extrusions 22' at an outside corner of existing wall 14. In this case, arcuate bend 57' of one corner fastening extrusion 22' is in overlapping relation to bent end retaining wall 52 of the other corner fastening extrusion 22'.

Referring now to FIGS. 19-25, there is shown a system 10" which is a modification of the system 10' of FIGS. 12-18, and in which like elements are referred to by the same numerals, but in which modified elements are referred to by the same numerals with a double prime (") added, and a detailed description of the like elements is not provided. System 10" differs from system 10' in two respects, and all other elements are identical to those in system 10' and therefore referred to by the same reference numerals.

Figure 19:
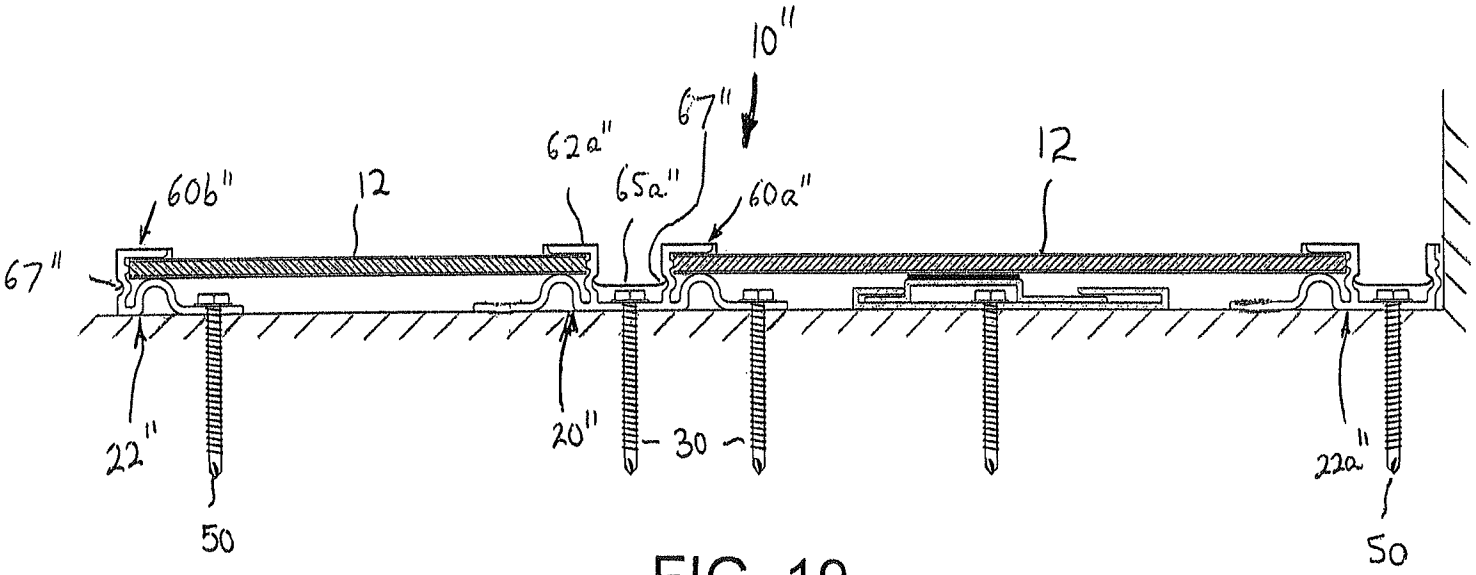
FIG. 19 is a cross-sectional view of a further modification of the system for easily mounting wall panels over an existing wall, showing a final assembled condition for securement of the first and second wall panels thereto.
Figures 20, 21, 22, 23, 24, 25, 25B:
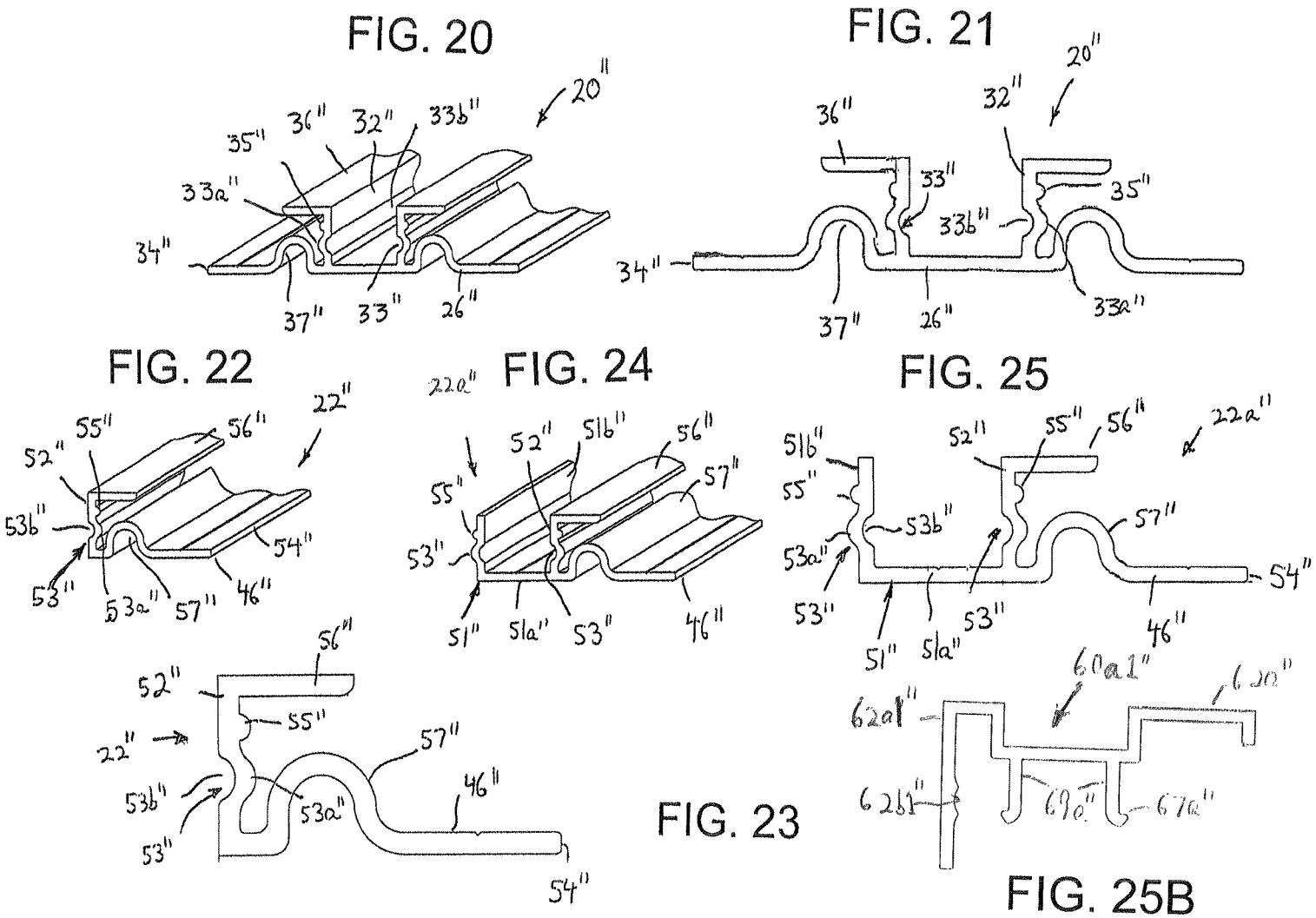
FIG. 20 is a perspective view of the main fastening extrusion of FIG. 19.
FIG. 21 is a cross-sectional view of the main fastening extrusion of FIG. 20.
FIG. 22 is a perspective view of the first corner fastening extrusion of FIG. 19.
FIG. 23 is a cross-sectional view of the corner fastening extrusion of FIG. 22.
FIG. 24 is a perspective view of the second corner fastening extrusion of FIG. 19.
FIG. 25 is a cross-sectional view of the corner fastening extrusion of FIG. 24.
FIG. 25B shows a modified closure member for the corner fastening extrusion of FIG. 25.

Specifically, as shown in FIGS. 19-21, each retaining wall 32" of main fastening extrusions 20" is provided with a lower arcuate bend 33" that produces an outward bulge 33*a"* on the outwardly facing surface thereof and a recess 33*b"* on the inwardly facing surface thereof. Outward bulge 33*a"* is at the same height as the apex of the adjacent arcuate bend 37" formed in base section 26" in spaced relation from the respective side edge 34" of base section 26". This serves a twofold purpose. Specifically, outward bulge 33*a"* with the apex of arcuate bend 37" functions to support the lower surface of wall panel 12, and also, inward recess 33*b"* serves to receive and hold a lip 67" at the lower end of U-shaped center section 65*a"* of closure member 60*a"* to releasably lock closure member 60*a"* therein. L-shaped cover wall 62*a"* of closure member 60*a"* is the same as L-shaped cover wall 62*a'* of closure member 60*a'*.

In addition, each retaining wall 32" is provided with an upper bulge 35" on the outwardly facing surface thereof immediately above outward bulge 33*a"*, and against which the edge of wall panels 12 abut. The reason for such outward bulge 35" is as follows. When the temperature increases, the thin aluminum walls 18 of wall panel 12 expand at a greater rate than polyethylene core 16 thereof. As a result, thin aluminum walls 18 tend to expand in a direction toward retaining wall 32". However, if the outer surface of retaining wall 32" is planar, there is no room for expansion. By providing outward bulge 35", polyethylene core 16 abuts against outward bulge 35", but because of the sloping walls of outward bulge 35", aluminum walls 18 can expand in a direction past the outer edge of polyethylene core 16 in a direction toward the outer surface of retaining wall 32".

Of course, an enlarged holding section 36" extends along the upper end of each retaining wall 32", as described above.

In the same manner, the retaining wall 52" of each corner fastening extrusion 22" shown in FIGS. 19, 22 and 23, is provided with a lower arcuate bend 53" that produces an inward bulge 53*a*" on the inwardly facing surface thereof and a recess 53*b*" on the outwardly facing surface thereof, in a similar manner as arcuate bend 33", and an upper bulge 55" on the inwardly facing surface thereof immediately above outward bulge 53*a*", in the same manner as upper bulge 35". Thus, outward bulge 53*a*" is at the same height as the apex of the adjacent arcuate bend 57" formed in base section 46" in spaced relation from the respective side edge 54" of base section 46". Of course, an enlarged holding section 56" extends along the upper end of each retaining wall 52", as described above. A closure member 60*b*" which is identical to closure member 60*a*" is provided, except that the lower end of closure member 60*b*" includes a lower lip 67" which is received and held in recess 53*b*", as shown in FIG. 19.

In addition, as shown in FIGS. 19, 24 and 25, a modified corner fastening extrusion 22*a*" is shown at the closing end of existing wall 14. Corner fastening extrusion 22*a*" is identical to corner fastening extrusion 22" with the except that corner fastening extrusion 22*a*" further includes an L-shaped wall 51" extending to the outside of retaining wall 52", with one wall 51*a*" of L-shaped wall 51" continuing as an extension of base section 46" but on the opposite side of retaining wall 52" and secured to existing wall 14 by screws 50, and the other wall 51*b*" of L-shaped wall 51" extending from the free edge of wall 51*a*" and positioned against the adjacent side wall 14*a* of existing wall 14. Wall 51*b*" also includes a lower arcuate bend 53" that produces an outward bulge 53*a*" on the outwardly facing surface thereof and a recess 53*b*" on the inwardly facing surface thereof, in the same manner as arcuate bend 33", and an upper bulge 55" on the outwardly facing surface thereof immediately above outward bulge 53*a*", in the same manner as upper bulge 35". In this manner, a closure member is captured between retaining wall 52" and wall 51*b*" in the same manner as discussed above in relation to closure member 60*a*" and main fastening extrusion 20".

Figure 25A:
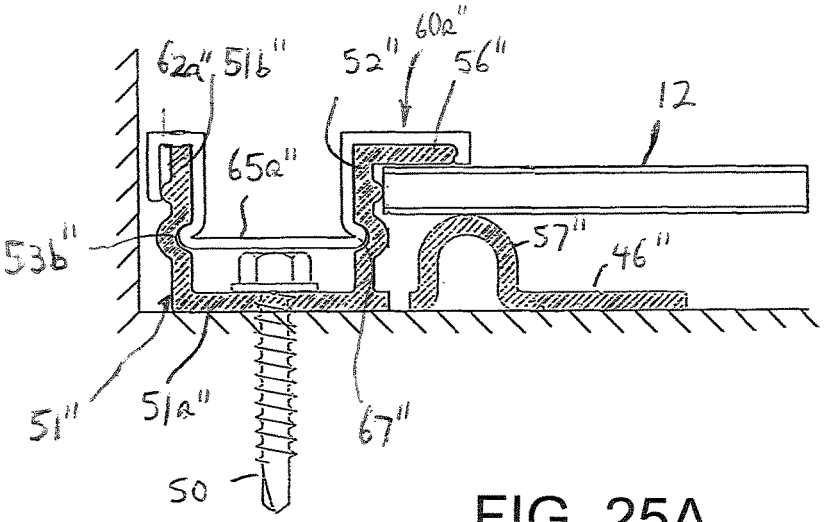
FIG. 25A is a cross-sectional view showing a modification of the corner fastening extrusion of FIG. 24 installed, in the manner shown in FIG. 19.

FIG. 25A shows a slight modification to corner fastening extrusion 22*a*" in which L-shaped wall 51" and retaining wall 52" are formed as a single, one-piece unit, and base section 46" with arcuate bend 57" is formed as a separate single, one-piece unit, with each being secured separately. In this case, in order to assemble the same, base section 46" with arcuate bend 57" is first secured to wall 14 by any suitable means, such as screws, adhesive or the like, and wall panel 12 is positioned thereover, as shown. Then, the single, one-piece unit of L-shaped wall 51" and retaining wall 52" are assembled with enlarged holding section 56" being positioned over wall panel 12, and with the end of wall panel 12 abutting against upper bulge 55". A screw 50 is then used to secure the single, one-piece unit of L-shaped wall 51" and retaining wall 52" to existing wall 14, as shown. Thereafter, closure member 60*a*" is assembled therewith, with inward recesses 53*b*" serving to receive and hold a lip 67" at the lower end of U-shaped center section 65*a*" of closure member 60*a*" to releasably lock closure member 60*a*" therein.

FIG. 25B shows a modified closure member 60*a*1" in which two parallel, spaced apart walls 69*a*" extend from the undersurface of U-shaped center section 65*a*", each having an outwardly turned tab 67*a*" which engages within a respective recess 53*b*" in order to lock closure member 60*a*1" to corner fastening extrusion 22*a*". In this arrangement, the leftmost L-shaped cover wall 62*a*" shown in FIG. 19 is replaced by a U-shaped cover wall 62*a*1" that acts as a finishing wall to cover an outer surface of a respective retaining wall 53" and that includes a recess 62*b*1" for receiving lower arcuate bend 53".

It will be appreciated that the aspects of system 10" of lower arcuate bend 53" with outward bulge 53*a*" and recess 53*a*", along with upper bulge 55", can be used with the first embodiment of FIGS. 1-11 as well.

Figure 18:
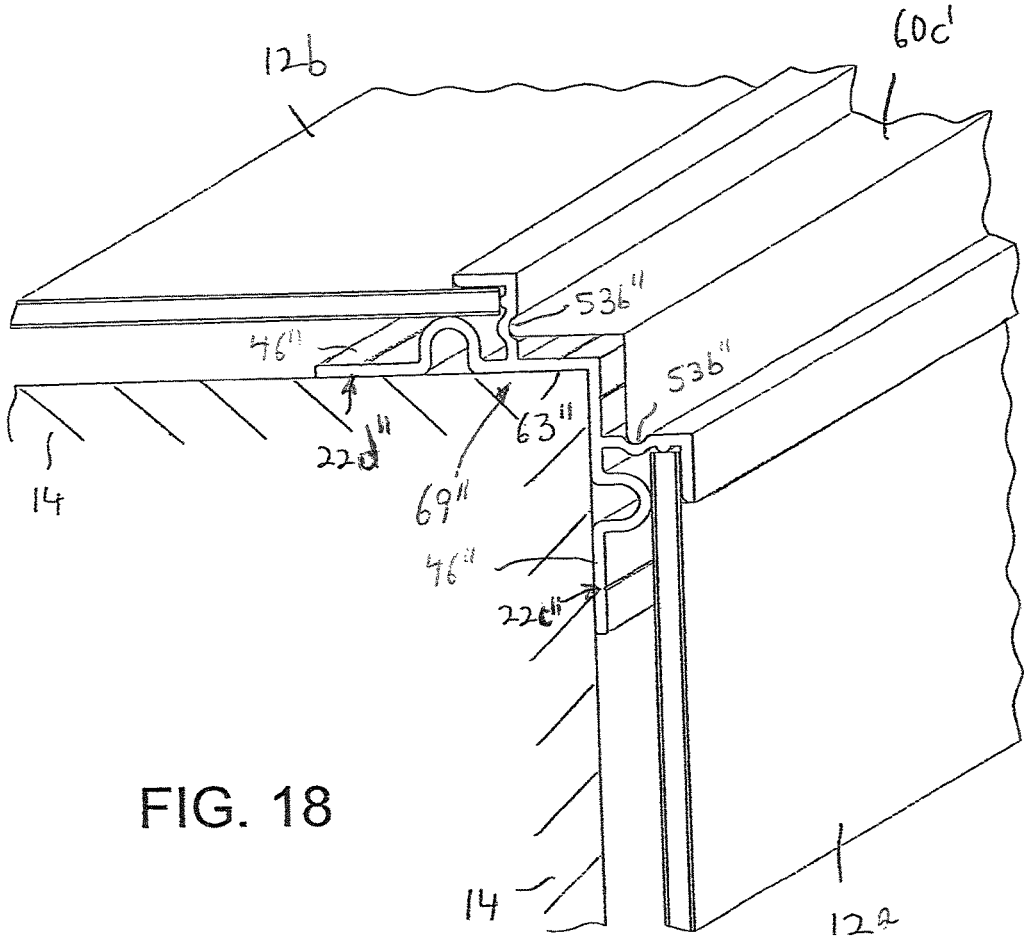
FIG. 18 is a cross-sectional view of a yet further modification of the system for easily mounting wall panels over an existing wall, showing the use of two corner fastening extrusions of the type shown in FIG. 13, at an outside corner of an existing wall.
Figure 18A:
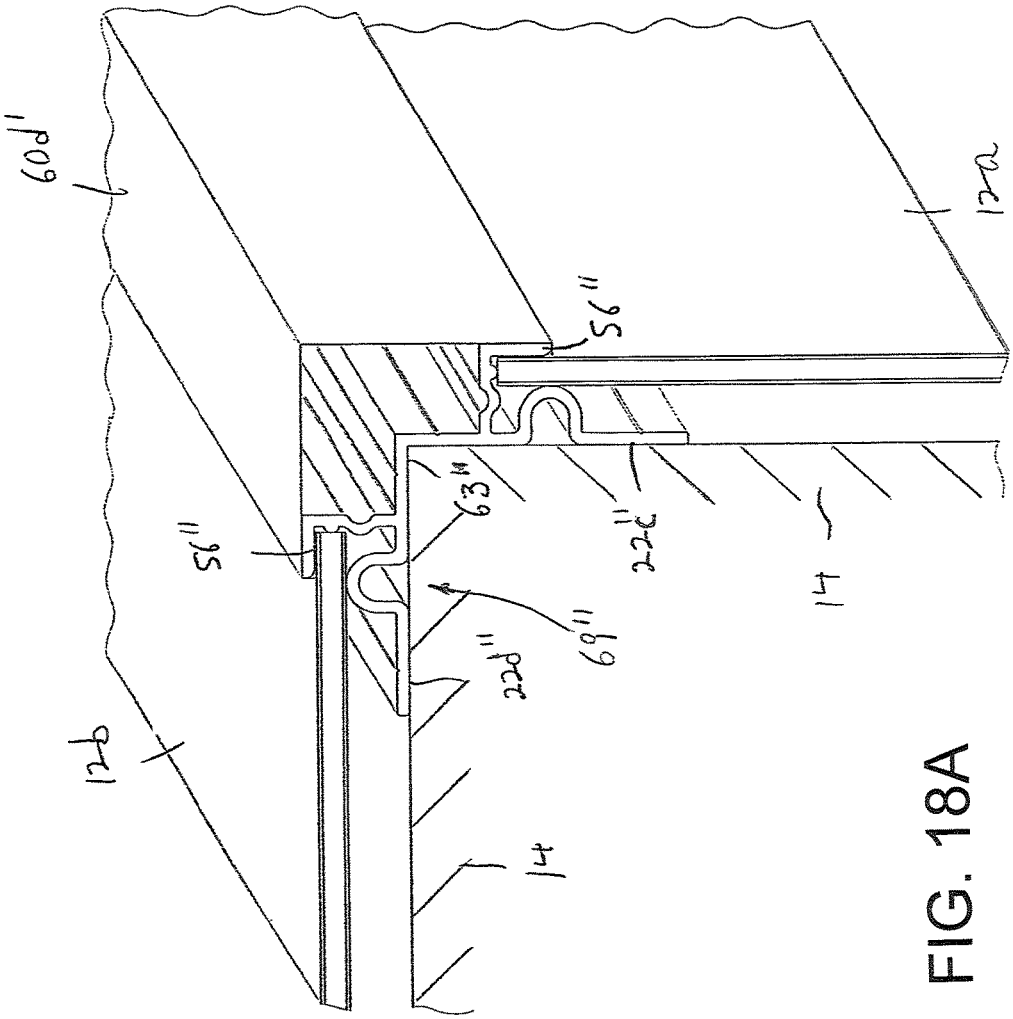
FIG. 18A is a cross-sectional view of the yet further modification of the system of FIG. 18, but with a different decorative cover.
Figure 18B:
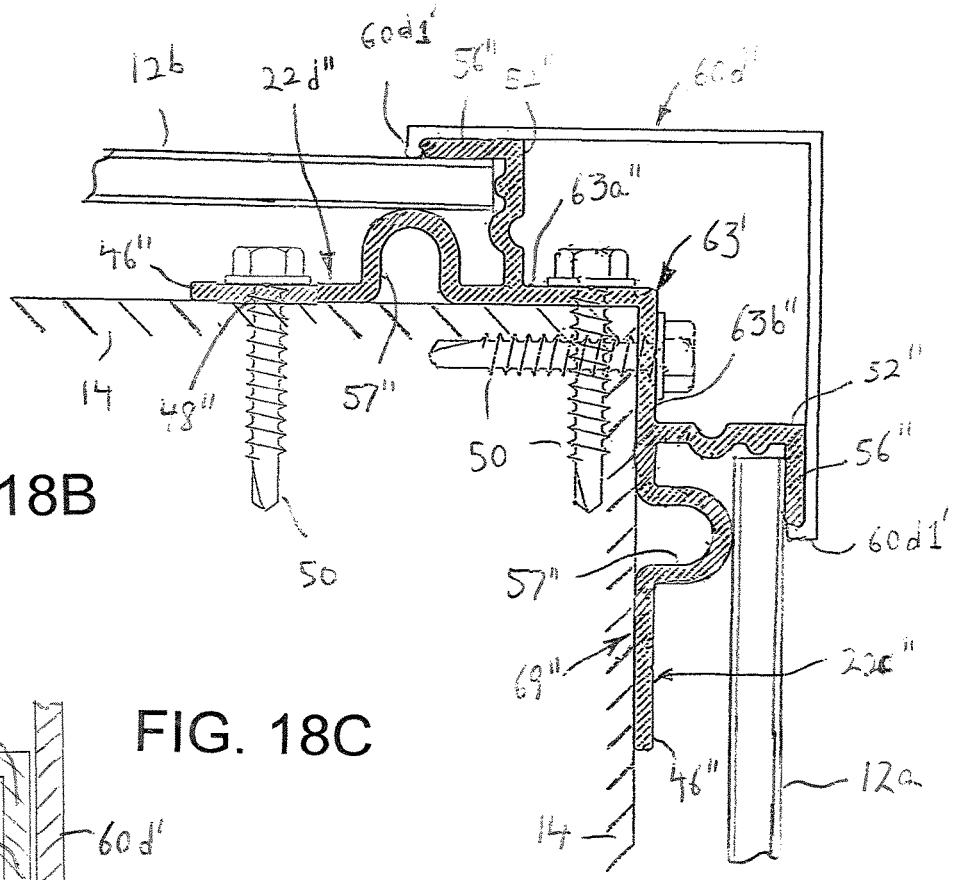
FIG. 18B is an enlarged cross-sectional view of FIG. 18A.

Referring now to FIGS. 18, 18A and 18B, there is shown a system for easily mounting wall panels over an existing wall, showing a modified construction for securement of the wall panels at an outside corner of an existing corner wall 14, using the basic construction shown in FIGS. 19-25. Specifically, two corner fastening extrusions 22*c*" and 22*d*" are connected together by an elongated L-shaped wall 63" that wraps around the corner of existing wall 14 to form a singe, one-piece, corner fastening extrusion assembly 69". L-shaped wall 63" includes connected right angle wall panels 63*a*" and 63*b*" connected together at one end and connected at their opposite ends to the lower ends of retaining walls 52" so that base sections 46" of the two corner fastening extrusions 22*c*" and 22*d*" are at right angles to each other and seat on the right angle existing walls 14. The securing screws are omitted in FIGS. 18 and 18A for the sake of clarity, but are shown in FIG. 18B.

Each base section 46" has a plurality of linearly aligned openings 48" extending therealong and through which screws 50 can be inserted to secure base section 46" to existing wall 14. An arcuate bend 57" is formed in each base section 46" in the same manner as discussed previously in FIGS. 19-25.

A single bent end retaining wall 52" extends outwardly at right angles from each base section 46", and a hold down wall 56" is connected at the upper end of each retaining wall 52" and faces outwardly away from the corner. Hold down wall 56" is provided in parallel, spaced relation with base section 46". Retaining wall 52" is provided with the aforementioned lower arcuate bend 53" and upper bulge 55" on the outwardly facing surface thereof immediately above outward bulge 53*a*", in the same manner as previously discussed. Thus, outward bulge 53*a*" is at the same height as the apex of the adjacent arcuate bend 57" formed in base section 46".

Alternatively, corner fastening extrusions 22*c*" and 22*d*" can be formed separately from L-shaped wall 63" in the manner shown in FIG. 25A.

To assemble corner fastening extrusion assembly 69" with corner wall 14, it is first assumed that wall panel 12*a* in FIG. 18B extends from a main fastening extrusion 20" (not shown) below it. Then, corner fastening extrusion assembly 69" is positioned over corner wall 14, as shown, with the space between hold down wall 56" and arcuate bend 57" of corner fastening extrusion 22*c*" receiving the free end of wall panel 12*a*. Thereafter, screws 50 are inserted through openings in wall panels 63*a*" and 63*b*" of elongated L-shaped wall 63" and in base section 46" of corner fastening extrusion 22*d*" to the outside of arcuate bend 57" thereof. Then, one end of the other wall panel 12*b* is inserted within the space between hold down wall 56" and arcuate bend 57" of corner fastening extrusion 22*d*".

Alternatively, in the event that the starting point for assembly of the wall panels begins at the corner, screws 50 are first inserted through openings in wall panels 63*a*" and 63*b*" of elongated L-shaped wall 63" and in base section 46" of corner fastening extrusion 22*d*" to the outside of arcuate bend 57" thereof. Then, one end of each wall panel 12*a* and 12*b* is inserted within the respective space between hold down wall 56" and arcuate bend 57" of corner fastening extrusions 22*c*" and 22*d*".

Thereafter, an L-shaped closure member made of any suitable thin material such as aluminum, is secured over corner fastening extrusion assembly 69" for decorative purposes. In the embodiment of FIG. 18, an L-shaped closure member 60*c*' is provided, with free ends thereof received and held in recesses 53*b*".

Figure 18C:
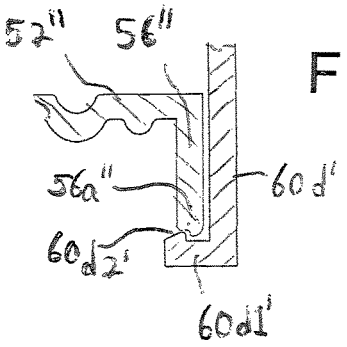
FIG. 18C is an enlarged cross-sectional view of a portion of FIG. 18B.

In FIGS. 18A and 18B, an L-shaped closure member 60*d*' is provided for decorative purposes, in which the free ends thereof have downturned walls 60*d*1' which engage over the ends of hold down walls 56". Preferably, the inner ends of downturned walls 60*d*1', as best shown in FIG. 18C, have inwardly directed tabs or beads 60*d*2' that engage within cut-away recesses 56*a*" at the free ends of enlarged holding section 56".

Of course, it will be appreciated that, in all of the embodiments of the present application, a thermal break insulation 99 can be positioned between existing wall 14 and base section 26, base section 46 and/or base support 76 so that base section 26, base section 46 and/or base support 76 are not in direct contact with existing wall 14 of the building.

Figure 26:
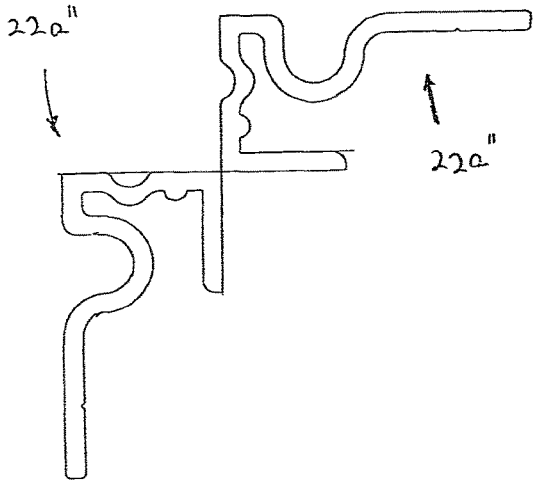
FIG. 26 is a cross-sectional view of a further modification of the system for easily mounting wall panels over an existing wall, showing the use of two connected together first corner fastening extrusions of the type shown in FIG. 22, for use at an inside corner of an existing wall in the same manner as shown in FIG. 16.
Figure 27:
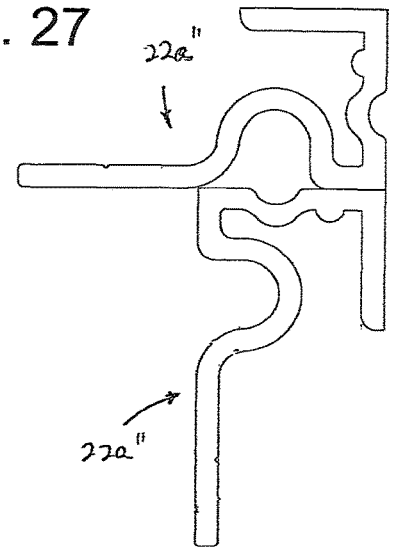
FIG. 27 is a cross-sectional view of a still further modification of the system for easily mounting wall panels over an existing wall, showing the use of two first corner fastening extrusions of the type shown in FIG. 22, for use at an outside corner of an existing wall in the same manner as shown in FIG. 17.
Figure 28:
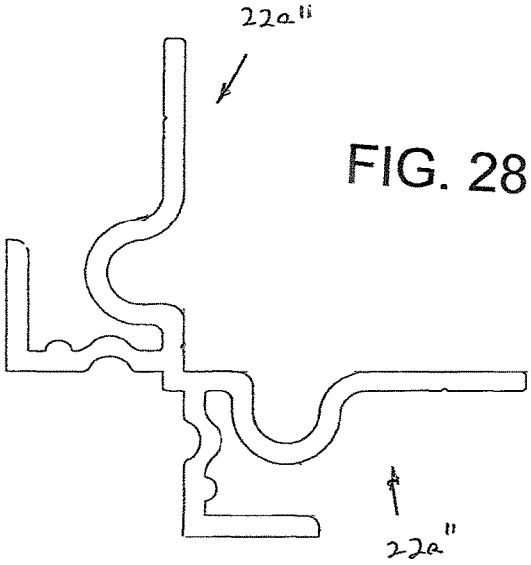
FIG. 28 is a cross-sectional view of a yet further modification of the system for easily mounting wall panels over an existing wall, showing the use of two first corner fastening extrusions of the type shown in FIG. 22, for use at an outside corner of an existing wall in the same manner as shown in FIG. 18.

FIG. 26 is a cross-sectional view of a further modification of the system for easily mounting wall panels over an existing wall, showing the use of two connected together first corner fastening extrusions 20*a*" of the type shown in FIG. 22, for use at an inside corner of an existing wall in the same manner as shown in FIG. 16;

FIG. 27 is a cross-sectional view of a still further modification of the system for easily mounting wall panels over an existing wall, showing the use of two first corner fastening extrusions 20*a*" of the type shown in FIG. 22, for use at an outside corner of an existing wall in the same manner as shown in FIG. 17;

FIG. 28 is a cross-sectional view of a yet further modification of the system for easily mounting wall panels over an existing wall, showing the use of two first corner fastening extrusions 20*a*" of the type shown in FIG. 22, for use at an outside corner of an existing wall in the same manner as shown in FIG. 18.

It will be appreciated that although only shown in the first embodiment of FIGS. 1-4, in all of the above embodiments, prior to securing a main fastening extrusion 20, 20' or 20", a corner fastening extrusion 22, 22', 22" or 22*a*" or base support 78 of structural support assembly 24 to existing wall 14, a thermal break insulation 99 is inserted over existing wall 14, and then main fastening extrusion 20, 20' or 20", a corner fastening extrusion 22, 22', 22" or 22*a*" or base support 78 of structural support assembly 24 is positioned over the thermal insulation break 99, with screws 30, 50, 84 also inserted through the thermal insulation break 99.

When installing wall panels over an existing wall, it is often necessary to provide a spacing between the wall panels and the existing wall. This spacing can be provided for ventilation, to provide for water run-off, to provide insulation therein, and to provide a thermal barrier. Typically, Z-furring or U-channel furring is used to provide this spacing between the existing wall and the wall panels. However, it has been found that this arrangement is not entirely satisfactory. For example, although it is known to combine insulation with the Z-furring or U-channel furring, such insulation is not securely held therein, and must be secured by screws, adhesive or the like. Further, the outwardly extending foot walls of the Z-furring or U-channel furring are secured directly to the existing wall, thereby providing thermal transfer directly with the existing wall. In addition, such Z-furring or U-channel furring may not be entirely satisfactory in providing thermal insulation, and in many cases, it is desirable to increase the thermal insulation. It is also not possible to change the spacing between the walls panels and existing wall since the Z-furring or U-channel furring are of fixed dimensions.

U.S. patent application Ser. No. 15/047,024, filed Feb. 18, 2016 and entitled THERMAL BREAK SYSTEM FOR WALL PANELS SECURED TO AN EXISTING WALL, the entire disclosure of which is incorporated herein by reference, to the same applicant herein, attempts to solve this problem by providing additional thermal insulation between the existing wall and the outside in a system utilizing Z-furring, U-channel furring, and T-furring.

The aforementioned sliding arrangement can be used in such a system utilizing Z-furring, U-channel furring, and T-furring.

Figure 29:
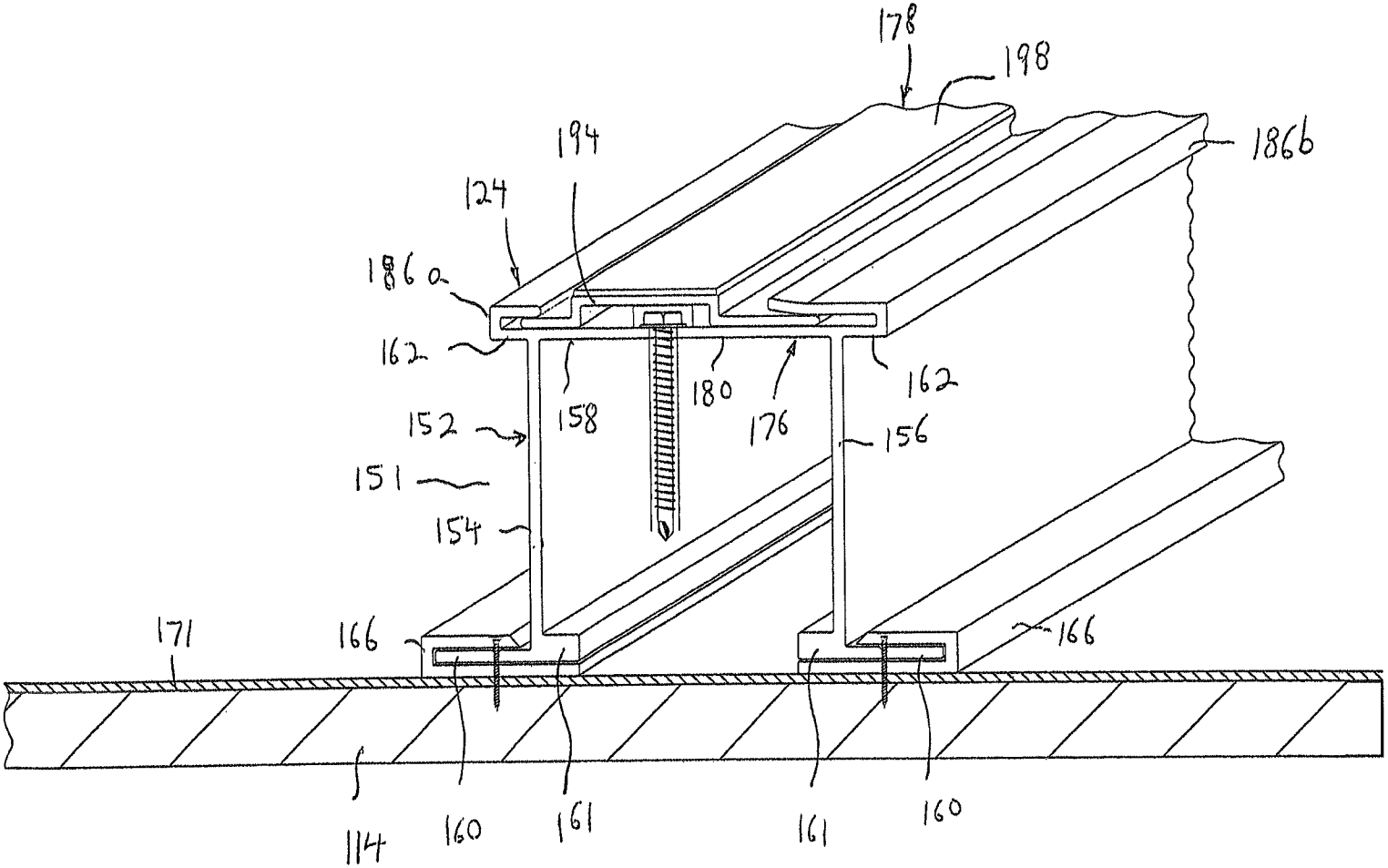
FIG. 29 is a perspective view of another embodiment of the system for easily mounting wall panels over an existing wall, using a U-channel furring with an intermediary structural support assembly.

Specifically, as shown in FIG. 29, in order to provide a spacing 151 between the wall panels (not shown) and the existing wall 114, for example, for ventilation, to provide for water run-off, to provide insulation therein, and to provide a thermal barrier, a U-channel furring 152 is connected between existing wall 114 and the wall panels.

Specifically, U-channel furring 152 includes two parallel, spaced apart spacing walls 154 and 156 connected together by a common transverse connection wall 158 at one end of walls 154 and 156, as is known. Also, outwardly extending foot walls 160 are connected to the opposite free ends of spaced apart walls 154 and 156, as is also known. However, in accordance with one aspect of said U.S. patent application Ser. No. 15/047,024, opposing inwardly extending foot walls 161 extend inwardly of walls 154 and 156 in a coplanar arrangement with outwardly extending foot walls 160, and opposite extension walls 162 are formed as a continuation of common transverse wall 158 and extend outwardly of spaced apart walls 154 and 156. In this manner, insulation 273 (see FIG. 53) can be positioned in spacing 151 so as to be tightly held between foot walls 160 and extension walls 162 so as to prevent escape thereof, and to keep the insulation properly positioned at all times. Further, the insulation is tightly held between common transverse wall 158 and inwardly extending foot walls 161. This eliminates the need for any additional members to hold the insulation in place, such as screws, adhesives, etc., while also eliminating any extra labor that would result therefrom.

U-channel furring 152 is made of a metal material, and therefore, is thermally conductive, that is, will transfer heat and cold from the outside to existing wall 114, which is undesirable. Therefore, a generally J-shaped thermal insulation cover 166 is positioned around each foot wall 160, and is made of a thermally insulating material so that foot walls 160 are not in direct contact with existing wall 114 of the building. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

As a result of the above arrangement, a space is further provided between the insulation and existing wall 114, which allows for water and air circulation. In this regard, a thin waterproof membrane 171 can be provided against existing wall 114.

With the above arrangement, elongated base plate 180 of base support 176 of each intermediary structural support assembly 124 is formed by common transverse connection wall 158 and opposite extension walls 162 of U-channel furring 152, with L-shaped retaining walls 186*a*, 186*b* extending outwardly from side edges of opposite extension walls 162. Further, in order to enhance easy insertion of sliding support member 178 therein, the free end of L-shaped retaining wall 186*b* is angled outwardly. FIG. 29 also shows an adhesive member 198, which can be a double sided tape, an adhesive or any other securing means, secured on top of inverted U-shaped plate 194 of sliding support member 178, for securement of a wall panel thereon.

Of course, it will be appreciated that, with the arrangement of FIG. 29, a similar U-channel furring 152 will be provided below each corner fastening extrusion and main fastening extrusion with the base section thereof formed by common transverse connection wall 158 and L-shaped retaining walls 186*a*, 186*b* of U-channel furring 152.

Figure 30:
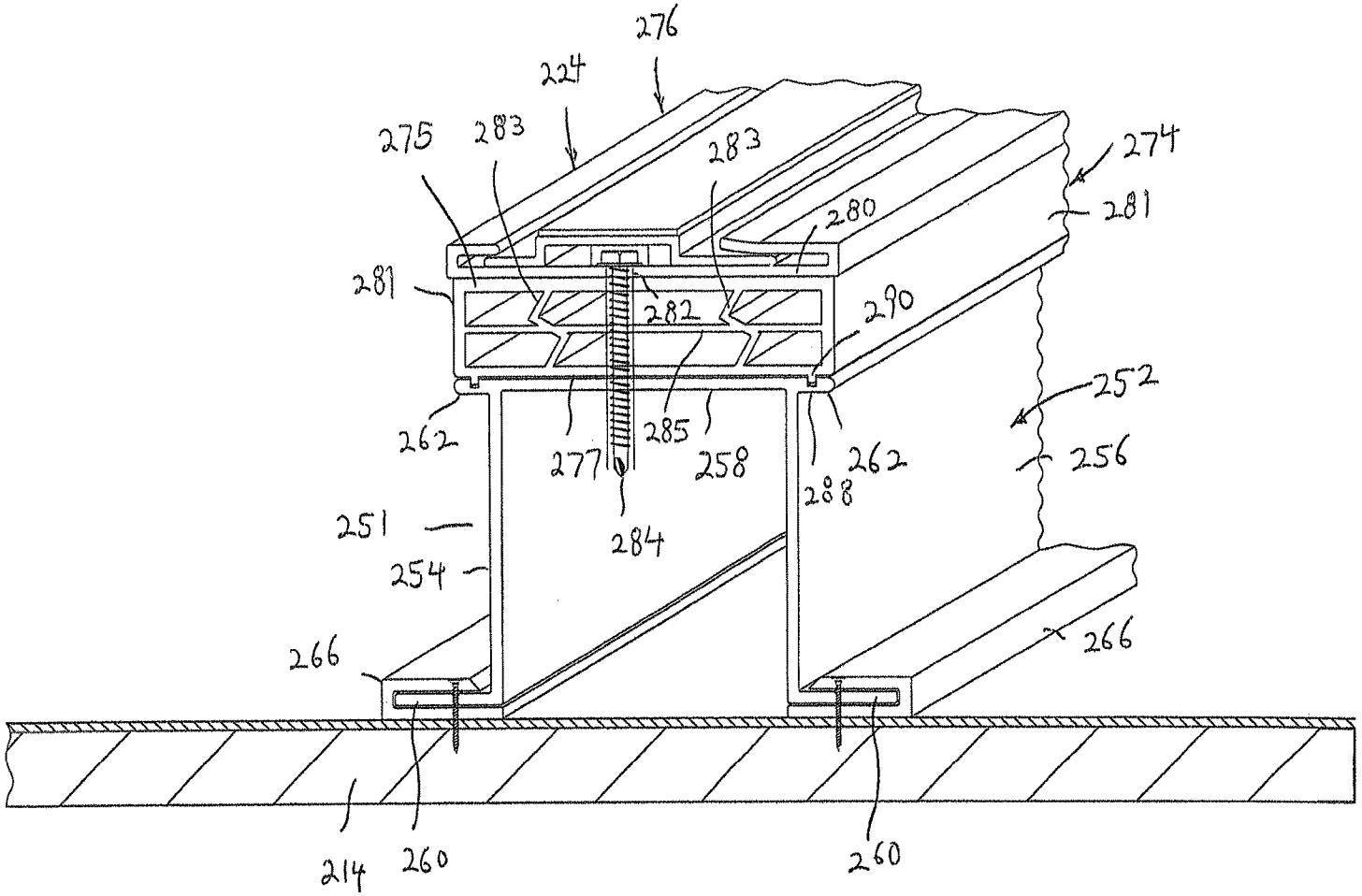
FIG. 30 is a perspective view of a modification of the embodiment of FIG. 29, using a U-channel furring with a thermal break attachment and an intermediary structural support assembly.

Referring now to FIG. 30, a further thermal break attachment 274 is connected between common transverse wall 258 of U-channel furring 252 and elongated base plate 280 of base support 276 of each intermediary structural support assembly 224.

U-channel furring 252 includes two parallel, spaced apart spacing walls 254 and 256 connected together by a common transverse connection wall 258 at one end of walls 254 and 256, as is known. Also, outwardly extending foot walls 260 are connected to the opposite free ends of spaced apart walls 254 and 256, as is also known. Opposing inwardly extending foot walls (not shown) can also be provided so as to extend inwardly of walls 254 and 256 in a coplanar arrangement with outwardly extending foot walls 260, and opposite extension walls 262 are formed as a continuation of common transverse wall 258 and extend outwardly of spaced apart walls 254 and 256. In this manner, insulation (not shown) can be positioned in spacing 251 so as to be tightly held between foot walls 260 and extension walls 262 so as to prevent escape thereof, and to keep the insulation properly positioned at all times. Further, the insulation is tightly held between common transverse wall 258 and the inwardly extending foot walls. This eliminates the need for any additional members to hold the insulation in place, such as screws, adhesives, etc., while also eliminating any extra labor that would result therefrom.

U-channel furring 252 is made of a metal material, and therefore, is thermally conductive, that is, will transfer heat and cold from the outside to existing wall 214, which is undesirable. Therefore, a generally J-shaped thermal insulation cover 266 is positioned around each foot wall 260, and is made of a thermally insulating material so that foot walls 260 are not in direct contact with existing wall 214 of the building. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

Thermal break attachment 274 is formed by at least an outer wall 275 and a parallel, spaced apart inner wall 277 connected together by outer transverse walls 281 and preferably, also by inner transverse walls 283. As shown in FIG. 30, thermal break attachment 274 also includes an intermediate wall 285 in parallel spaced apart relation to and between outer wall 275 and inner wall 277, and also connected with transverse walls 281 and 283.

The upper surface of common transverse wall 258 of U-channel furring 252 includes parallel, spaced apart openings 288 having a dovetail cross-sectional configuration, and the lower surface of inner wall 277 of thermal break attachment 274 is provided with projections 290 having a dovetail cross-sectional configuration complementary in shape and dimensions to openings 288 to slidably lock therein.

Elongated base plate 280 of base support 276 of elongated intermediary structural support assembly 224 sits on top of outer wall 275 of thermal break attachment 274 and includes openings 282 therein through which screws 284 extend to secure base plate 280 to outer wall 275, inner wall 277 and intermediate wall 285.

Of course, it will be appreciated that, with the arrangement of FIG. 30, a similar U-channel furring 252 will be provided below each corner fastening extrusion and main fastening extrusion.

Figure 31:
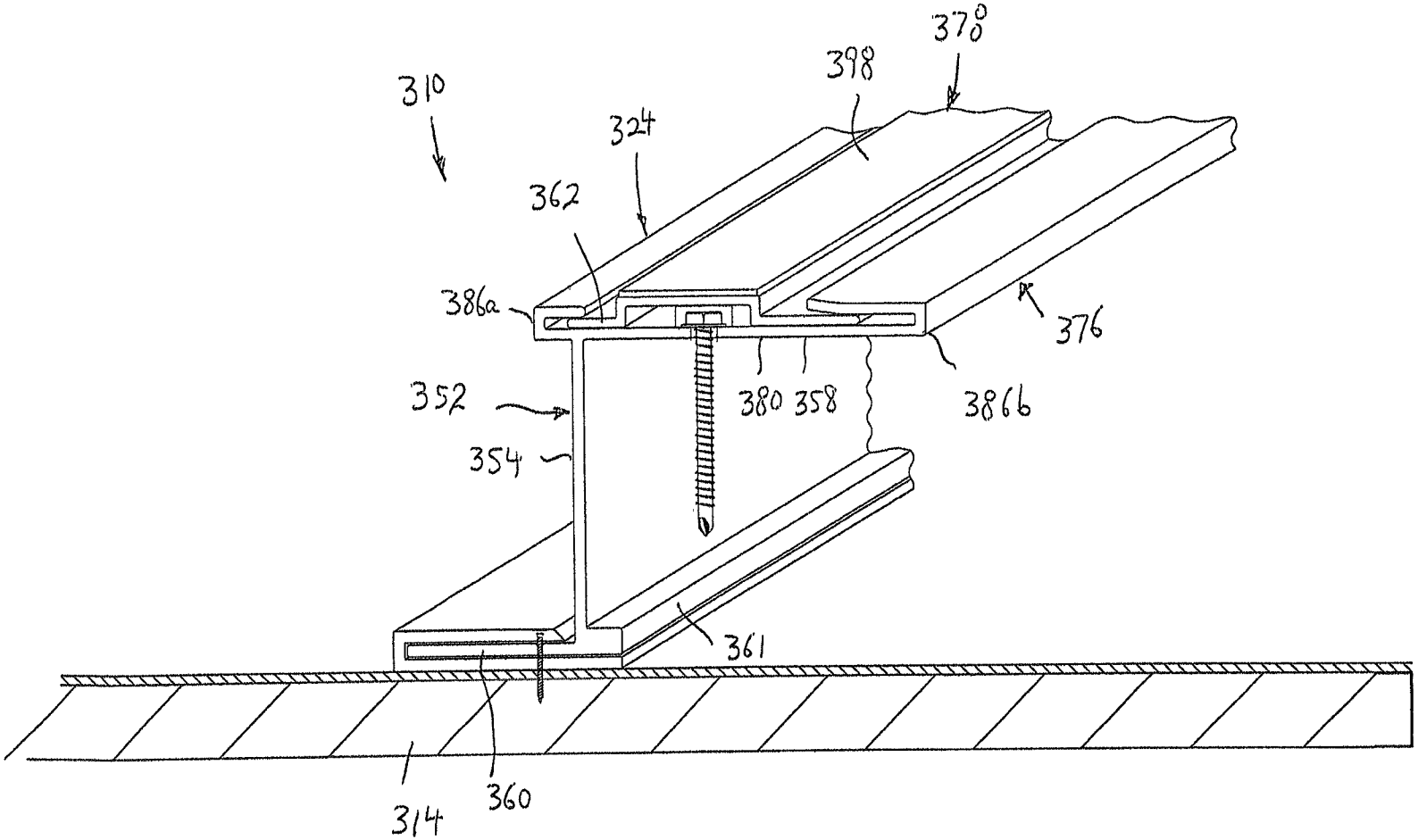
FIG. 31 is a perspective view of another modification of the embodiment of FIG. 29, using a Z-channel furring with an intermediary structural support assembly.

Referring now to FIG. 31, there is a shown a system 310 according to the present invention for mounting wall panels over an existing planar wall 314 through Z-furring 352 with thermal breaks. All of the elements shown in FIG. 31 are identical to those in FIG. 29 and use the same numerals augmented by a value of 200, except that U-channel furring 152 is replaced with Z-furring 352, and therefore, a detailed description of the common elements will be omitted for the sake of brevity.

Z-furring 352 includes a single spacing wall 354 that replaces the two parallel, spaced apart walls 154 and 156 of U-channel furring 152, with a transverse connection wall 358 at one end thereof and extending to the right side of wall 354 in FIG. 31, and an extension wall 362 formed as a continuation of transverse wall 358 and extending to the opposite left side of wall 354 in FIG. 31. An outwardly extending transverse foot wall 360 extends from the opposite end of wall 354 to the left side of wall 354 in FIG. 31, and a coplanar, inwardly extending transverse foot wall 361 is also connected to the opposite free end of wall 354, and extends to the right side of wall 354 in FIG. 31. In this manner, insulation is tightly held between foot wall 360 and extension wall 362 so as to prevent escape thereof, and to keep insulation properly positioned at all times. Further, insulation is tightly held between transverse wall 358 and inwardly extending foot wall 361. This eliminates the need for any additional members to hold the insulation in place, such as screws, adhesives, etc., while also eliminating any extra labor that would result therefrom.

As with U-channel furring 152, elongated base plate 380 of base support 376 of each intermediary structural support assembly 324 is formed by common transverse connection wall 358 and extension wall 362 of Z-channel furring 352, with L-shaped retaining walls 386*a*, 386*b* extending outwardly from side edges of opposite extension walls 362. Further, in order to enhance easy insertion of sliding support member 378 therein, the free end of L-shaped retaining wall 386*b* is angled outwardly. FIG. 31 also shows an adhesive member 398, which can be a double sided tape, an adhesive or any other securing means, secured on top of inverted U-shaped plate 394 of sliding support member 378, for securement of a wall panel thereon.

Of course, it will be appreciated that, with the arrangement of FIG. 31, a similar Z-channel furring 352 will be provided below each corner fastening extrusion and main fastening extrusion.

Further, a thermal break attachment similar to thermal break attachment 274 can be provided with this embodiment as well.

Figure 32:
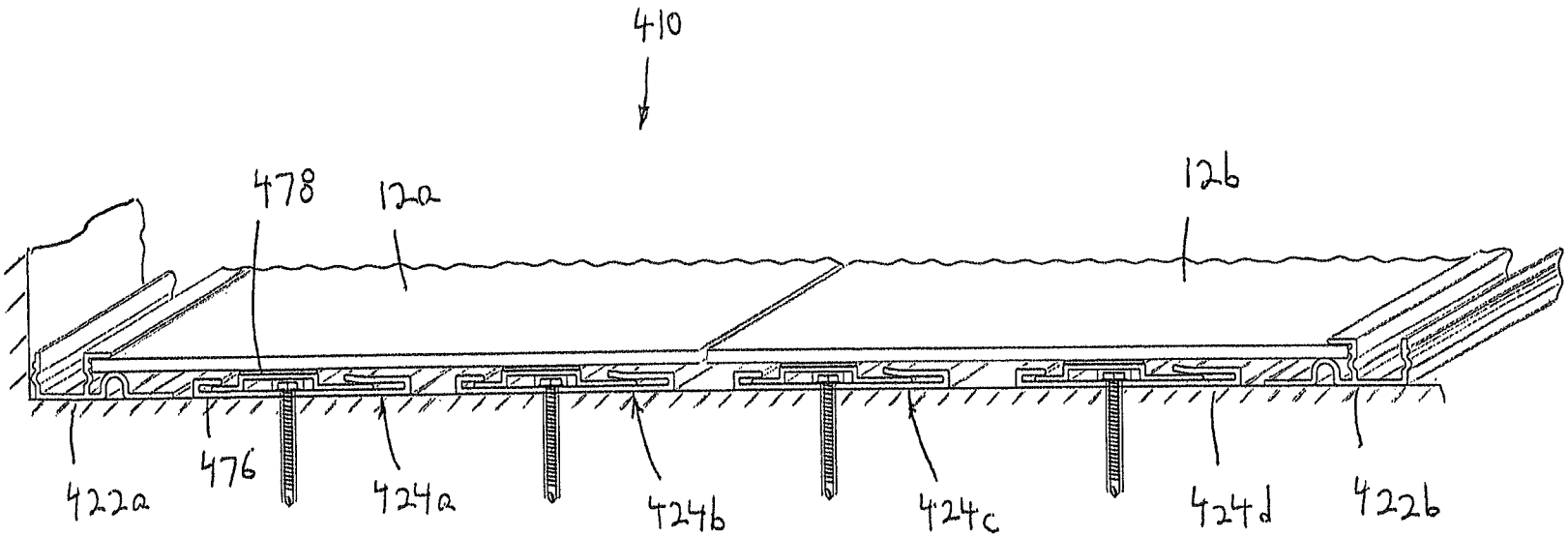
FIG. 32 is a perspective view of a further embodiment of the system for easily mounting wall panels over an existing wall without any main fastening extrusions, showing a final condition for securement of first and second wall panels thereto.

Referring now to FIG. 32, there is shown a further embodiment of a system 410 for easily mounting wall panels over an existing wall, showing a final condition for securement of first and second wall panels 12*a*, 12*b* thereto.

As shown therein, main fastening extrusions are eliminated, and there are only two panels 12*a*, 12*b* assembled without any main fastening extrusion therebetween. System 410 includes corner fastening extrusions 422 which are identical to corner fastening extrusions 22*a*" of FIGS. 24 and 25, and intermediary structural support assemblies 424 which are identical to intermediary structural support assemblies 224 of FIG. 30. With this arrangement, the leftmost corner fastening extrusion 422*a* is installed on existing wall 14, and base supports 476 of intermediary structural support assemblies 424*a* and 424*b* are then installed in spaced relation to leftmost corner fastening extrusion 422*a*. Then, sliding support members 478 are inserted into these base supports 476 to the extreme right thereof. Wall panel 12*a* is then connected to base supports 476 and slid to the left with base supports 476 to the position shown in FIG. 32.

Thereafter, base supports 476 of intermediary structural support assemblies 424*c* and 424*d* are then installed in spaced relation to wall panel 12*a*. Then, sliding support members 478 are inserted into base supports 476 of structural support assemblies 424*c* and 424*d* to the extreme right thereof. Wall panel 12*b* is then connected to base supports 476 and slid to the left with base supports 476 to the position shown in FIG. 32, with the left edge of wall panel 12*a* immediately adjacent the right edge of wall panel 12*a*. Thereafter, rightmost corner fastening extrusion 422*b* is installed on existing wall 14 with the right edge of wall panel 12*b*.

Further, system 410 can be used with many linearly aligned wall panels. For example, a further corner fastening extrusion (not shown) which is oriented the same as corner fastening extrusion 422*a* can be positioned adjacent the right side of corner fastening extrusion 422*b*, and two more wall panels can be assembled in the same manner, and so on. In such case, corner fastening extrusions 422 effectively become main fastening extrusions, and a cover can be provided to cover adjacent corner fastening extrusions 422.

Figure 33:
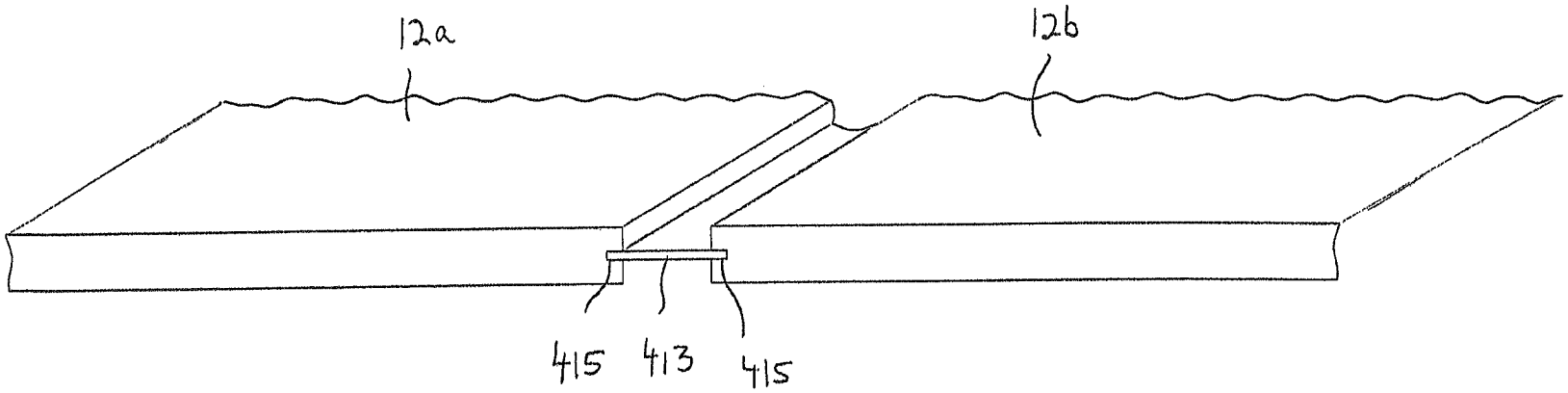
FIG. 33 is a perspective view of a connector arrangement for connecting together adjacent side edges of adjacent wall panels of FIG. 32.

Further, adjacent edges of adjacent walls panels 12*a* and 12*b* can be further connected together, as shown in FIG. 33, by a connecting plate 413 which fits within slots 415 of adjacent edges of wall panels 12*a* and 12*b*.

Figure 34:
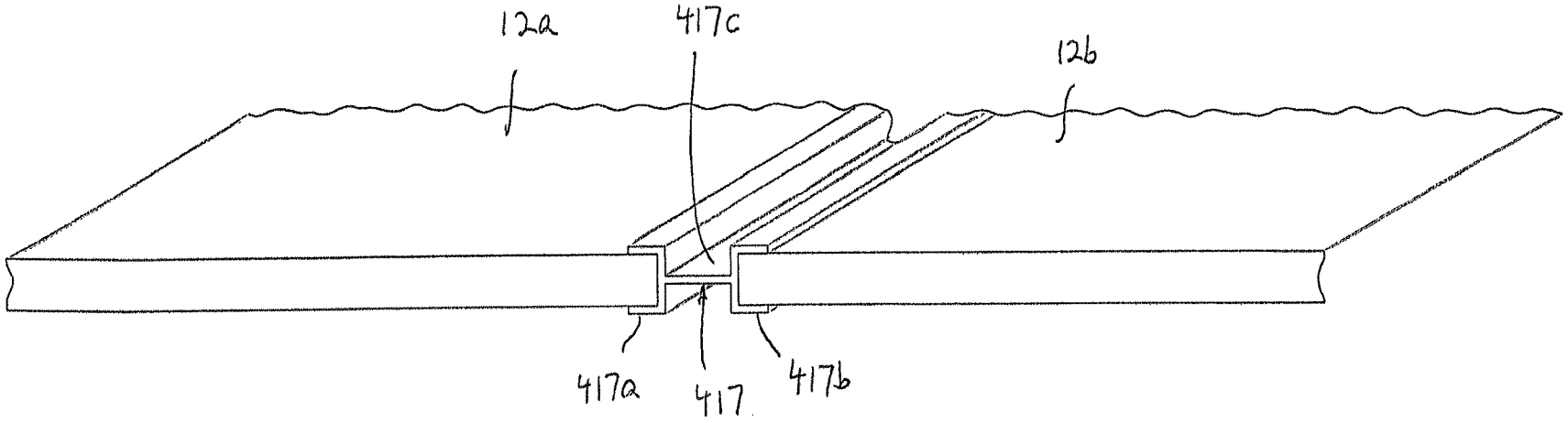
FIG. 34 is a perspective view of another connector arrangement for connecting together adjacent side edges of adjacent wall panels of FIG. 32.

Alternatively, as shown in FIG. 34, a connector 417 can be used to connect together adjacent edges of wall panels 12*a* and 12*b*. In such case, connector 417 includes a first U-shaped connector 417*a* that engages the side edge and top and bottom of wall panel 12*a*, a second U-shaped connector 417*b* that engages the side edge and top and bottom of wall panel 12*a*, and a connecting plate 417*c* that connects together first and second U-shaped connectors 417*a* and 417*b*.

Figure 32A:
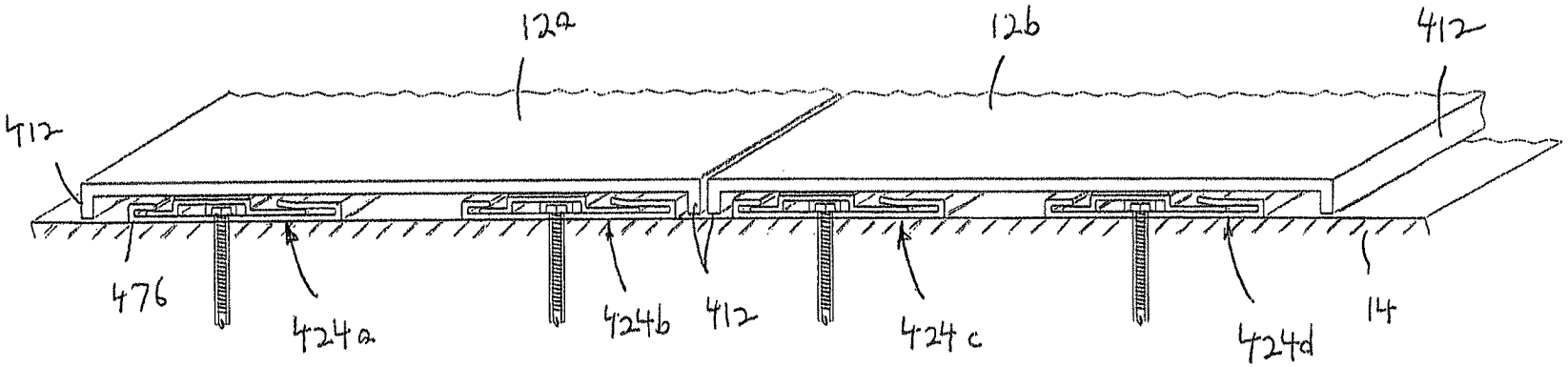
FIG. 32A is a perspective view of a modification of the further embodiment of FIG. 32.

As shown in FIG. 32A, inwardly turned bent end sections 412 can be provided at side and end edges of wall panels 12*a* and 12*b* so as to be in abutting relation to each other. This also eliminates the corner fastening extrusions.

Figure 35:
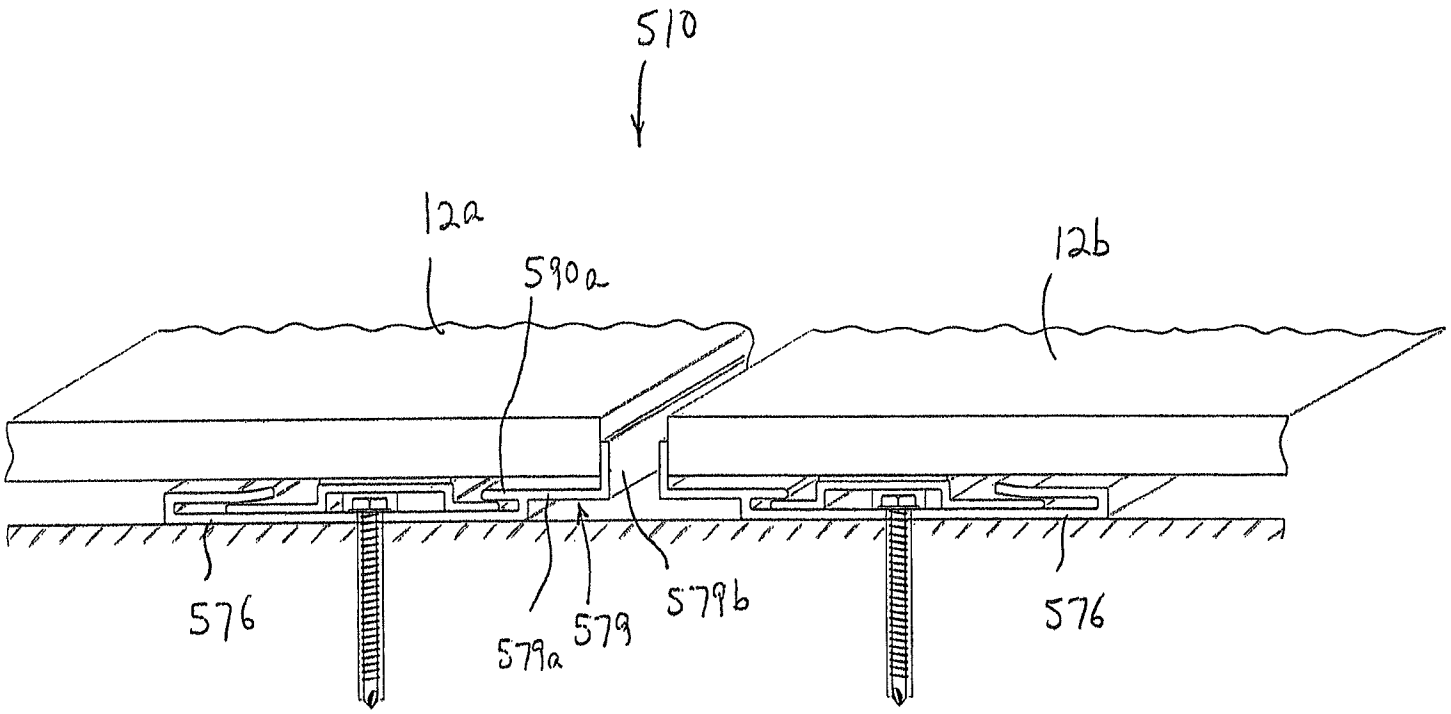
FIG. 35 is a perspective view of a still further embodiment of the system for easily mounting wall panels over an existing wall without any main fastening extrusions, showing a final condition for securement of first and second wall panels thereto.

Referring now to FIG. 35, there is shown a further embodiment of the system 510 for easily mounting wall panels over an existing wall, showing a final condition for securement of first and second wall panels 12*a*, 12*b* thereto.

In this embodiment, base supports 576 of intermediary structural support assemblies 524 for adjacent wall panels 12*a* and 12*b* are oriented 180 degrees out of phase with each other. Further, inwardly extending second wall 590*a* of each base support 576 includes an L-shaped extension wall 579 having a first wall 579*a* that is coplanar with and forms an outward extension of second wall 590*a* and a second wall 579*b* that extends at right angles outwardly from the free end of first wall 579*a* and which functions as a stop limit for the edge of the respective wall panel 12*a*, 12*b*.

Figure 36:
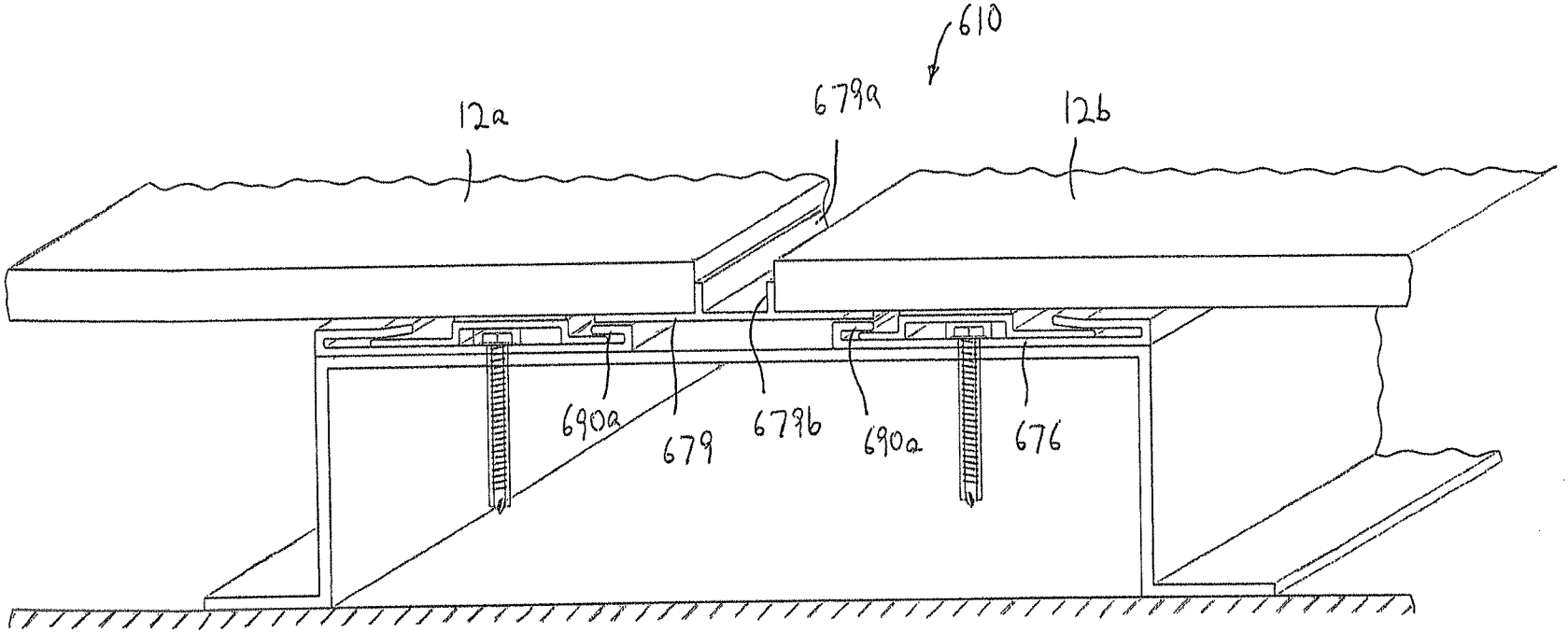
FIG. 36 is a perspective view of a yet further embodiment of the system for easily mounting wall panels over an existing wall without any main fastening extrusions, showing a final condition for securement of first and second wall panels thereto.

Alternatively, as shown in FIG. 36, in an alternative system 610, L-shaped extension walls 579 can be replaced with a common plate 679 that sits on top of adjacent second walls 690*a* of adjacent base supports 676 of intermediary structural support assemblies 624, and two parallel, spaced apart walls 679*a* and 679*b* extend outwardly from common plate 679 to function as stop limits for the edges of the respective wall panels 12*a*, 12*b*.

Figure 37:
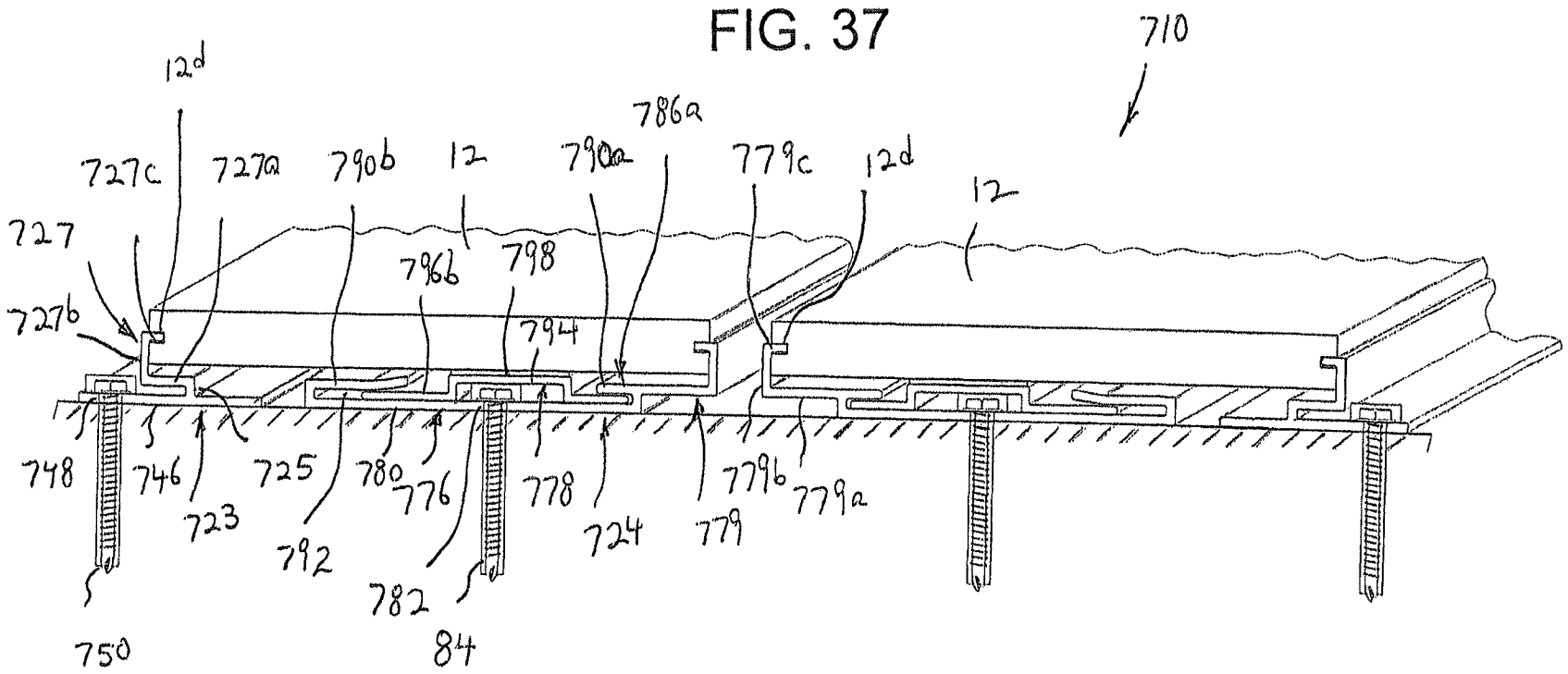
FIG. 37 is a perspective view of yet another embodiment of the system for easily mounting wall panels over an existing wall without any main fastening extrusions, showing a final condition for securement of first and second wall panels thereto.

A further alternative system 710 is shown in FIG. 37, in which each structural support assembly 724 includes a base support 776 that is secured to existing wall 14 and a sliding support member 778 that is slidably retained within base support 776. Base support 776 is identical with base support 76 except that inwardly extending second wall 790*a* of each base support 776 includes a J-shaped extension wall 779 having a first wall 779*a* that is coplanar with and forms an outward extension of second wall 790*a*, a second wall 779*b* that extends at right angles outwardly from the free end of first wall 779*a* and which functions as a stop limit for the edge of the respective wall panel 12, and a third wall 779*c* which turns inwardly at a right angle from second wall 779*b* and which engages within a slot 12*d* of a wall panel 12.

An end extrusion 723 includes a base section 746 that seats flush against and is secured to existing wall 14. A first wall 725 extends upwardly from base section 746, and a second J-shaped extension wall 727 has a first wall 727*a* that is in parallel, spaced relation to base section 746, a second wall 727*b* that extends at right angles outwardly from the free end of first wall 727*a* and which functions as a stop limit for the edge of the respective wall panel 12, and a third wall 727*c* which turns inwardly at a right angle and which engages within a slot 12*d* of a wall panel 12.

In assembling wall panels 12 with this arrangement, base supports 776 are first secured to wall panel 12 in spaced apart relation, as shown, by screws 84 through openings 782 in base supports 776. It will be appreciated that adjacent base supports 776 are assembled such that L-shaped retaining walls 786*a* are closest to each other. Support members 778, which are identical to support members 78, are then assembled in sliding relation with base supports 776 as discussed above, with wing plates 796*b* positioned entirely in spaces 792 between second walls 790*b* and base plate 780. An adhesive member 798, which can be a double sided tape, an adhesive or any other securing means, is secured on top of each inverted U-shaped plate 794 of sliding support members 778, for securement of wall panels 12 thereon. Then, each wall panel 12, with its sliding support member 778 secured thereto, is slid in its base support 776 to the positions shown in FIG. 37 toward each other until third walls 779*c* of J-shaped extension walls 779 engage within slots 12*d* of adjacent wall panels 12.

Then, end extrusions 723 are assembled with the opposite sides of wall panels 12 such that third walls 727*c* of second J-shaped extension walls 727 engage within slots 12*d* at the opposite side edges of wall panels 12. Thereafter, screws 750 are inserted through openings 748 in base sections 746 to secure end extrusions 723 in position. The construction then continues to the left and/or right in FIG. 37 in the same manner.

In order to assemble wall panels 12 in covering relation to existing wall 14, reference is made to FIGS. 38-44 which utilizes the construction of the embodiment of FIGS. 19-25, with the understanding that this method is applicable to all of the above embodiments.

Figures 38, 39, 40, 41:
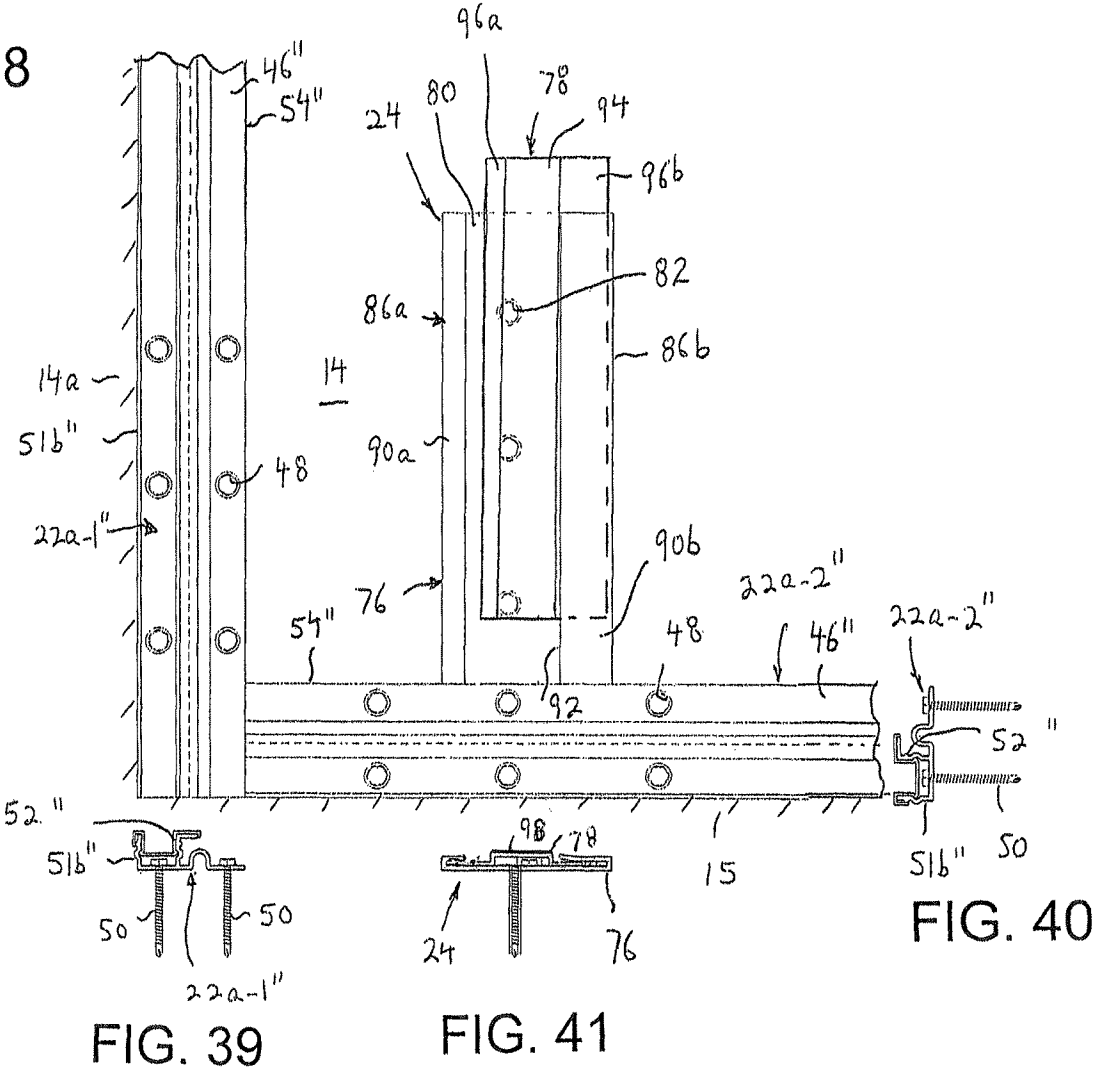
FIG. 38 is a top plan view showing a first step of a method for easily mounting wall panels over an existing wall using the embodiment of FIGS. 19-25.
FIG. 39 is a cross-sectional view of the first corner fastening extrusion of FIG. 38.
FIG. 40 is a cross-sectional view of the second corner fastening extrusion of FIG. 38.
FIG. 41 is a cross-sectional view of the structural support assembly of FIG. 38.

A first corner fastening extrusion 22*a*-1" is first secured to existing wall 14, as shown in FIGS. 38 and 39, by screws 50 through openings 48 thereof (or other fastening members such as double sided tape or the like) adjacent a corner where existing wall 14 meets another existing wall 14*a*. In such case, wall 51*b*" of first corner fastening extrusion 22*a*-1" is positioned in abutting relation to adjacent existing wall 14*a*. Then, a second corner fastening extrusion 22*a*-2" is secured to existing wall 14, as shown in FIGS. 38 and 40, by screws 50 through openings 48 thereof adjacent a corner where existing wall 14 meets a floor (or ceiling) 15, and with an end edge of second corner fastening extrusion 22*a*-2" abutting against the free edge 54" of base section 46" of first corner fastening extrusion 22*a*-1" and with wall 51*b*" of second corner fastening extrusion 22*a*-2" positioned in abutting relation to floor 15.

The base support 76 of one or more structural support assemblies 24 is secured to existing wall 14 in parallel, spaced relation to first corner fastening extrusion 22*a*"-1, with L-shaped retaining wall 86*a* being closer to corner fastening extrusion 22*a*-1", and with one end edge of the base support 76 abutting against the free edge 54" of base section 46" of second corner fastening extrusion 22*a*-2".

Thereafter, a sliding support member 78 is assembled with its base support 76 by angling sliding support member 78 slightly to slide wing 96*b* into the space 92 between the base plate 80 and second wall 90*b*. At such time, the free end of wing 96*a* is positioned in spaced relation from the free edge of second wall 90*a*, as shown in FIGS. 38 and 41, and in the manner shown in FIG. 11. In this position, sliding support member 78 is also offset in the lengthwise direction from its base support 76, as shown in FIG. 38. Then, an adhesive member 98, which can be a double sided tape, an adhesive or any other securing means, is secured on top of inverted U-shaped plate 94.

Figure 42:
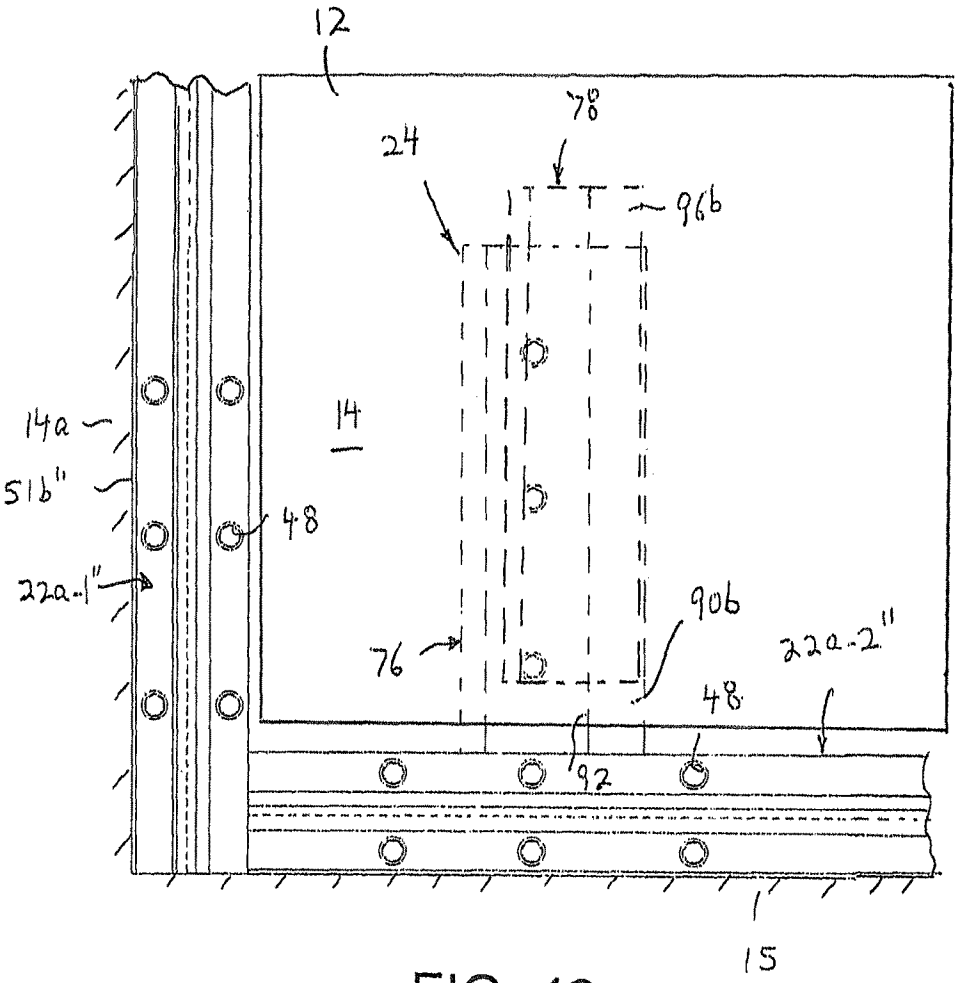
FIG. 42 is a top plan view showing a second step of the method for easily mounting wall panels over an existing wall using the embodiment of FIGS. 19-25.

The thin aluminum wall 18 of one wall panel 12 is then secured to the top of the inverted U-shaped plate 94 of at least one sliding support member 78 by the adhesive member 98. In such position, the leftmost free edge of wall panel 12, as viewed in FIG. 42, is in spaced relation to first corner fastening extrusion 22*a*-1" and the lower edge of wall panel 12, as viewed in FIG. 42, is in spaced relation to second corner fastening extrusion 22*a*-2".

Figures 43, 44:
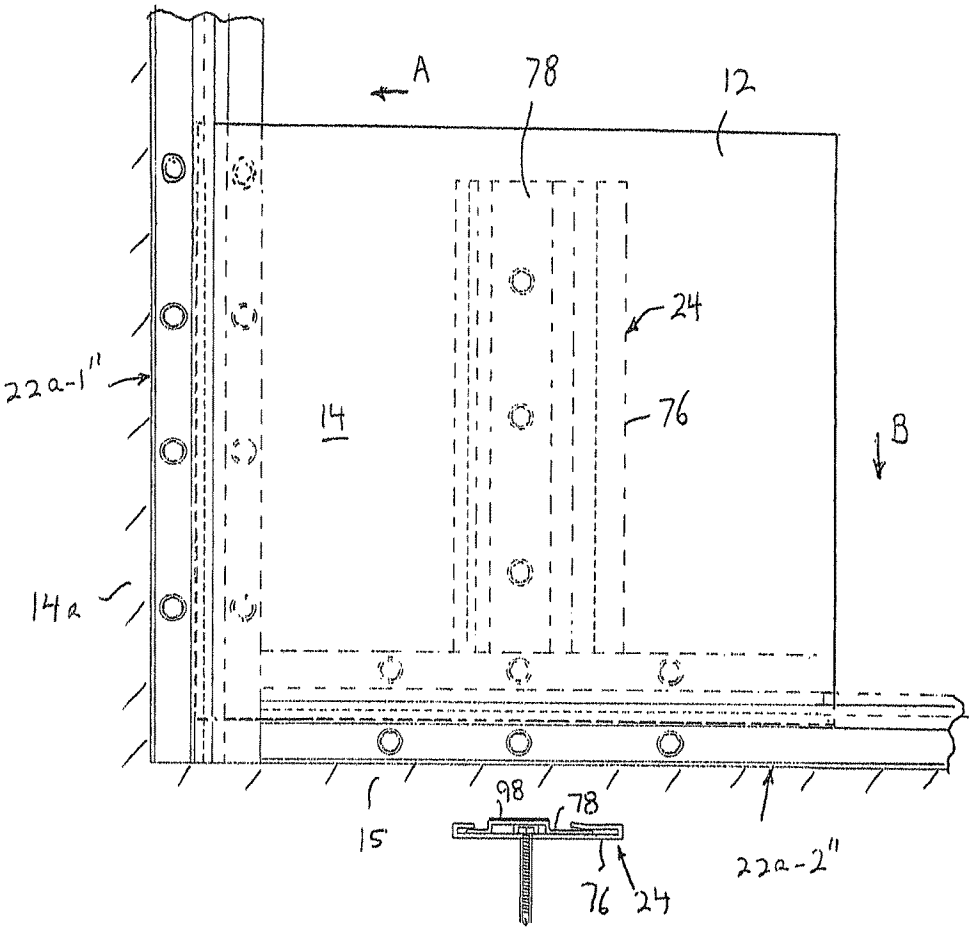
FIG. 43 is a top plan view showing a third final step of the method for easily mounting wall panels over an existing wall using the embodiment of FIGS. 19-25.
FIG. 44 is a cross-sectional view of the structural support assembly of FIG. 43.

Thereafter, wall panel 12 is pushed to the left in the direction of arrow A and down in the direction of arrow B in FIG. 43, so that the left side edge of the wall panel 12 is in abutting relation with the respective bent end retaining wall 52" of first corner fastening extrusion 22*a*-1" and the lower edge of wall panel 12 is in abutting relation with the respective bent end retaining wall 52" of second corner fastening extrusion 22*a*-2". At the same time, sliding support member 78 is moved with wall panel 12 in the direction of arrow A to the left to the position shown in FIG. 44 so that both wings 96*a* and 96*b* are positioned in spaces 92 and also downwardly in the direction of arrow B.

Then, in the manner shown in FIGS. 2 and 4, a main fastening extrusion 20" (FIGS. 20 and 21) has its leftmost retaining wall 32" abutted up against the opposite end of the wall panel 12 such that this opposite free end of wall panel 12 seats on top of arcuate bend 37" and beneath holding section 36". Further, an end edge of this main fastening extrusion 20" is abutted against the free edge 54" of base section 46" of second corner fastening extrusion 22*a*-2". Screws 30 are then used to secure main fastening extrusion 20" to existing wall 14. This locks wall panel 12 tightly in position between first and second corner fastening extrusions 22*a*-1" and 22*a*-2" and main fastening extrusion 20".

Thereafter, the base support 76 of one or more structural support assemblies 24 is secured to existing wall 14 in spaced relation from this main fastening extrusion 20" with an end edge thereof abutted against the free edge 54" of base section 46" of second corner fastening extrusion 22*a*-2".

At the opposite side of the already assembled main fastening extrusion 20", a new wall panel 12 is assembled in the same manner as discussed above with respect to corner fastening extrusion 22*a*-1", with a respective sliding support member 78 secured to this new wall panel 12 being slid over to the left in the direction of arrow A and downward in the direction of arrow B until the left side edge of the new wall panel 12 is in abutting relation with the other bent end retaining wall 32" of the assembled main fastening extrusion 20" and the lower edge of the new wall panel 12 is in abutting relation with the respective bent end retaining wall 52" of second corner fastening extrusion 22*a*-2".

This operation continues until the opposite corner wall 14*a* is reached, as shown in FIG. 19, at which time, a new corner fastening extrusion 22" is assembled therewith.

Then, an elongated main fastening extrusion 20" is assembled on wall 14 with the upper edges of the already assembled wall panels 12, such that the upper edges of the already assembled wall panels 12 are in abutting relation to one retaining wall 32" thereof and captured between the respective arcuate bend 37" and holding section 36". Then, the operation continues, on the opposite upper side of this new main fastening extrusion 20" starting at the left side with corner fastening extrusion 22*a*-1", in the manner discussed above, until the entire existing wall 14 is covered by wall panels 12.

Closure members 60*a*" are then assembled with all main fastening extrusions 20" and corner fastening extrusions 22*a*-1" and 22*a*-2".

As a result, wall panels 12 are securely and tightly held in place without any play between main fastening extrusions 20 and corner fastening extrusions 22, and locked in position.

Of course, it will be appreciated that the wall panels 12 can be removed by a reverse operation to that described above.

Figure 45:
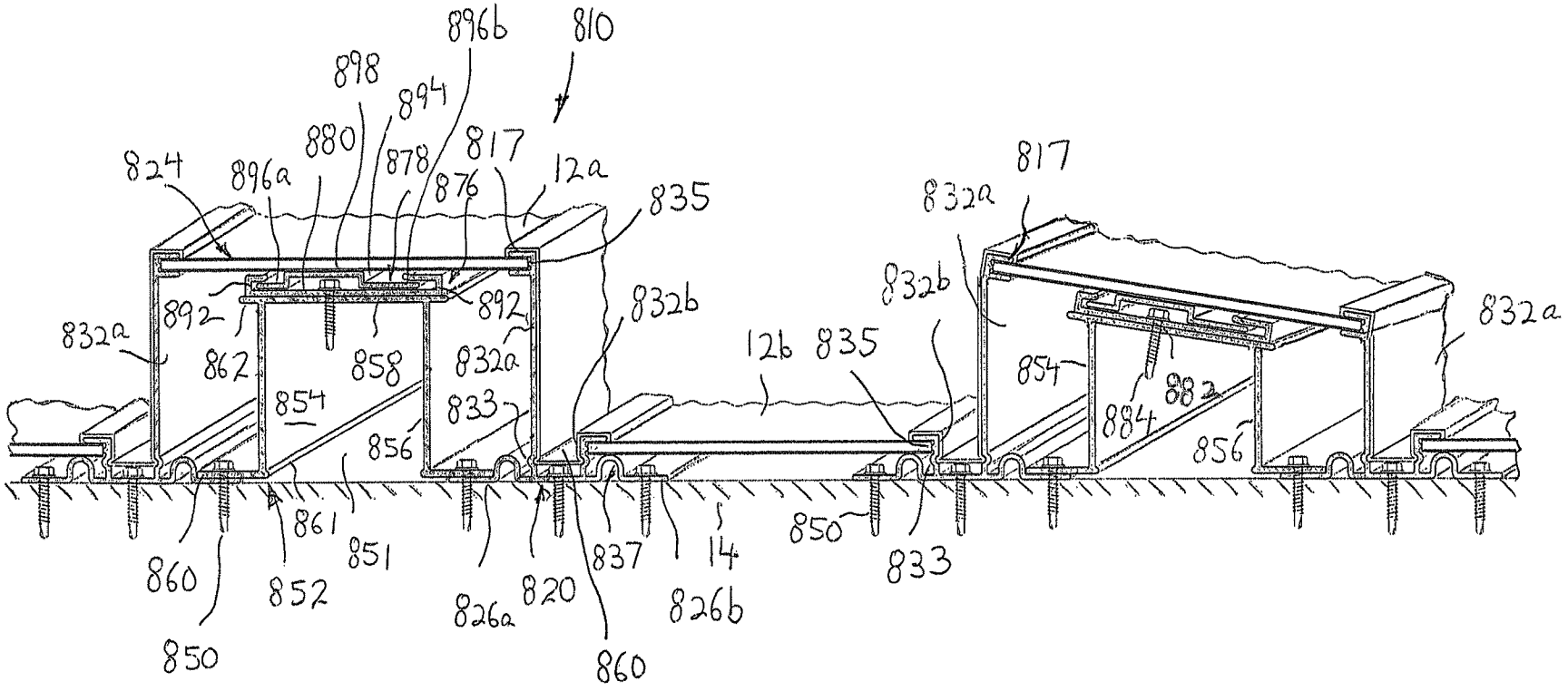
FIG. 45 is a cross-sectional view of another modification of the system for easily mounting wall panels over an existing wall.

Referring now to FIG. 45, there is shown a system 810 which is a modification of the system 10" of FIGS. 19-25, in which like parts are numbered with the same numerals but augmented by 800.

Specifically, system 810 includes main fastening extrusions 820, in which first and second base plate sections 826*a* and 826*b* thereof are each bent in an arcuate shape immediately adjacent the respective retaining wall 832*a* or 832*b* to form arcuate bends 837 that are bent in an arc towards the respective hold down wall 836, in the same manner as described in FIGS. 19-25.

One retaining wall 832*b* of main fastening extrusions 820 is identical to that of retaining wall 32" and is provided with a lower arcuate bend 833 that produces an outward bulge on the outwardly facing surface thereof and a recess on the inwardly facing surface thereof. In addition, retaining wall 832*b* is provided with an upper bulge 835 on the outwardly facing surface thereof immediately above lower arcuate bend 833, and against which the edge of wall panels 12 abut.

Main fastening extrusion 820 differs from main fastening extrusion 20" in that the other retaining wall 832*a*, while including the lower arcuate bend 833, has a height much greater height than retaining wall 832*b*. Further, the upper end of retaining wall 832*a* is provided with an outwardly extending U-shaped holding wall 817 that engages the side edge and top and bottom surfaces of a wall panel 12. In addition, an upper bulge 835 is provided within U-shaped holding wall 817 on the outwardly facing surface thereof and against which the end edge of a wall panel 12 abuts, for the same purpose as upper bulge 35" in FIG. 21.

With the arrangement of FIG. 45, wall panels 12 can be provided at different heights to present an aesthetic three-dimensional effect. In other words, while wall panels 12*a* are raised from existing wall 14, adjacent wall panels 12*b* can be mounted at a lower position, in the same manner as previously shown in FIG. 14.

In order to further support raised wall panels 12*a* and provide a spacing 851 between the wall panels 12 and the existing wall 14, for example, for ventilation, to provide for water run-off, to provide insulation therein, and to provide a thermal barrier, a U-channel furring 852 is connected between existing wall 14 and the wall panels.

Specifically, U-channel furring 852 includes two parallel, spaced apart spacing walls 854 and 856 connected together by a common transverse connection wall 858 at one end of walls 854 and 856, as is known. Also, outwardly extending foot walls 860 are connected to the opposite free ends of spaced apart walls 854 and 856, as is also known. However, in accordance with one aspect of said U.S. patent application Ser. No. 15/047,024, opposing inwardly extending foot walls 861 extend inwardly of walls 854 and 856 in a coplanar arrangement with outwardly extending foot walls 860, and opposite extension walls 862 are formed as a continuation of common transverse wall 858 and extend outwardly of spaced apart walls 854 and 856. In this manner, insulation (not shown) can be positioned in spacing 851 so as to be tightly held between foot walls 860 and extension walls 862 so as to prevent escape thereof, and to keep the insulation properly positioned at all times. Further, the insulation is tightly held between common transverse wall 858 and inwardly extending foot walls 861. This eliminates the need for any additional members to hold the insulation in place, such as screws, adhesives, etc., while also eliminating any extra labor that would result therefrom.

Outwardly extending foot walls 860 sit on top of first base plate section 826*a*, and screws 850, which secure base plate sections 826*a* and 826*b* to existing wall 14, also secure foot walls 860 to base plate sections 826*a* and existing wall 14. However, foot walls 860 can be positioned inside of first base plate sections 826*a*.

Elongated base plate 880 of base support 876 of elongated intermediary structural support assembly 824, which is identical to intermediary structural support assembly 24, sits on top of common transverse wall 858 and includes openings 882 therein through which screws 884 extend to secure base plate 880 to common transverse wall 858. Spaces 892 are provided at opposite sides of base support 876 in the same manner as previously discussed. Further, a sliding support member 878, which is identical to sliding support member 78, slidably fits within elongated base plate 880 in the same manner as previously discussed in relation to intermediary structural support assembly 24, and includes an adhesive member 898, which can be a double sided tape, an adhesive or any other securing means, secured on top of inverted U-shaped plate 894 of sliding support member 878, for securement of wall panel 12 thereon. Wing plates 896*a* and 896*b* are provided at opposite sides of inverted U-shaped plate 894 in the same manner as described above.

With the above arrangement, in order to assemble wall panels 12 in covering relation to existing wall 14, main fastening extrusions 820 and U-channel furrings 852 are secured to existing wall 14 as shown in FIG. 45, with the higher retaining walls 832*a* of adjacent fastening extrusions 820 positioned in parallel, spaced relation to the outside of spacing walls 854 and 856 of each U-channel furring 852. The height of retaining walls 832*a* is slightly greater than the height of spacing walls 854 and 856. Then, first wall panels 12*a* are secured on top of inverted U-shaped plate 894 of sliding support member 878 by an adhesive member 898. The side edges of panel 12*a* are then slid into U-shaped holding walls 817 of adjacent main fastening extrusions 820, while wing plates 896*a* and 896*b* are slid into spaces 892 of base support 876, whereby a center section of panel 12*a* is stably supported on top of common transverse connection wall 858 of U-channel furring 852.

Further, it will be appreciated that spacing walls 854 and 856 of a U-channel furrings 852 can have different heights, as shown at the right side of FIG. 45, for example, where spacing wall 854 is higher than spacing wall 856. In this regard, the height of retaining wall 832*a* of the main fastening extrusion 820 adjacent spacing wall 854 would be greater than the height of retaining wall 832*a* of the main fastening extrusion 820 adjacent spacing wall 856. Of course, outwardly extending U-shaped holding walls 817 would have to be angled slightly. This imparts a further three-dimensional inclined or slanted appearance to the wall panels 12.

Thereafter, a closure member 860 which is identical to closure member 60*b*" is provided, except that one side of closure member 860 is higher than the other side to accommodate the greater height retaining wall 832*a*, and the upper ends of closure member 860 wrap around and snap over and onto U-shaped holding walls 817. Closure member 860 is made of any suitable thin material such as aluminum. As a result, the gap between retaining walls 832*a* and 832*b* is covered.

Figure 46:
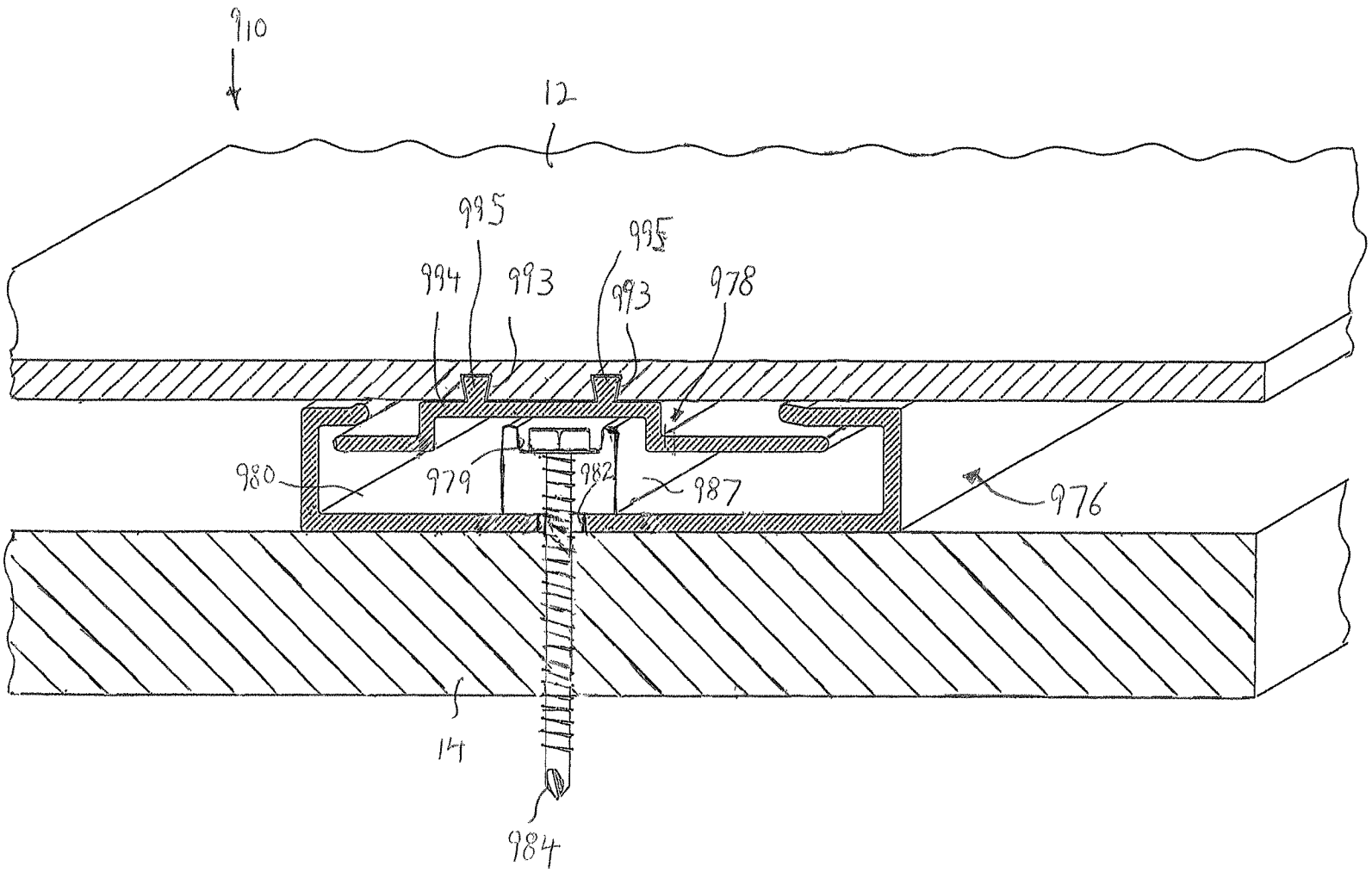
FIG. 46 is a cross-sectional view of still another modification of the system for easily mounting wall panels over an existing wall.

Referring now to FIG. 46, there is shown a system 910 which is a modification of the system 10 of FIGS. 1-4, in which like parts are numbered with the same numerals but augmented by 900. The differences in system 910 are as follows.

First, rather than using an adhesive member on top of inverted U-shaped plate 994 of sliding support member 978, for securement of wall panel 12 thereon, the lower surface of wall panel 12 includes two spaced apart, parallel extending elongated dovetail shaped grooves 993 that receive two complementary spaced apart, parallel extending elongated dovetail shaped projections 995 extending from the upper surface of inverted U-shaped plate 994 of sliding support member 978.

Second, in order to increase the thermal barrier between the existing wall 14 and the wall panels 12, a non-thermal conducting or insulating, elongated spacer block 987 is provided between inverted U-shaped plate 994 of sliding support member 978 and elongated base plate 980 of base support 976, preferably at the center thereof, and on which inverted U-shaped plate 994 of sliding support member 978 is slidably supported. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like. It will be appreciated that the placement of elongated spacer block 987 and the positioning of inverted U-shaped plate 994 thereon, permits full sliding movement of inverted U-shaped plate 994 relative to base support 976. In this regard, the upper surface of elongated spacer block 987 is provided with an elongated recess 979 for receiving the heads of screws 984 so that the heads of screws 984 do not extend higher than elongated spacer block 987.

Third, openings 982 in elongated base plate 980 of base support 976 through which screws 984 extend to secure base plate 980 to existing wall 14, have a diameter which is much greater than the diameter of screws 984 so that screws 984 are not in contact with base support 976, and therefore, do not provide any thermal conduction to existing wall 14.

Figure 50:
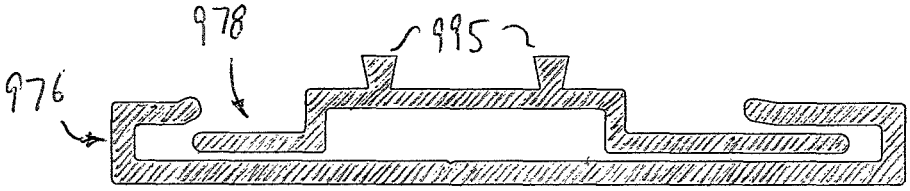
FIG. 50 is a cross-sectional view of yet another modification of the system of FIG. 1.

It will be appreciated that system 910 can be used without elongated spacer block 987, as shown in FIG. 50.

Figure 47:
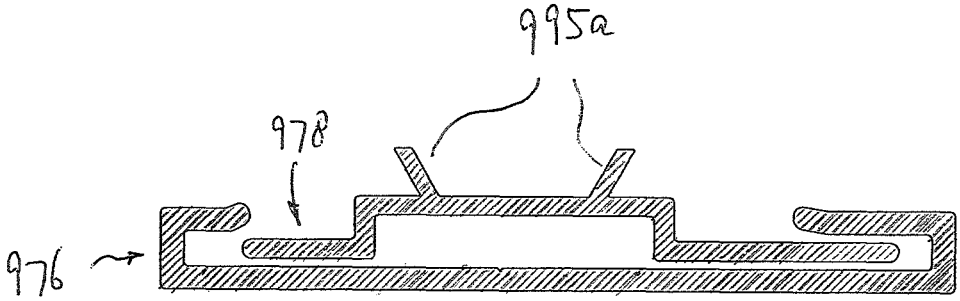
FIG. 47 is a cross-sectional view of a modification of the system of FIG. 1.
Figure 48:
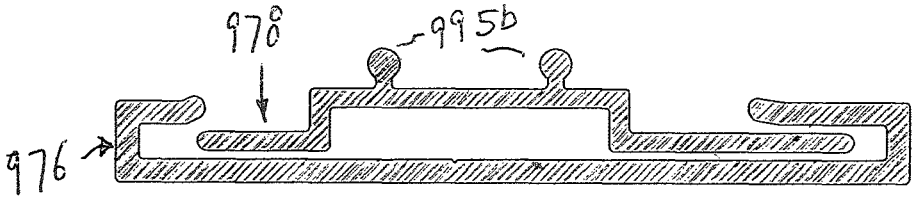
FIG. 48 is a cross-sectional view of another modification of the system of FIG. 1.
Figure 49:
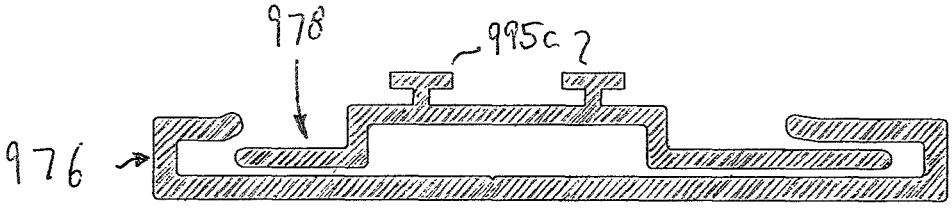
FIG. 49 is a cross-sectional view of still another modification of the system of FIG. 1.
Figure 51:
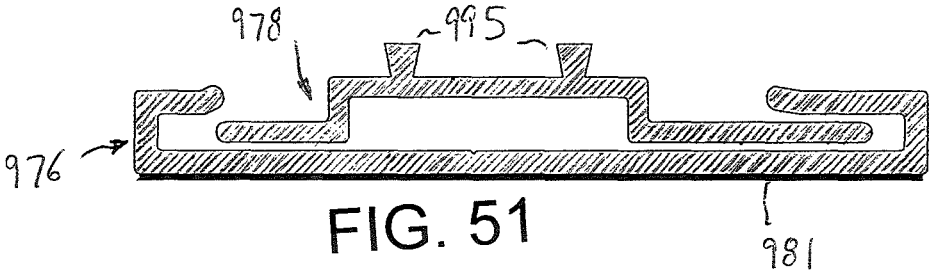
FIG. 51 is a cross-sectional view of a further modification of the system of FIG. 1.

Further, FIGS. 47-49 show modifications of the projections extending from the upper surface of inverted U-shaped plate 994 of sliding support member 978 of FIG. 50. Specifically, in place of the dovetail shaped projections 995 of FIG. 50, such projections can have any other suitable shape such as elongated diverging planar wall projections 995*a* shown in FIG. 47, elongated bulbous projections 995*b* shown in FIG. 48, elongated projections 995*c* having T-shaped cross-sections shown in FIG. 49, or any other suitable shaped projection. In addition, a double sided tape 981 can be provided at the underside of elongated base plate 980 of base support 976, as shown in FIG. 51.

In the embodiments of FIGS. 46-51, it will be appreciated that the projections and recesses can be reversed such that the projections extend from wall panel 12 and the recesses are provided in inverted U-shaped plate 994.

Figure 52:
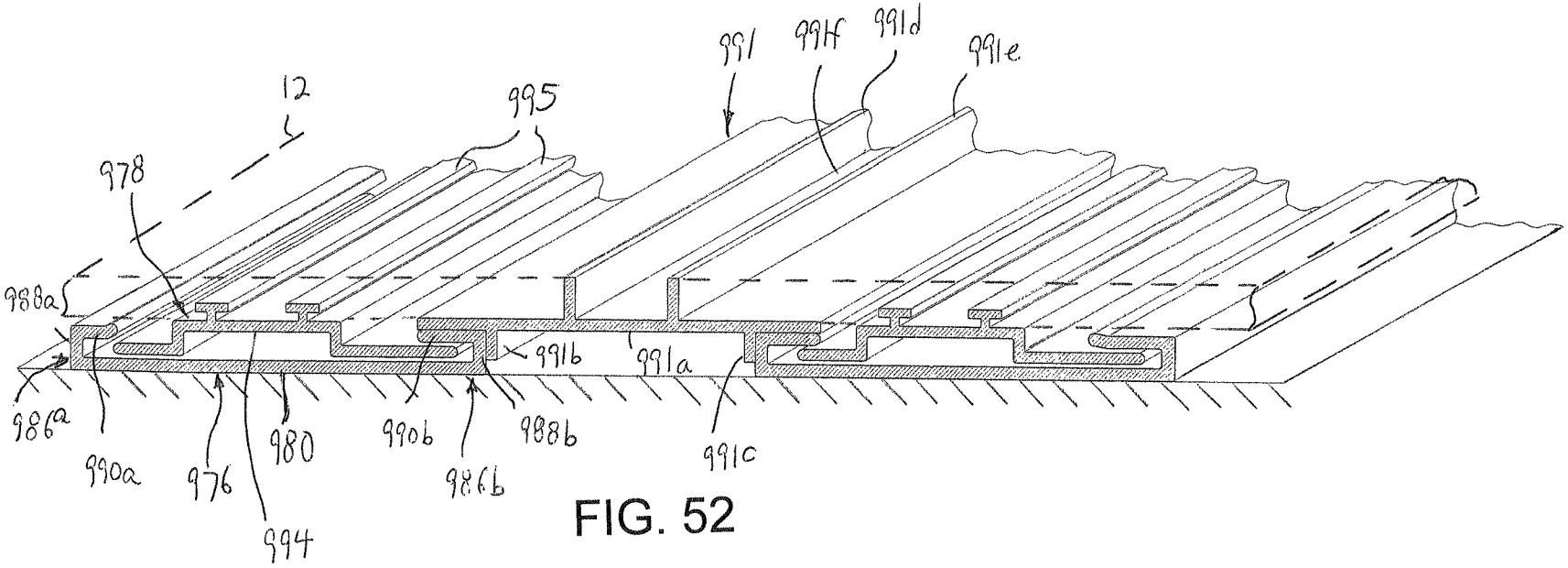
FIG. 52 is a cross-sectional view of another modification of the system for easily mounting wall panels over an existing wall.

Referring now to FIG. 52, there is shown a modification of the arrangement of FIG. 49 in which there is a stiffener element 991 which fixes the distance between adjacent base supports 976 and which provides further support for wall panels 12. Specifically, stiffener element 991 includes a stiffener plate 991*a* having parallel, spaced apart separation walls 991*b* and 991*c* extending downwardly from the underside of stiffener plate 991*a* and against which first walls 988*a* and 988*b* of L-shaped retaining walls 986*a* and 986*b* abut, with ends of stiffener plate 991*a* resting on top of inwardly extending second walls 990*a* and 990*b* of L-shaped retaining walls 986*a* and 986*b*. Stiffener element 991 also includes parallel, spaced apart limit walls 991*d* and 991*e* at a center portion thereof, with limit walls 991*d* and 991*e* being parallel to separation walls 991*b* and 991*c*. In this manner, the ends of wall panels 12 seat upon stiffener plate 991*a* and abut against limit walls 991*d* and 991*e*. The space between limit walls 991*d* and 991*e* can be left vacant, or can be closed by a plug or the like.

It will be appreciated that thermal break insulation members can be provided in association with the various elements discussed above in order to provide thermal insulation between wall panels 12 and existing wall 14 so as not to undesirably transfer heat and cold from the outside to existing wall 14. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

Figure 53:
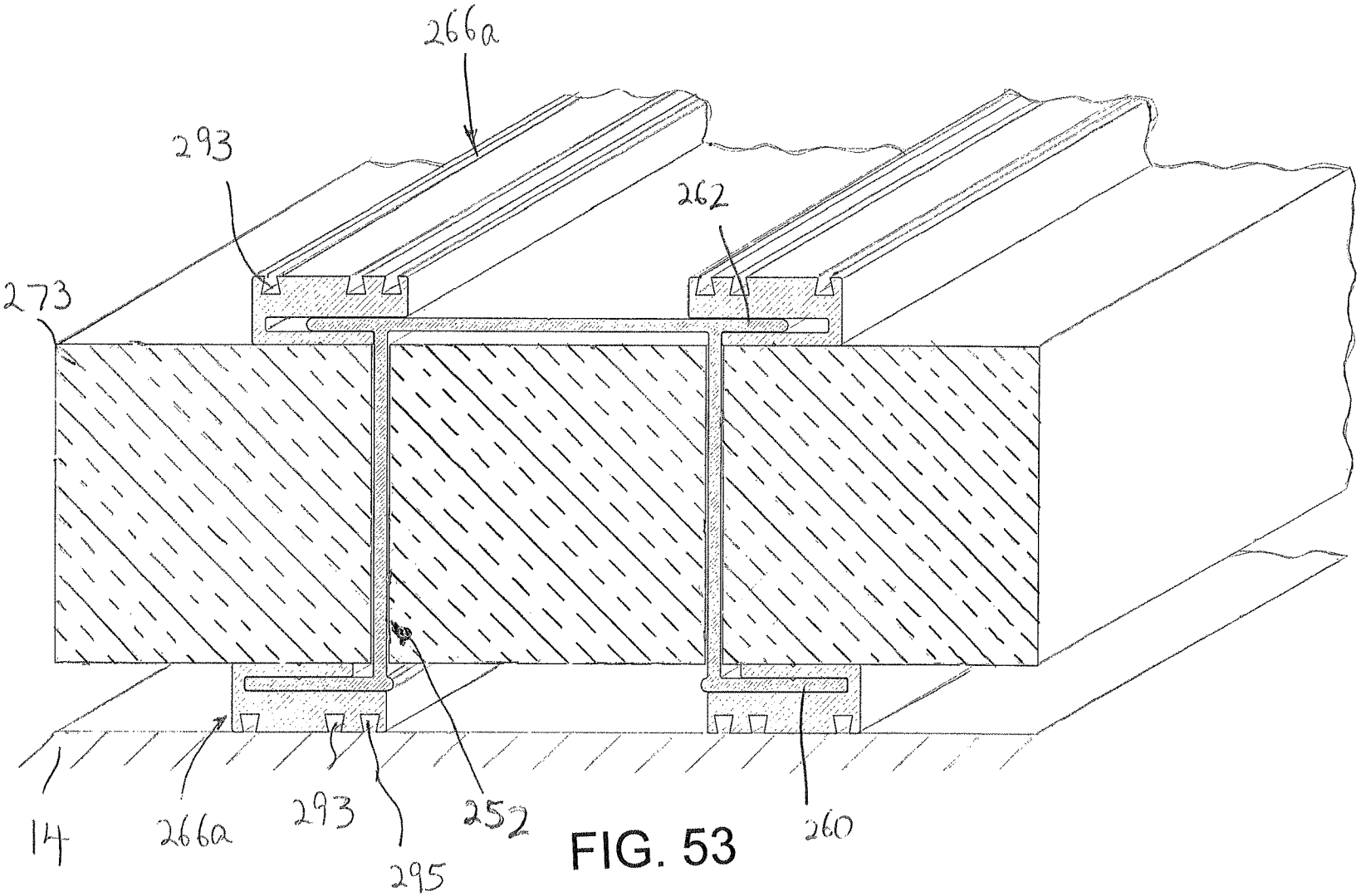
FIG. 53 is a cross-sectional view of another modification of the system for easily mounting wall panels over an existing wall.

Thus, referring first to FIG. 53, J-shaped thermal insulation covers 266*a* can be provided, which are similar to J-shaped thermal insulation covers 266 of FIG. 30, the difference being that the lowest surfaces thereof are provided with elongated dovetail openings 293, can be provided over outwardly extending put walls 260, so as to sit on top of existing wall 14 to provide air and liquid channels therein or engage with corresponding elongated dovetail projections (not shown) in existing wall 14 or with further spacer elements. In like manner, the same J-shaped thermal insulation covers 266*a* can be inserted over opposite extension walls 262 of U-channel furring 252 such that the elongated dovetail openings 293 face outwardly for receiving dovetail projections 290 of thermal break attachment 274 (FIG. 30), for receiving dovetail projections (not shown) in elongated base plate 80 of a base support 76, or for directly receiving elongated dovetail projections in wall panels 12, that is a reversal apart from that shown by dovetail projections 995 in FIG. 46.

Figure 54:
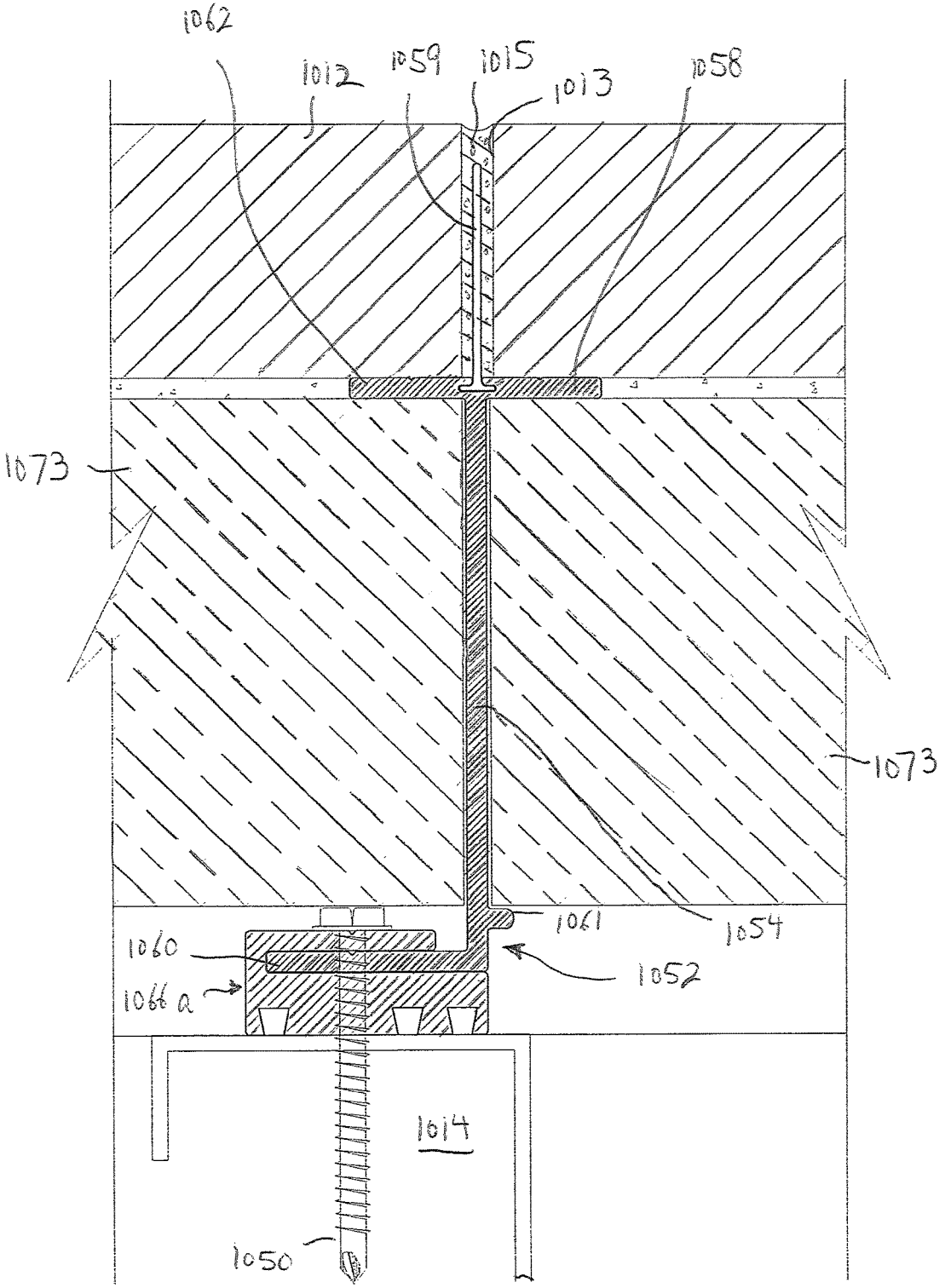
FIG. 54 is a cross-sectional view of another modification of the system for easily mounting wall panels over an existing wall.

As shown in FIG. 54, a similar arrangement can be provided with Z-furring 1052, which is similar to Z-furring 352 of FIG. 31. Z-furring 1052 includes a single spacing wall 1054, with a transverse connection wall 1058 at an outer end thereof and extending to the right side of spacing wall 1054, and an extension wall 1062 formed as a continuation of transverse wall 1058 and extending to the opposite left side of spacing wall 1054. An outwardly extending transverse foot wall 1060 extends from the opposite end of spacing wall 1054 to the left side of spacing wall 1054, and an inwardly extending transverse stub foot wall 1061 is also connected to the opposite free end of spacing wall 1054, and extends to the right side of spacing wall 1054 in FIG. 54. In this manner, insulation 1073 is tightly held between foot wall 1060 and extension wall 1062 so as to prevent escape thereof, and to keep insulation properly positioned at all times. Further, insulation is tightly held between transverse wall 1058 and inwardly extending stub foot wall 1061. This eliminates the need for any additional members to hold the insulation in place, such as screws, adhesives, etc., while also eliminating any extra labor that would result therefrom.

A J-shaped thermal insulation cover 1066*a* can be provided around foot wall 1060, and which is the same as J-shaped thermal insulation cover 266*a* of FIG. 53. Screws 1050 extend through J-shaped thermal insulation cover 266*a* and foot wall 1060, into an existing wall 1014.

A rod 1059 extends upwardly from the outer end of Z-furring 1052. A panel, bricks or the like 1012 is positioned over transverse connection wall 1058 and extension wall 1062, as well as over insulation 1073, with rod 1059 extending through an opening 1013 in panel, bricks or the like 1012, and a cement or adhesive 1015 provided in opening 1013 in order to secure panel, bricks or the like 1012 thereat.

Figures 55, 55A:
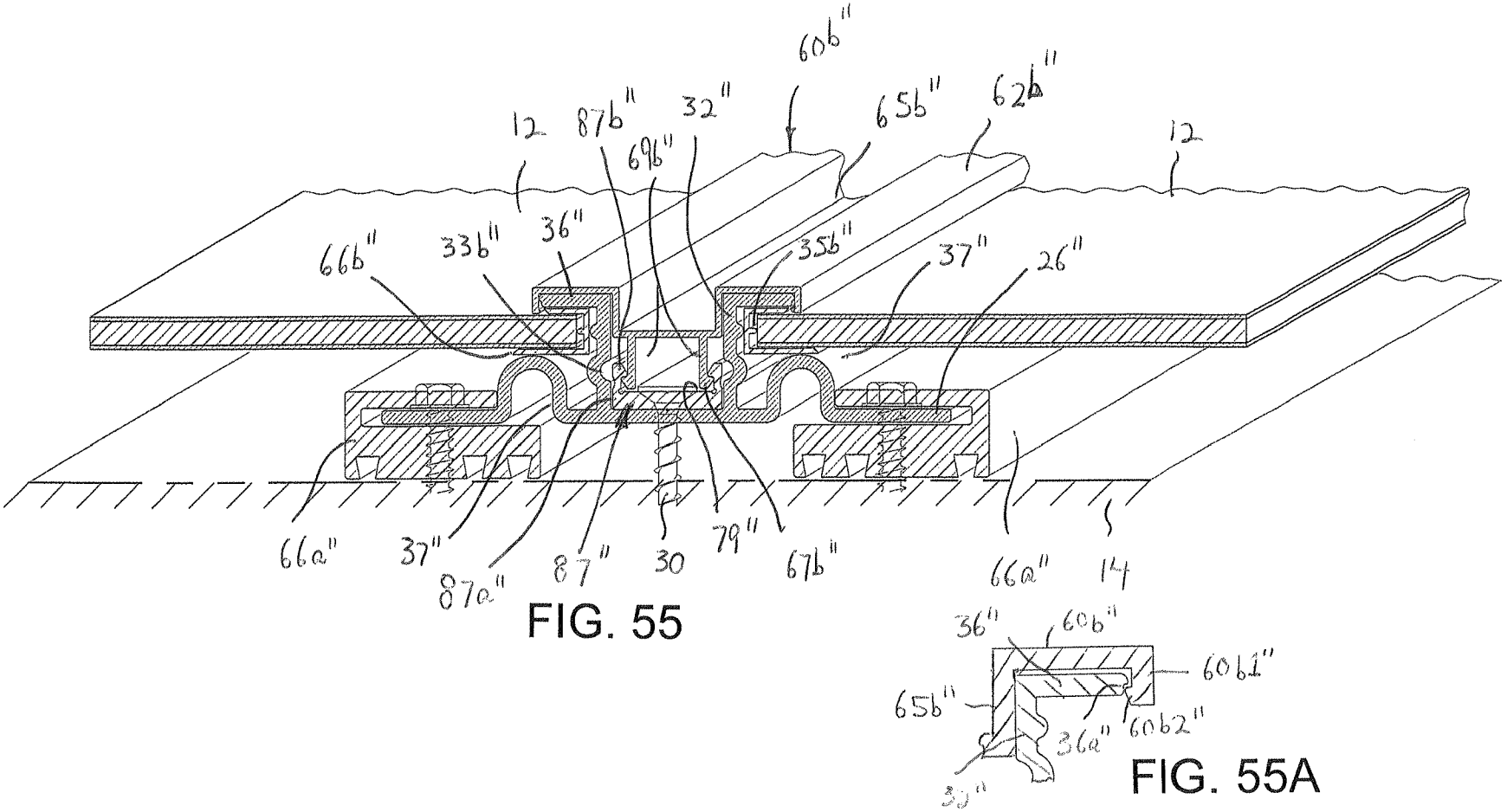
FIG. 55 is a cross-sectional view of a modification of the system of FIG. 19.
FIG. 55A is an enlarged cross-sectional view of a portion of FIG. 55.

FIG. 55 shows an arrangement similar to that of FIGS. 19-21, but in which J-shaped thermal insulation covers 66*a*" are provided in covering relation to base section 26" extending to the outside of arcuate bends 37". Screws 30 extend through J-shaped thermal insulation covers 66*a*" as well as through base section 26". Preferably, the inner ends of downturned walls 60*b*1" of closure member 60*b*", as best shown in FIG. 55A, have inwardly directed tabs or beads 60*b*2" that engage within cut-away recesses 36*a*" at the free ends of enlarged holding section 36".

In addition, an elongated spacer block 87" is provided on top of base section 26" between retaining walls 32". Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like. The upper surface of elongated spacer block 87" is provided with spaced apart openings 79" for receiving the heads of screws 30 so that the heads of screws 30 do not extend higher than elongated spacer block 87". The outwardly extending side walls 87*a*" of elongated spacer block 87" on opposite sides of openings 79" are provided with inwardly turned catches 87*b*" at the upper ends thereof.

A closure member 60*b*" is provided in the gap between retaining walls 32", and like closure member 60*a*", includes a U-shaped center section 65*b*" and L-shaped cover walls 62*b*". However, in addition, closure member 60*b*" also includes two parallel, spaced apart walls 69*b*" extending from the underside of U-shaped center section 65*b*", with the lower ends of walls 69*b*" including outwardly extending tabs 67*b*" for engaging with catches 87*b*". With this arrangement, when closure member 60*b*" is snapped into position, tabs 67*b*" force catches 87*b*" outwardly. Because catches 87*b*"

are positioned adjacent recesses 33*b*", this enables catches 87*b*" to be biased outwardly into recesses 33*b*", whereupon they snap back to their original position once tabs 67*b*" pass catches 87*b*".

In addition, thin walled J-shaped thermal insulation covers 66*b*" are provided in surrounding relation to the ends of wall panels 12, and fit with the ends of wall panels 12 into the space between holding sections 36" and arcuate bends 37". The inner surfaces of thin walled J-shaped thermal insulation covers 66*b*" against which the end edges of wall panels 12 abut, each include an elongated bead 35*b*" that serves the same function as upper bulge 35" in FIGS. 19-21.

Figure 56:
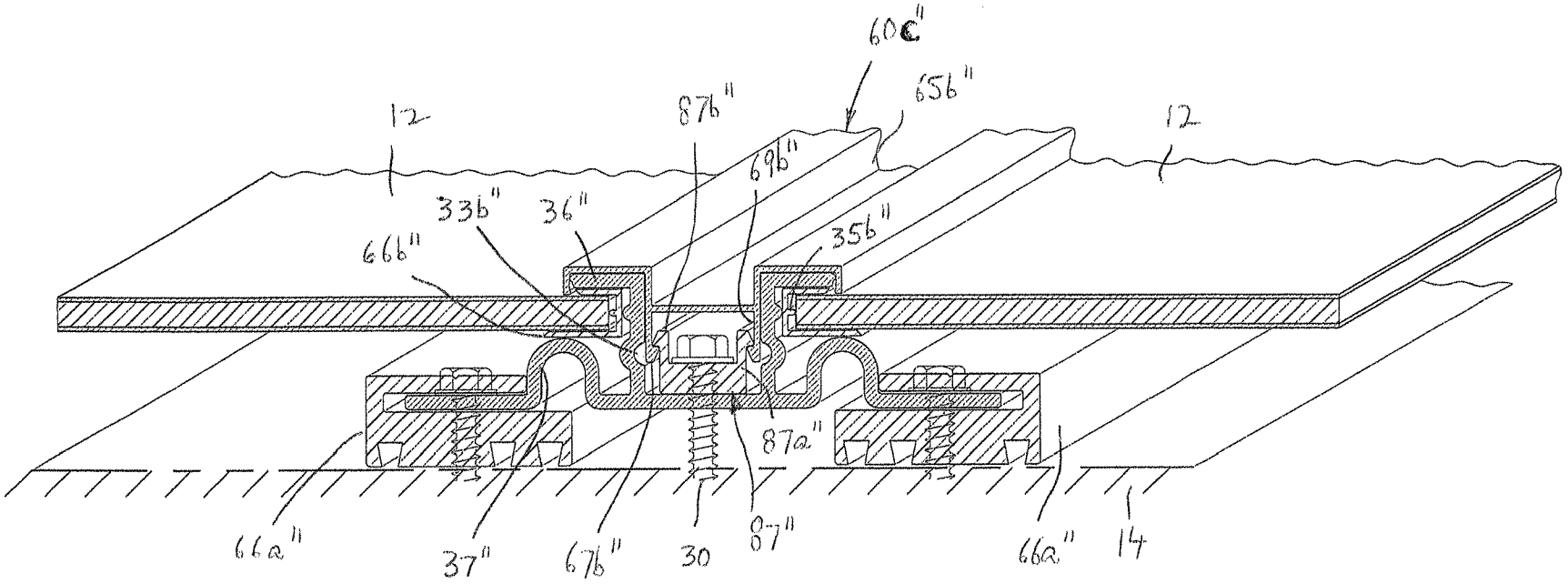
FIG. 56 is a cross-sectional view of another modification of the system of FIG. 19.

FIG. 56 shows a closure member 60*c*" which is similar to closure member 60*b*" of FIG. 55, but with the difference being that spaced apart walls 69*b*" extend to the outside of side walls 87*a*" of elongated spacer block 87", with catches 87*b*" outwardly extending and tabs 67*b*" inwardly extending. In this manner, tabs 67*b*" are biased outwardly into recesses 33*b*" by catches 87*b*". In other words, it is a reversal of parts from the arrangement of FIG. 55.

Figure 57:
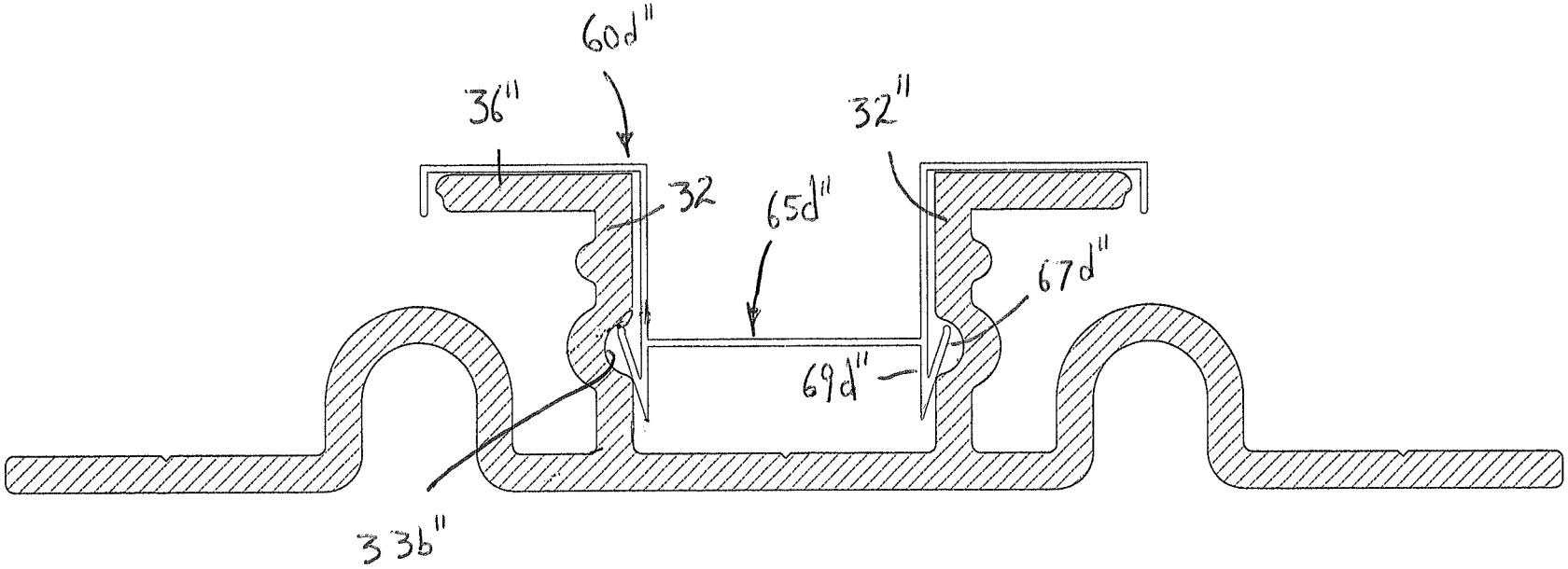
FIG. 57 is a cross-sectional view of still another modification of the system of FIG. 19.

FIG. 57 shows a closure member 60*d*" which is a modification of closure member 60*a*". Specifically, tabs 67*b*" are replaced by outwardly extending, flexible catch walls 67*d*" connected at their lower ends to lower ends of spaced apart walls 69*d*". When U-shaped center section 65*c*" and apart walls 69*d*" are inserted into the space between retaining walls 32", flexible catch walls 67*d*" are bent back against spaced apart walls 69*d*" until the upper free ends of flexible catch walls 67*d*" pass recesses 33*b*", whereupon flexible catch walls 67*d*" spring outwardly back to their original positions such that the upper free ends of flexible catch walls 67*d*" are captured within recesses 33*b*" to lock closure member 60*d*" in position, with L-shaped cover walls 62*d*" in covering relation to hold down walls 36".

Figure 58:
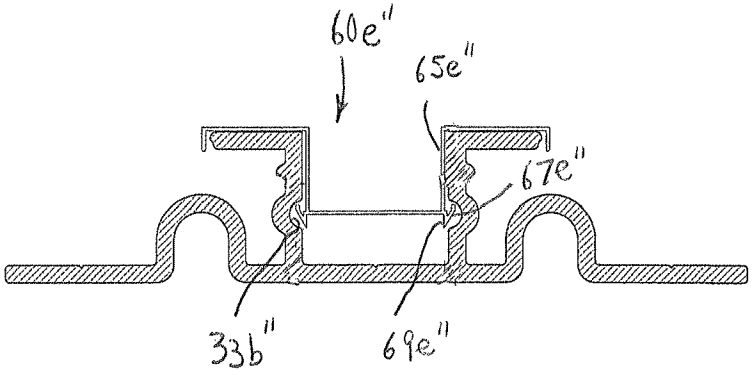
FIG. 58 is a cross-sectional view of yet another modification of the system of FIG. 19.

FIG. 58 shows a closure member 60*e*" which is a modification of closure member 60*d*". Specifically, spaced apart walls 69*e*" are of a much smaller length than spaced apart walls 69*d*", and therefore do not extend down below recesses 33*b*". Flexible catch walls 67*e*" are also of a much smaller length than flexible catch walls 67*d*".

Figure 59:
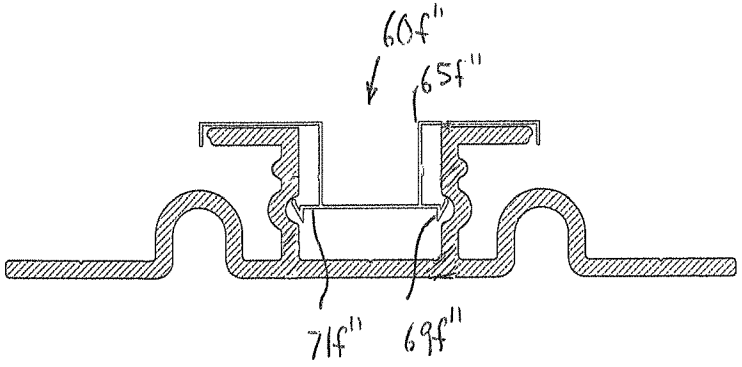
FIG. 59 is a cross-sectional view of a further modification of the system of FIG. 19.

FIG. 59 shows a closure member 60*f*" which is a modification of closure member 60*e*". Specifically, spaced apart side walls of U-shaped center section 65*f*" are spaced closer together than the corresponding spaced apart side walls of U-shaped center section 65*e*" of closure member 60*e*", and spaced apart walls 69*f*" are connected to the lower ends of the side walls of U-shaped center section 65*f*" by transverse walls 71*f*".

Figure 60:
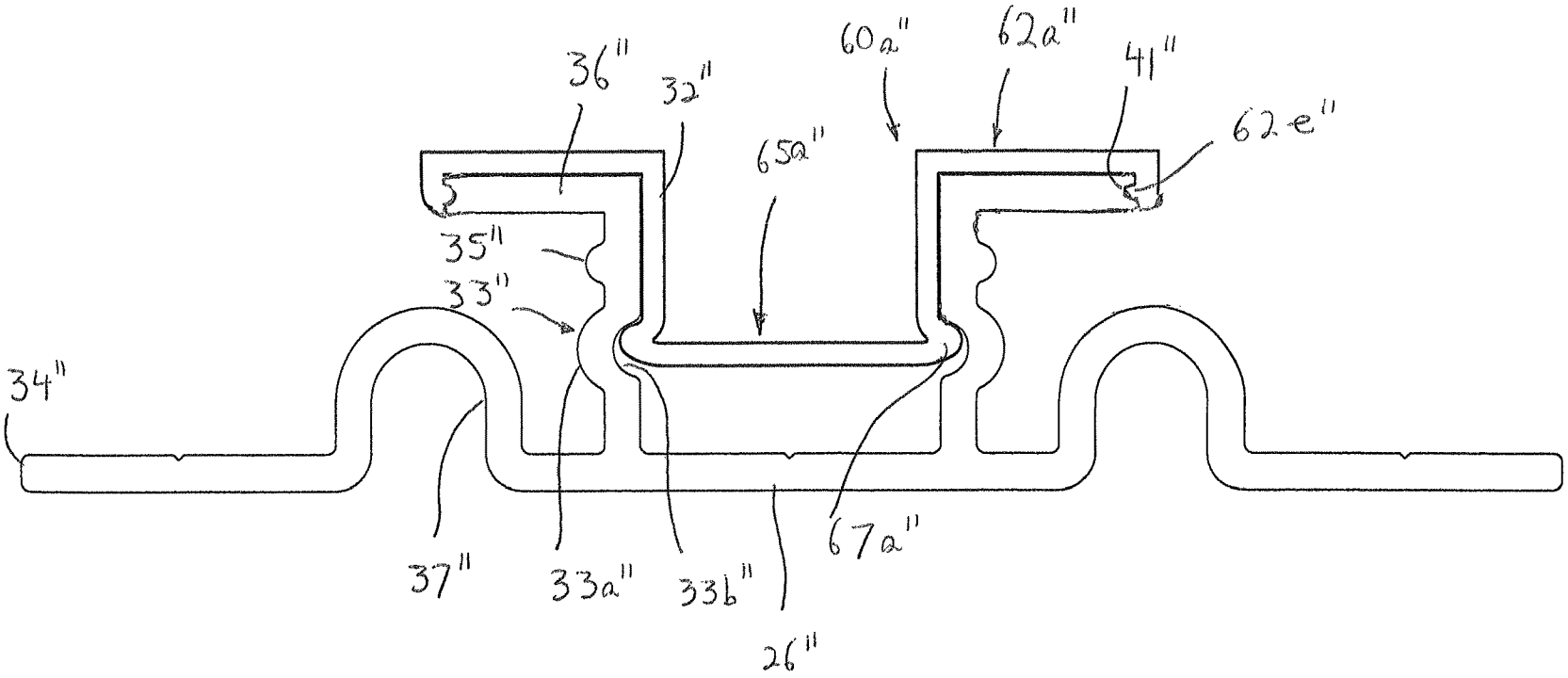
FIG. 60 is a cross-sectional view of a still further modification of the system of FIG. 19.

Referring now to FIG. 60, there is shown a modification of closure member 60*a*" of FIG. 19 in which the ends of L-shaped cover walls 62*a*" are provided with inwardly directed beads 62*e*" which snap into and engage within elongated recesses 41" in end edges of enlarged holding sections 36". In such case, tabs 67*a*" can be eliminated.

Figure 61:
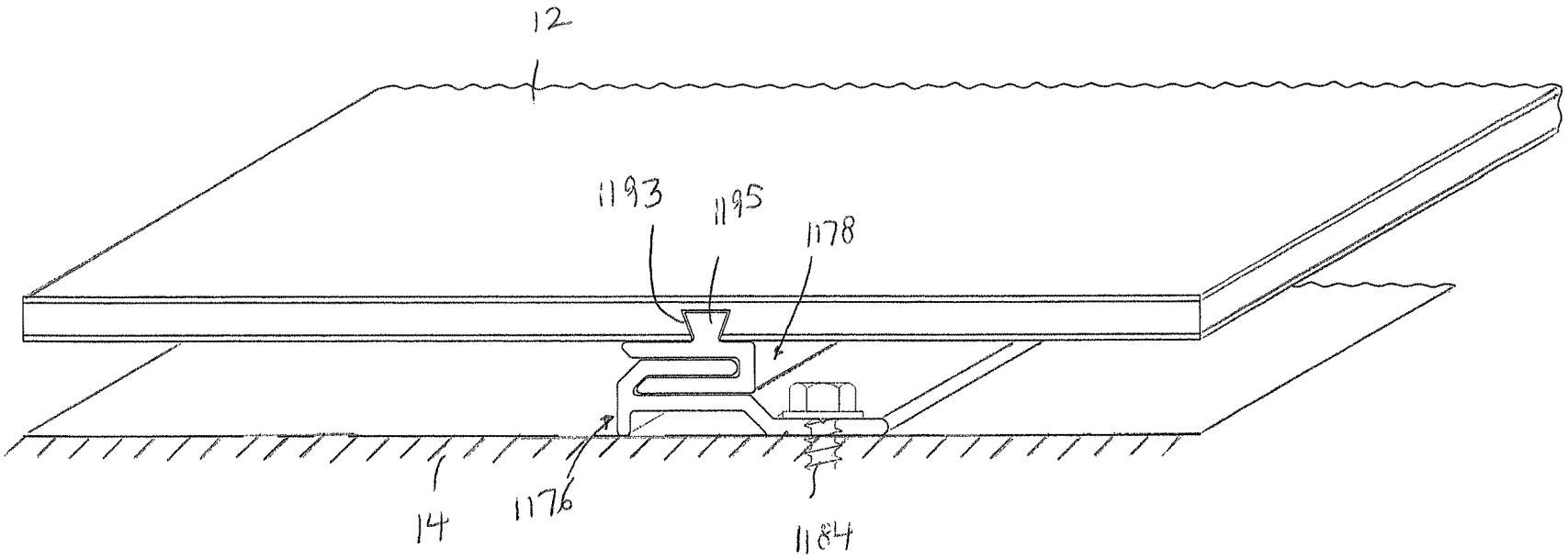
FIG. 61 is a perspective view of another modification of the system for easily mounting wall panels over an existing wall.
Figure 62:
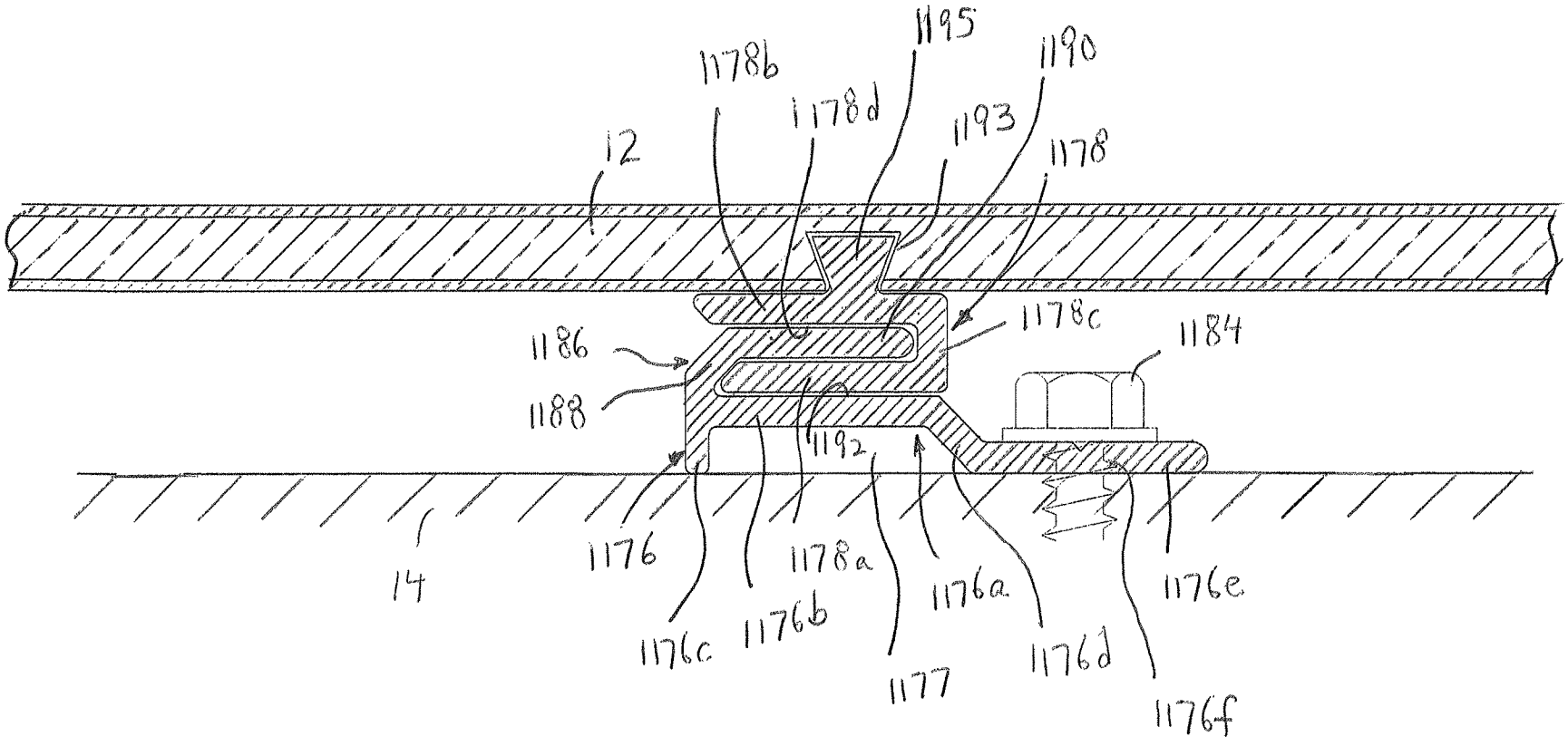
FIG. 62 is a cross-sectional view of the system of FIG. 61.

Referring now to FIGS. 61 and 62, there is shown a further embodiment for attaching wall panels 12 to existing wall 14. Specifically, wall panels 12 are provided with elongated dovetail shaped grooves 1193, similar to dovetail shaped grooves 993.

Elongated, generally U-shaped sliding support members 1178 are provided, each including two spaced apart, parallel walls 1178*a* and 1178*b* which are connected at common edges thereof to a connecting plate 1178*c* so as to define an open area 1178*d* therebetween, which is accessible from the opposite ends of walls 1178*a* and 1178*b*. An elongated dovetail shaped projection 1195 is formed at the outer surface of wall 1178*b*, and is received within a corresponding dovetail shaped groove 1193 in order to secure wall panels 12 to sliding support members 1178.

A base support 1176 is secured to existing wall 14 by screws 1184. Specifically, base support 1176 includes an elongated trapezoidal shaped base section 1176*a* formed by a first elongated wall 1176*b* positioned in parallel, spaced relation to existing wall 14 with a space 1177 therebetween, a first elongated supporting wall 1176*c* extending from one side of elongated wall 1176*b* into contact with existing wall 14, and a second elongated supporting wall 1176*d* extending at an outward angle from the opposite side of first elongated wall 1176*b* into contact with existing wall 14. An elongated tail wall 1176*e* is connected with the free edge of second elongated supporting wall 1176*d* and extends away from trapezoidal shaped base section 1176*a*, so as to be in flush contact with existing wall 14. Tail wall 1176*e* has a plurality of spaced apart openings 1176*f* therein through which screws 1184 can extend into existing wall 14 in order to secure base support 1176 thereto.

Base support 1176 further includes a generally L-shaped retaining wall 1186. Specifically, L-shaped retaining wall 1186 includes a first elongated wall 1188 that extends at an angle of about 45° from the upper and of first elongated supporting wall 1176*b* and an inwardly extending elongated second wall 1190 connected to the free end of first elongated wall 1188 such that elongated second wall 1190 is positioned above first elongated wall 1176*b* in parallel, spaced apart relation so as to define an open area 1192 therebetween.

In this manner, with a sliding support member 1178 connected by the dovetail connection to a wall panel 12, wall 1178*a* is inserted within open area 1192 so as to be captured therein. In such condition, inwardly extending elongated second wall 1190 extends into open area 1178*d*. Thereafter, the next wall panel 12 is assembled in the same manner adjacent to the previous wall panel 12, with abutting edges thereof so that the second wall panel 12 locks the first wall panel 12 into the position shown. Alternatively, the arrangement of FIGS. 1 and 19 can be used to lock the opposite and of the wall panel.

It will be appreciated that base support 1176 can be made of a thermally insulating material of the type previously discussed in order to thermally insulate existing wall 14 with respect to wall panels 12. Alternatively, base support 1176 can be made of any other suitable material, such as aluminum or the like.

Figure 63:
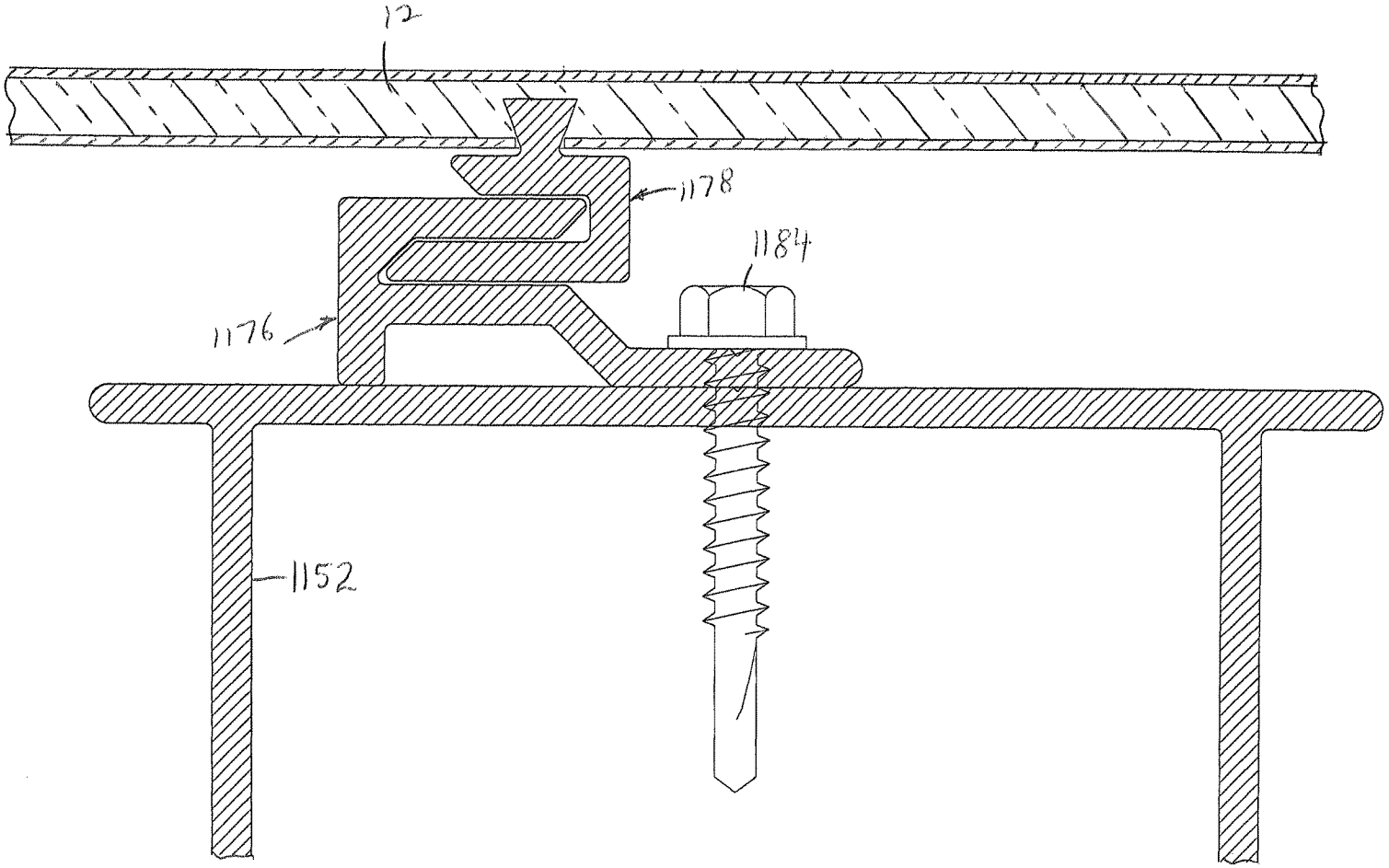
FIG. 63 is a cross-sectional view of a modification of the system of FIG. 61.
Figure 64:
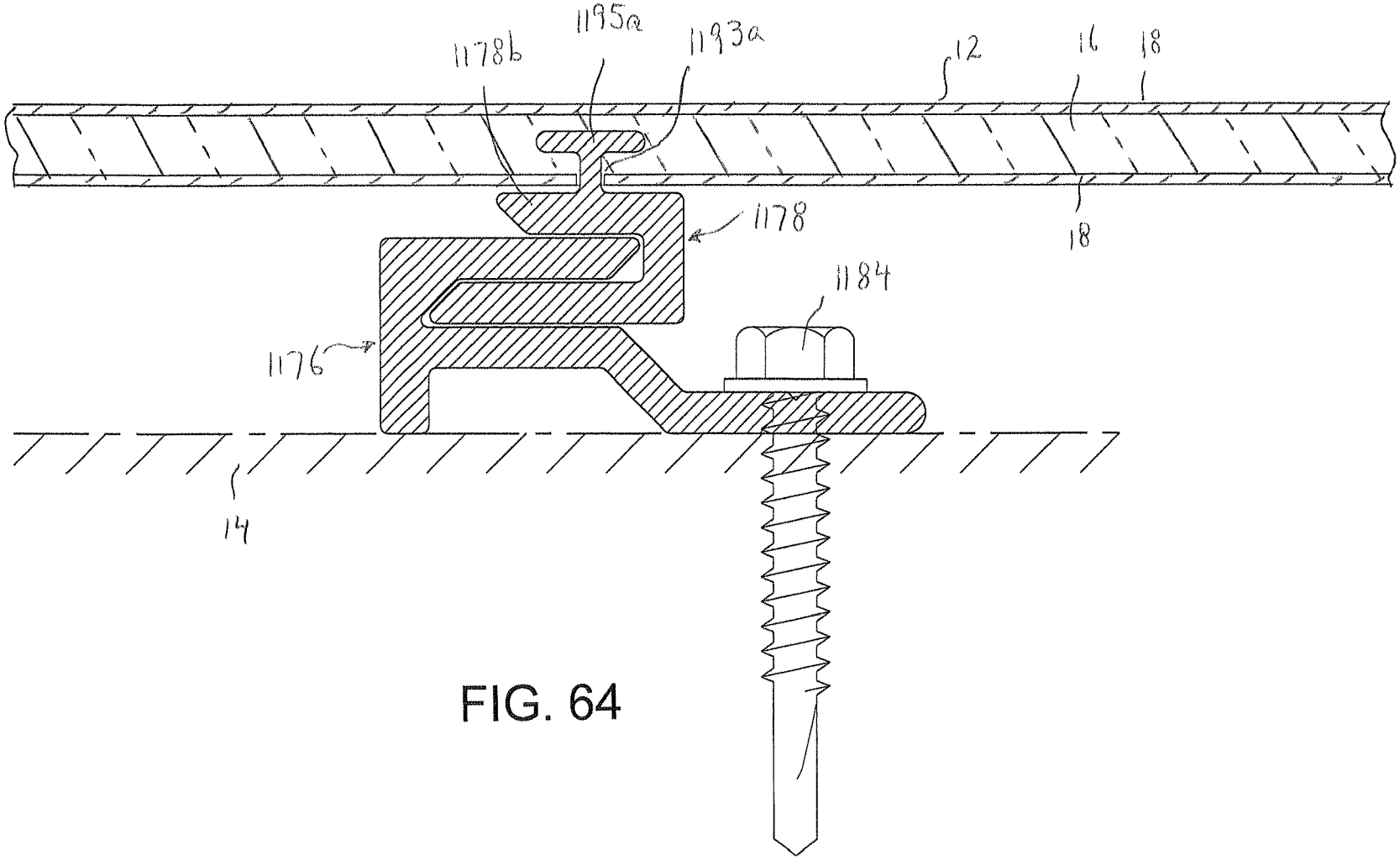
FIG. 64 is a cross-sectional view of a modification of the system of FIG. 61.
Figure 65:
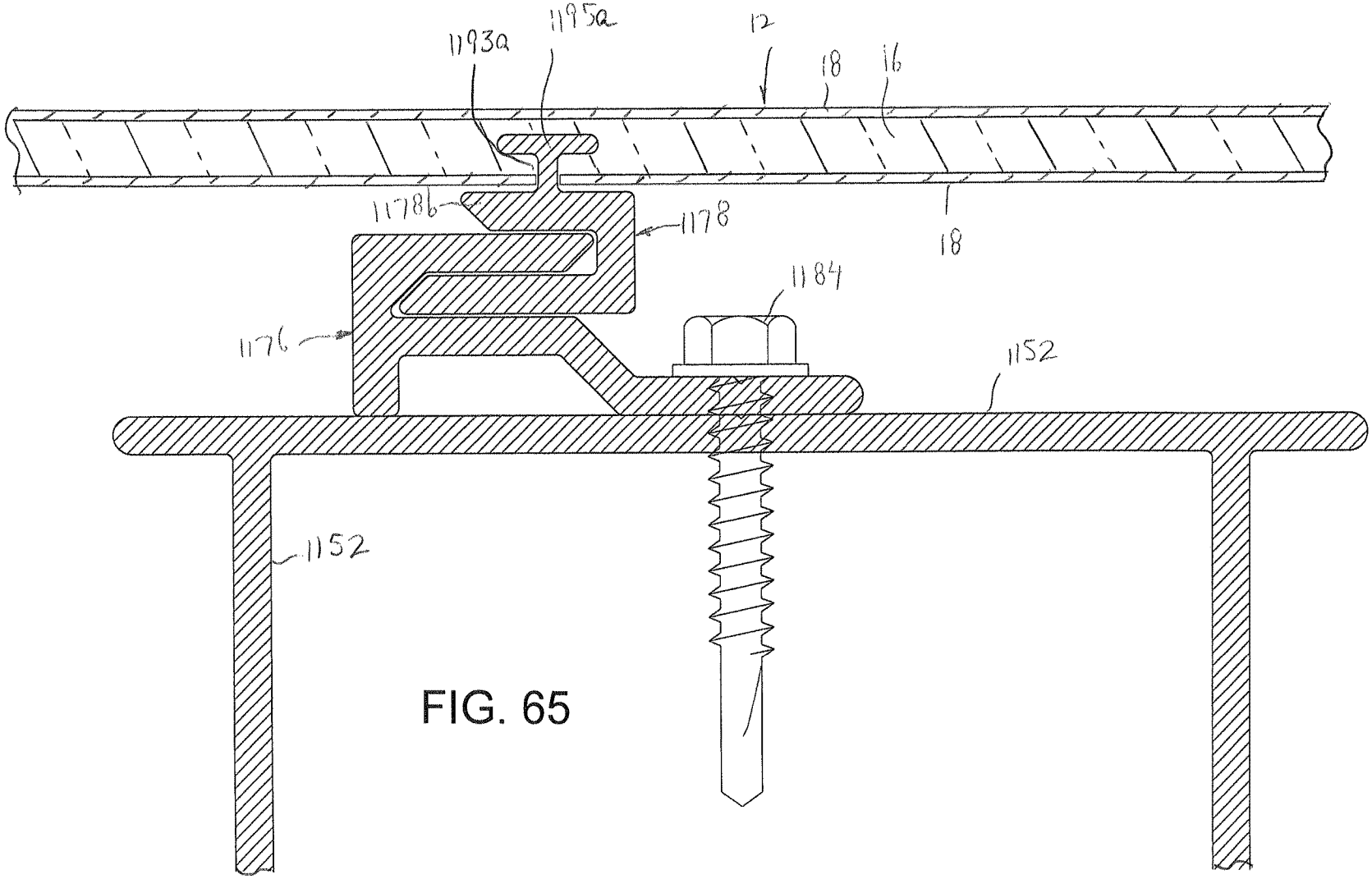
FIG. 65 is a cross-sectional view of a modification of the system of FIG. 61.

As a further modification, as shown in FIG. 63, base support 176 can be secured instead on a U-channel furring 1152 of the type shown in FIG. 53 in order to provide further separation of wall panels 12 from existing wall 14. FIGS. 64 and 65 show further modifications of FIGS. 62 and 63, respectively, in which dovetail shaped grooves 1193 are eliminated, and in place thereof, there are elongated T-shaped openings 1193*a* in polyethylene core 16 and the thin aluminum wall 18 covering the inner surface thereof. In place of dovetail shaped projections 1195, T-shaped projections 1195*a* extend from the outer surface of wall 1178*b* for sliding reception within T-shaped openings 1193*a*.

Figure 66:
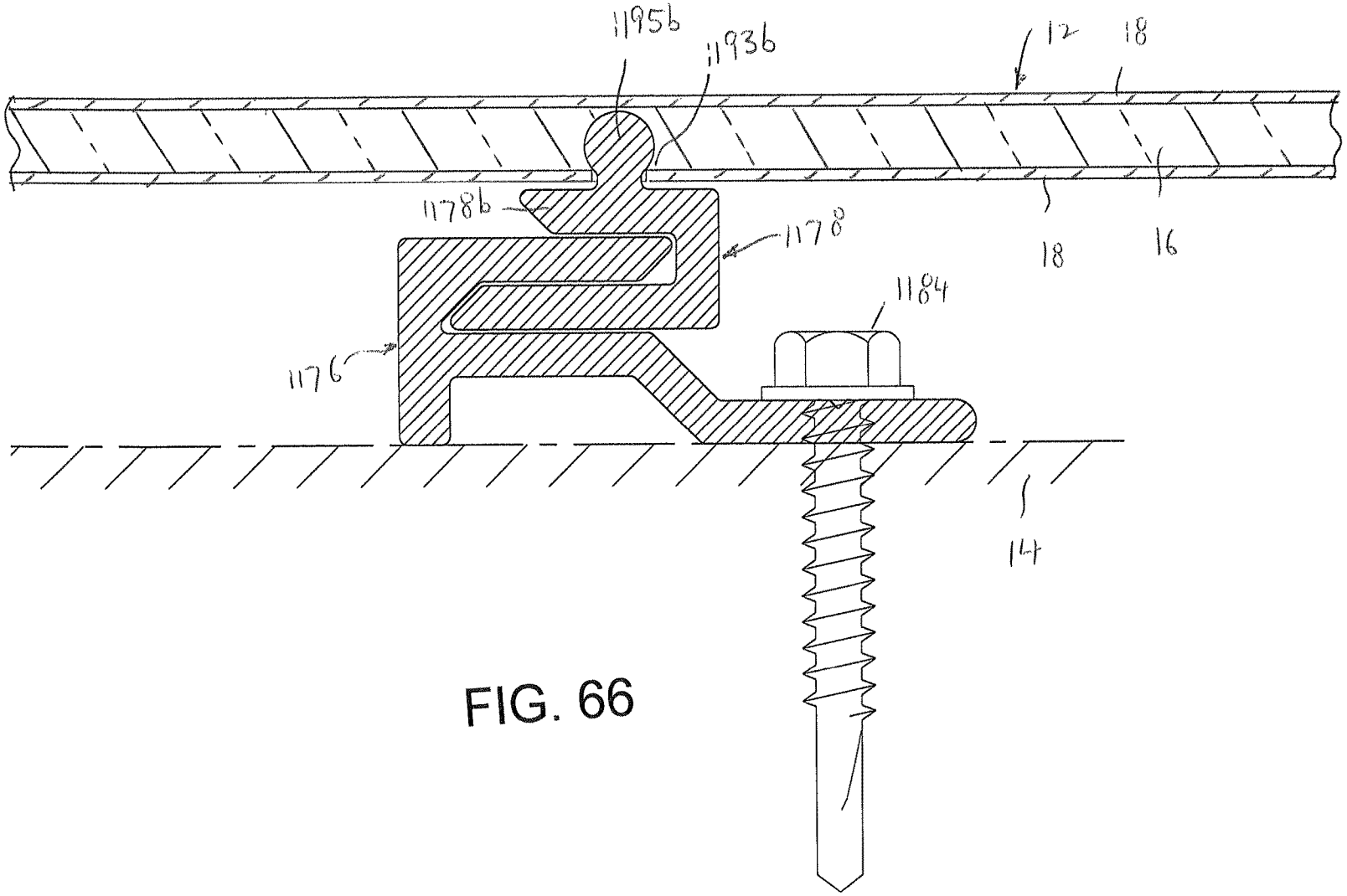
FIG. 66 is a cross-sectional view of a modification of the system of FIG. 61.
Figure 67:
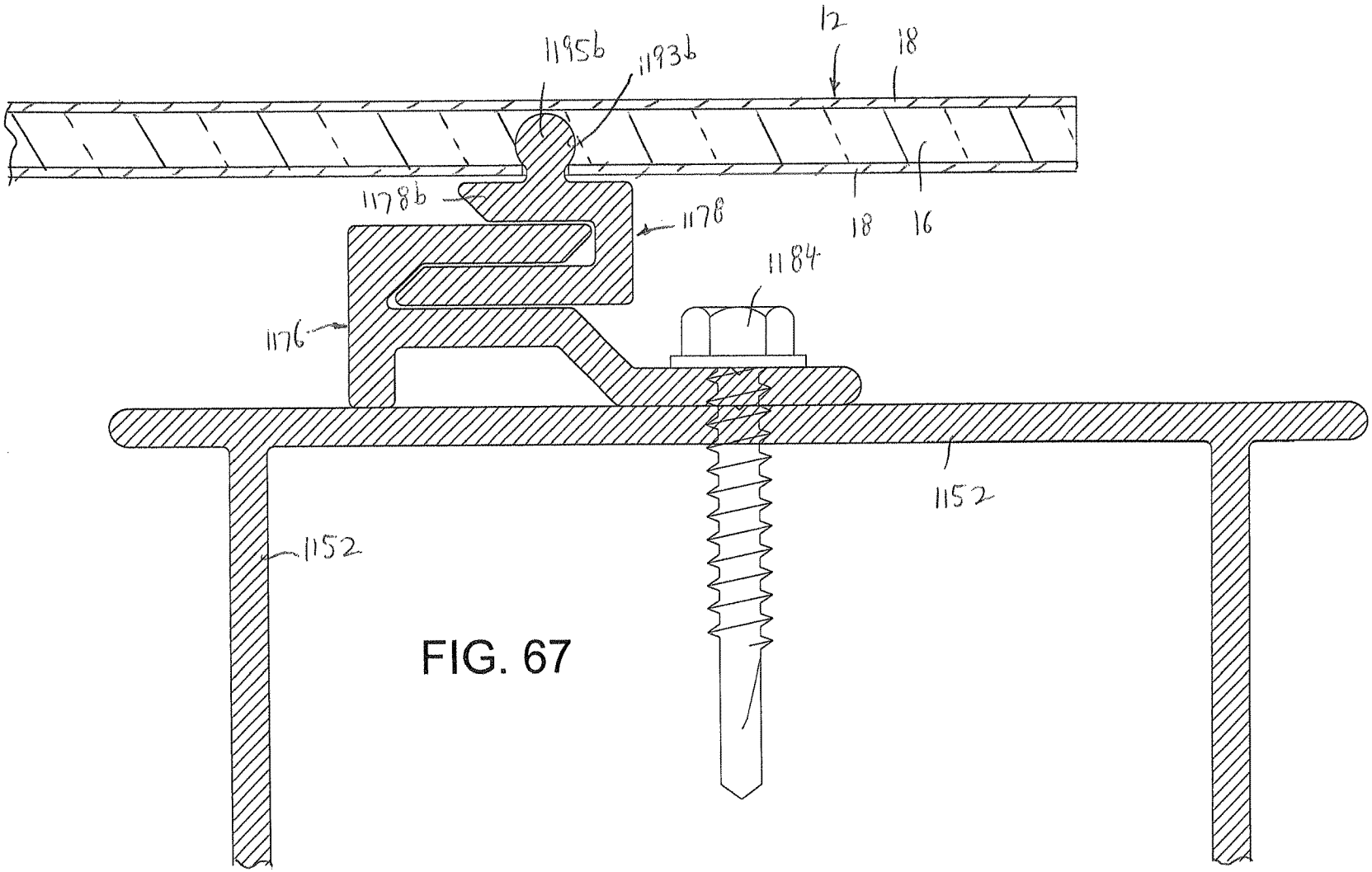
FIG. 67 is a cross-sectional view of a modification of the system of FIG. 61.

Alternatively, as shown in FIGS. 66 and 67, which show further modifications of FIGS. 62 and 63, respectively, dovetail shaped grooves 1193 are eliminated, and in place thereof, there are elongated bulbous shaped openings 1193*b* in polyethylene core 16 and the thin aluminum wall 18 covering the inner surface thereof. In place of dovetail shaped projections 1195, elongated bulbous projections 1195*b* extend from the outer surface of wall 1178*b* for sliding reception within bulbous openings 1193*b*.

Figure 68:
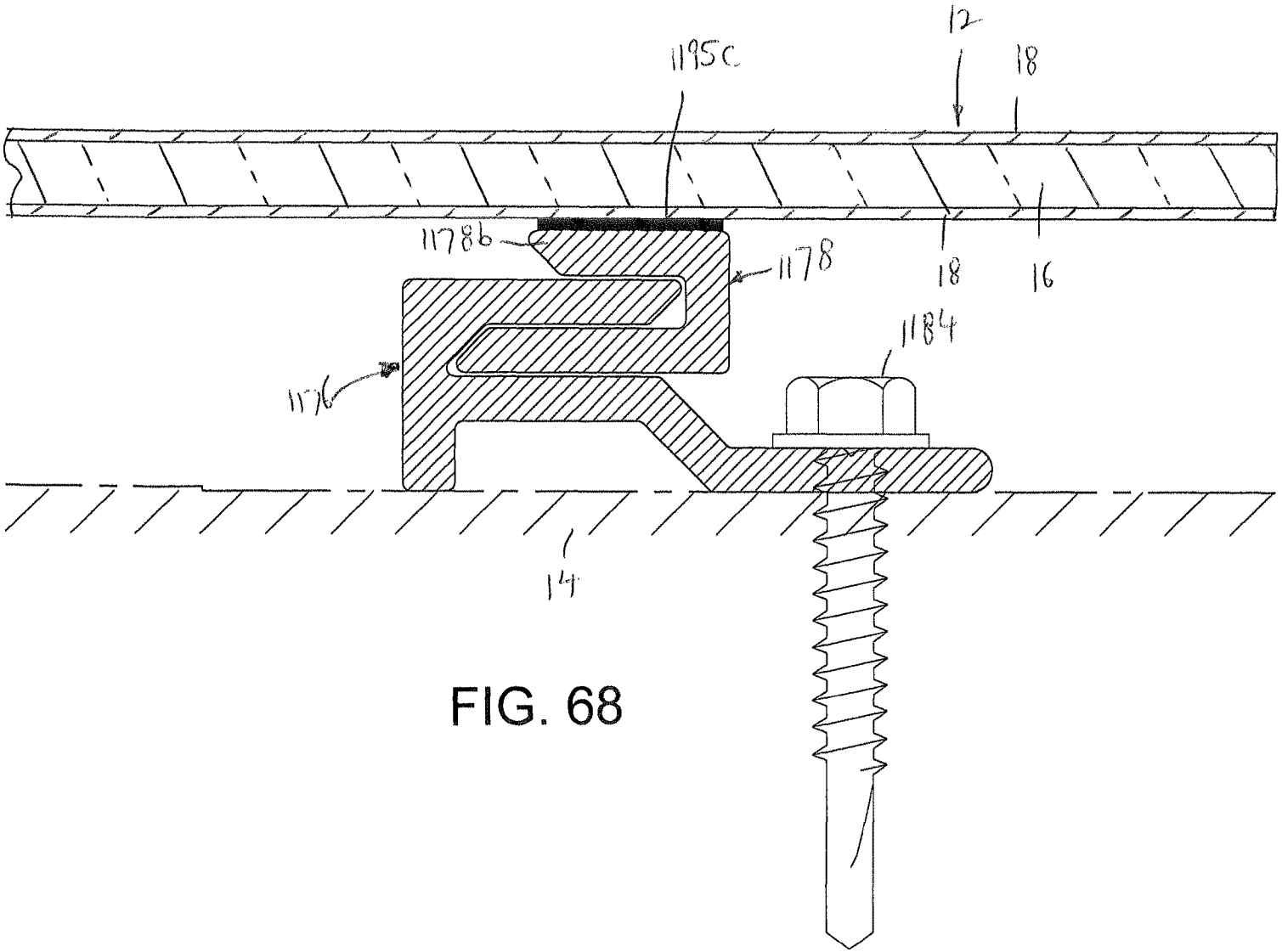
FIG. 68 is a cross-sectional view of a modification of the system of FIG. 61.
Figure 69:
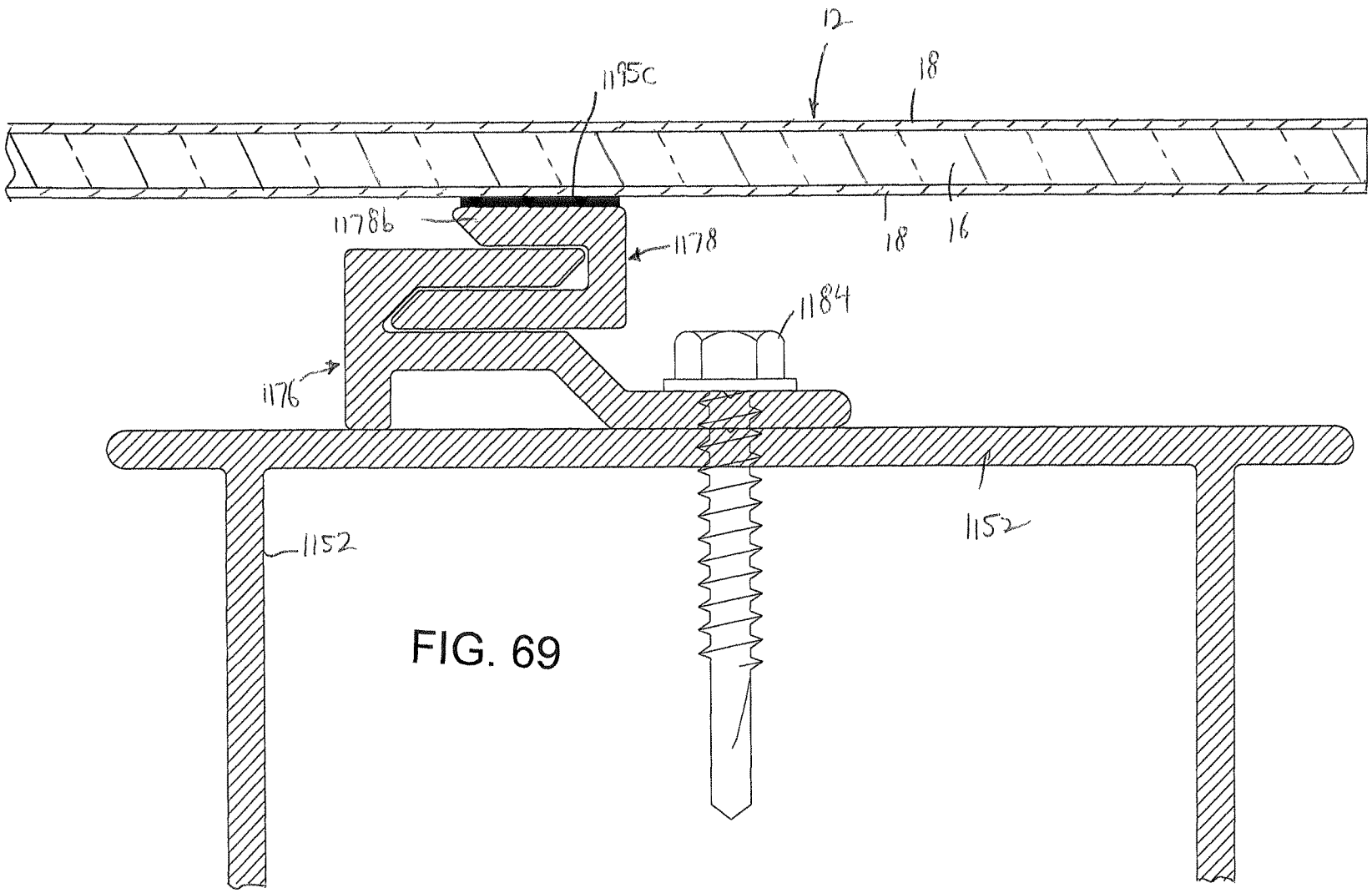
FIG. 69 is a cross-sectional view of a modification of the system of FIG. 61.

FIGS. 68 and 69 show further modifications of FIGS. 62 and 63, respectively, in which dovetail shaped grooves 1193 and dovetail shaped projections 1195 are eliminated, and in place thereof, a double sided adhesive strip 1195*c* is positioned between the outer surface of wall 1178*b* and the inner surface of wall panel 12 to secure the same together.

Figure 70:
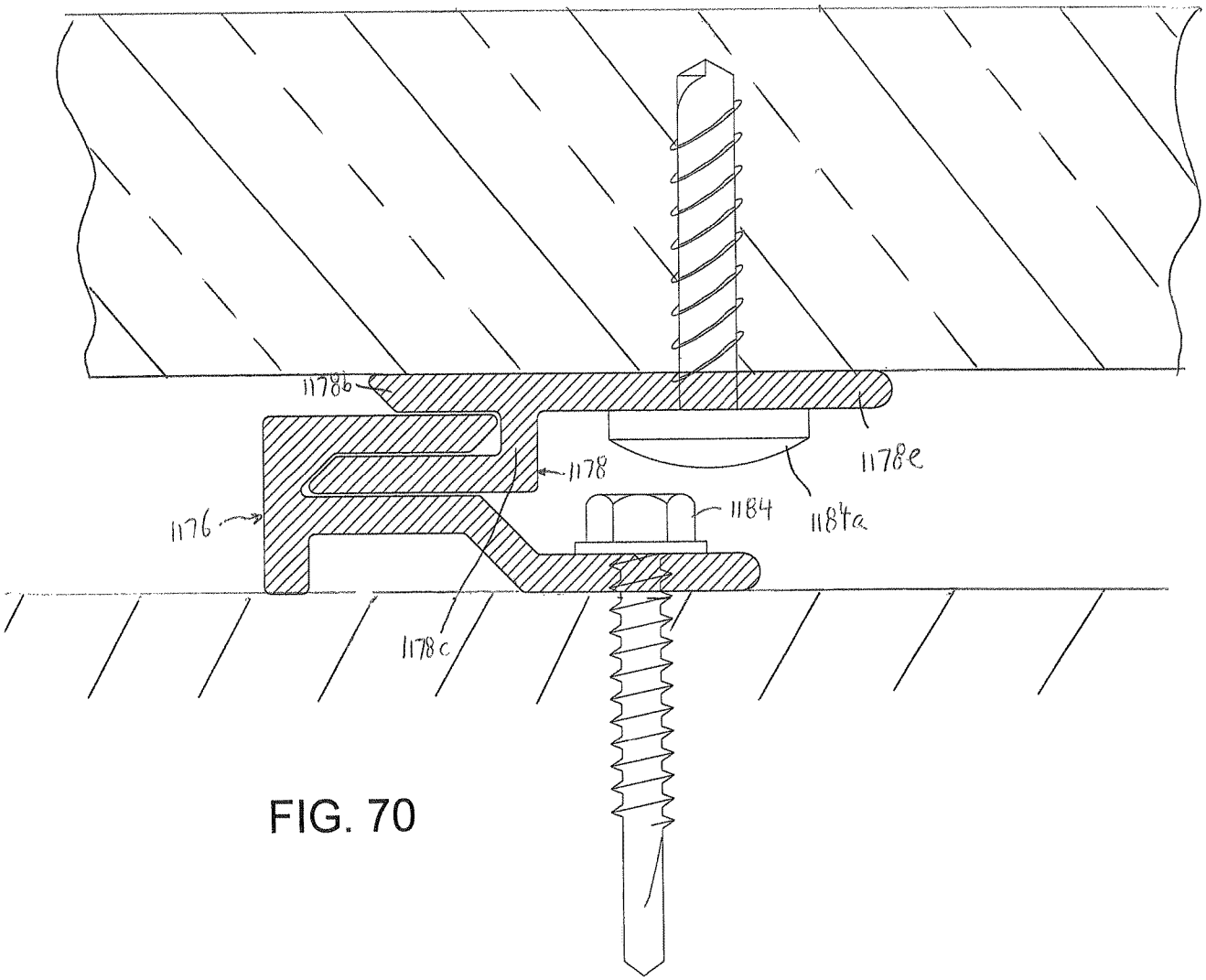
FIG. 70 is a cross-sectional view of a modification of the system of FIG. 61.

FIG. 70 shows a further modification in which wall 1178*b* is extended to the opposite side of connecting plate 1178*c* to form a tail wall 1178*e* which is connected to wall panel by screws 1184*a*.

It will be appreciated that some or all elements of all of the above discussed structural connections can be made of a thermally insulating material.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall, comprising a plurality of intermediary supports for supporting the wall panels, each said intermediary support including:

an intermediary support base adapted to be secured to the existing wall, said intermediary support base including:

a base plate adapted to be secured to the existing wall, a first support base retaining wall connected with a first side of said base plate, said first support base retaining wall including a first wall extending outwardly from a first surface of said base plate and a second wall extending from said first wall in overlying spaced relation relative to said first surface of said base plate, said second wall having an inner free edge, and a second support base retaining wall connected with a second opposite side of said base plate, said second support base retaining wall including a third wall extending outwardly from the first surface of said base plate and a fourth wall extending from said third wall in overlying spaced relation relative to said first surface of said base plate, said fourth wall having an inner free edge, said second and fourth walls extending toward each other, with an opening defined between the inner free edges of said second and fourth walls in a widthwise direction of said intermediary support base; and a sliding member adapted to be slidably connected with said base plate, such that one said wall panel is adapted to be secured on said sliding member for sliding movement relative to the intermediary support base with said sliding member, said sliding member having a first widthwise dimension between outer lengthwise edges thereof which permits entry and exit of said sliding member through said opening defined between the inner free edges of said second and fourth walls so as to be positioned within and withdrawn from said first and second support base retaining walls and which permits widthwise sliding adjustment of said sliding member between said first and second support base retaining walls, said sliding member having a first wing member adapted to be positioned in said first support base retaining wall and an opposite second wing member adapted to be positioned in said second support base retaining wall in order to slidably hold said sliding member on said base plate, and said first widthwise dimension being such that when said second wing member is positioned fully within said second support base retaining wall, said first wino member is positioned completely out of said first support base retaining wall.

2. A system for mounting wall panels to an existing wall according to claim 1, wherein:

said sliding member includes:

a central member dimensioned to fit between said first and second support base retaining walls, said first wing member at a first side of said central member for engagement within said first support base retaining wall, and said second wing member at a second opposite side of said central member for engagement within said second support base retaining wall, and said first widthwise dimension is defined between outer free lengthwise edges of said first and second wing members.

3. A system for mounting wall panels to an existing wall according to claim 1, further comprising a securement arrangement for securing the sliding member to a wall panel, the securement arrangement including one of the following:

an adhesive member secured between the sliding member and the wall panel, at least one projection extending from the sliding member or the wall panel, and at least one groove in the other of the sliding member and the wall panel for receiving the at least one projection, each groove having a shape complementary to each respective projection received therein, and screws for securing the sliding member to the wall panel.

4. A system for mounting wall panels to an existing wall according to claim 3, wherein each projection has a shape in cross-section selected from the group consisting of:

a trapezoid, diverging planar walls, a T-shape, and a bulbous shape.

5. A system for mounting wall panels to an existing wall according to claim 1, further comprising a stiffener element which fixes the distance between adjacent support bases and which provides further support for wall panels positioned thereon.

6. A system for mounting wall panels to an existing wall according to claim 5, wherein each stiffener element includes:

a stiffener plate;

first and second separation walls extending from an underside of the stiffener plate and against which adjacent intermediary support bases abut in order to fix the distance between adjacent support bases; and first and second limit walls at a center portion thereof against which ends of adjacent wall panels are adapted to abut when seated on the stiffener plate.

7. A system for mounting wall panels to an existing wall according to claim 1, wherein said first and second wing members each have a widthwise dimension, and the widthwise dimension of said first wing member is less than the widthwise dimension of said second wing member.

8. A system for mounting wall panels to an existing wall, comprising a plurality of intermediary supports for supporting the wall panels, each said intermediary support including:

an intermediary support base adapted to be secured to the existing wall, said intermediary support base including:

a base plate adapted to be secured to the existing wall, a first support base retaining wall connected with a first side of said base plate, said first support base retaining wall including a first wall extending outwardly from a first surface of said base plate and a second wall extending from said first wall in overlying spaced relation relative to said first surface of said base plate, said second wall having an inner free edge, and the first support base retaining wall having a first width, and a second support base retaining wall connected with a second opposite side of said base plate, said second support base retaining wall including a third wall extending outwardly from the first surface of said base plate and a fourth wall extending from said third wall in overlying spaced relation relative to said first surface of said base plate, said fourth wall having an inner free edge, the second support base retaining wall having a second width which is greater than said first width, said second and fourth walls extending toward each other, with an opening defined between the inner free edges of said second and fourth walls in a widthwise direction of said intermediary support base; and a sliding member adapted to be slidably connected with said base plate, such that one said wall panel is adapted to be secured on said sliding member for sliding movement relative to the intermediary support base with said sliding member, said sliding member having a first widthwise dimension between outer lengthwise edges thereof which permits entry and exit of said sliding member through said opening defined between the inner free edges of said second and fourth walls so as to be positioned within and withdrawn from said first and second support base retaining walls and which permits widthwise sliding adjustment of said sliding member between said first and second support base retaining walls, said sliding member having a first wing member adapted to be positioned in said first support base retaining wall and an opposite second wing member adapted to be positioned in said second support base retaining wall in order to slidably hold said sliding member on said base plate, and said first widthwise dimension being such that when said second wing member is positioned fully within said second support base retaining wall, said first wing member is positioned completely out of said first support base retaining wall.

9. A system for mounting wall panels to an existing wall according to claim 8, wherein:

said sliding member includes:

a central member dimensioned to fit between said first and second support base retaining walls, said first wing member at a first side of said central member for engagement within said first support base retaining wall, the first wing member having a third width, and said second wing member at a second opposite side of said central member for engagement within said second support base retaining wall, the second wing member having a fourth width which is greater than said third width, and said first widthwise dimension is defined between outer free lengthwise edges of said first and second wing members.

10. A system for mounting wall panels to an existing wall according to claim 8, further comprising a securement arrangement for securing the sliding member to a wall panel, the securement arrangement including one of the following:

an adhesive member secured between the sliding member and the wall panel, at least one projection extending from the sliding member or the wall panel, and at least one groove in the other of the sliding member and the wall panel for receiving the at least one projection, each groove having a shape complementary to each respective projection received therein, and screws for securing the sliding member to the wall panel.

11. A system for mounting wall panels to an existing wall according to claim 10, wherein each projection has a shape in cross-section selected from the group consisting of:

a trapezoid, diverging planar walls, a T-shape, and a bulbous shape.

12. A system for mounting wall panels to an existing wall according to claim 8, further comprising a stiffener element which fixes the distance between adjacent support bases and which provides further support for wall panels positioned thereon.

13. A system for mounting wall panels to an existing wall according to claim 12, wherein each stiffener element includes:

a stiffener plate;

first and second separation walls extending from an underside of the stiffener plate and against which adjacent intermediary support bases abut in order to fix the distance between adjacent support bases; and first and second limit walls at a center portion thereof against which ends of adjacent wall panels are adapted to abut when seated on the stiffener plate.

* * * * *